US010661419B2

(12) United States Patent
Takahashi et al.

(10) Patent No.: US 10,661,419 B2
(45) Date of Patent: May 26, 2020

(54) STAPLER

(71) Applicant: MAX CO., LTD., Chuo-ku, Tokyo (JP)

(72) Inventors: Hiroaki Takahashi, Tokyo (JP); Tomoaki Kikai, Tokyo (JP)

(73) Assignee: MAX CO., LTD., Tokyo (JP)

( * ) Notice: Subject to any disclaimer, the term of this patent is extended or adjusted under 35 U.S.C. 154(b) by 136 days.

(21) Appl. No.: 16/080,082

(22) PCT Filed: Apr. 21, 2017

(86) PCT No.: PCT/JP2017/016115
§ 371 (c)(1),
(2) Date: Aug. 27, 2018

(87) PCT Pub. No.: WO2017/183728
PCT Pub. Date: Oct. 26, 2017

(65) Prior Publication Data

US 2019/0061129 A1 Feb. 28, 2019

(30) Foreign Application Priority Data

Apr. 22, 2016 (JP) ..... 2016-086604

(51) Int. Cl.
*B25C 5/02* (2006.01)
*B27F 7/19* (2006.01)
*B27F 7/21* (2006.01)

(52) U.S. Cl.
CPC ..... *B25C 5/0271* (2013.01); *B25C 5/02* (2013.01); *B25C 5/0207* (2013.01); *B27F 7/19* (2013.01);
(Continued)

(58) Field of Classification Search
CPC ..... B25C 5/00; B25C 5/02; B25C 5/0257; B25C 5/0228; B25C 5/0271;
(Continued)

(56) References Cited

U.S. PATENT DOCUMENTS 2,933,733 A * 4/1960 Strollis ..... B31B 50/00 227/85
4,431,127 A * 2/1984 Watanabe ..... B25B 31/005 227/76
(Continued)

FOREIGN PATENT DOCUMENTS

CN 2759787 Y 2/2006
JP 48-35779 U 4/1973
(Continued)

OTHER PUBLICATIONS

International Search Report and Written Opinion dated Aug. 16, 2017 in PCT/JP2017/016115.

*Primary Examiner* — Scott A Smith
(74) *Attorney, Agent, or Firm* — Rothwell, Figg, Ernst & Manbeck, P.C.

(57) ABSTRACT

To provide a stapler in which a staple leg of a nonmetal staple can be reliably bent with a small number of components and a simple configuration so as to reduce a cost. A stapler includes a penetration mechanism and a bending mechanism. Hole parts are provided in a pair of cutting blades of the penetration mechanism. The bending mechanism includes first and second bending members which protrude from the hole parts toward between the pair of cutting blades to bend a pair of staple legs, guide surfaces which guide the first and second bending members, and a slide member which drives the first and second bending members. The first and second bending members are provided between the guide surfaces and the slide member.

8 Claims, 54 Drawing Sheets

(52) U.S. Cl.
CPC ..... *B25C 5/0228* (2013.01); *B25C 5/0264* (2013.01); *B27F 7/21* (2013.01)

(58) Field of Classification Search
CPC ..... B25C 5/0264; B25C 5/0207; B27F 7/19; B27F 7/21; B27F 7/38; B42B 4/00; B42B 5/08
USPC .. 227/71, 76, 86, 93, 95, 98, 131, 134, 154, 227/155
See application file for complete search history.

(56) References Cited

U.S. PATENT DOCUMENTS 5,697,747 A * 12/1997 Sawada ..... B42C 9/0056 412/16
5,758,813 A * 6/1998 Kikuchi ..... B25C 5/0242 227/134
6,036,074 A * 3/2000 Manabe ..... B27F 7/19 227/131
6,698,640 B2 * 3/2004 Hakozaki ..... B27F 7/21 227/155
6,820,790 B2 * 11/2004 Ura ..... B27F 7/19 227/131
7,021,512 B1 * 4/2006 Nakamura ..... B25C 5/00 227/120
7,124,925 B2 * 10/2006 Ishizaki ..... B27F 7/19 227/155
8,038,378 B2 * 10/2011 Aoki ..... B42B 5/08 412/33
9,643,307 B2 * 5/2017 Kato ..... B25C 5/0257
2007/0023474 A1 * 2/2007 Smith ..... B25C 5/0207 227/155
2009/0136324 A1 5/2009 Aoki et al.
2010/0096430 A1 4/2010 Sugihara et al.
2014/0158738 A1 6/2014 Kato et al.
2017/0190038 A1 7/2017 Kato et al.

FOREIGN PATENT DOCUMENTS

JP 62-35779 U 3/1987
JP 2007-167978 A 7/2007
JP 2008-44053 A 2/2008
JP 2008-044060 A 2/2008
JP 2010-115773 A 5/2010
JP 2014-113679 A 6/2014
JP 2015-042442 A 3/2015
WO 2007/072939 A2 6/2007

* cited by examiner

[Fig. 1A]
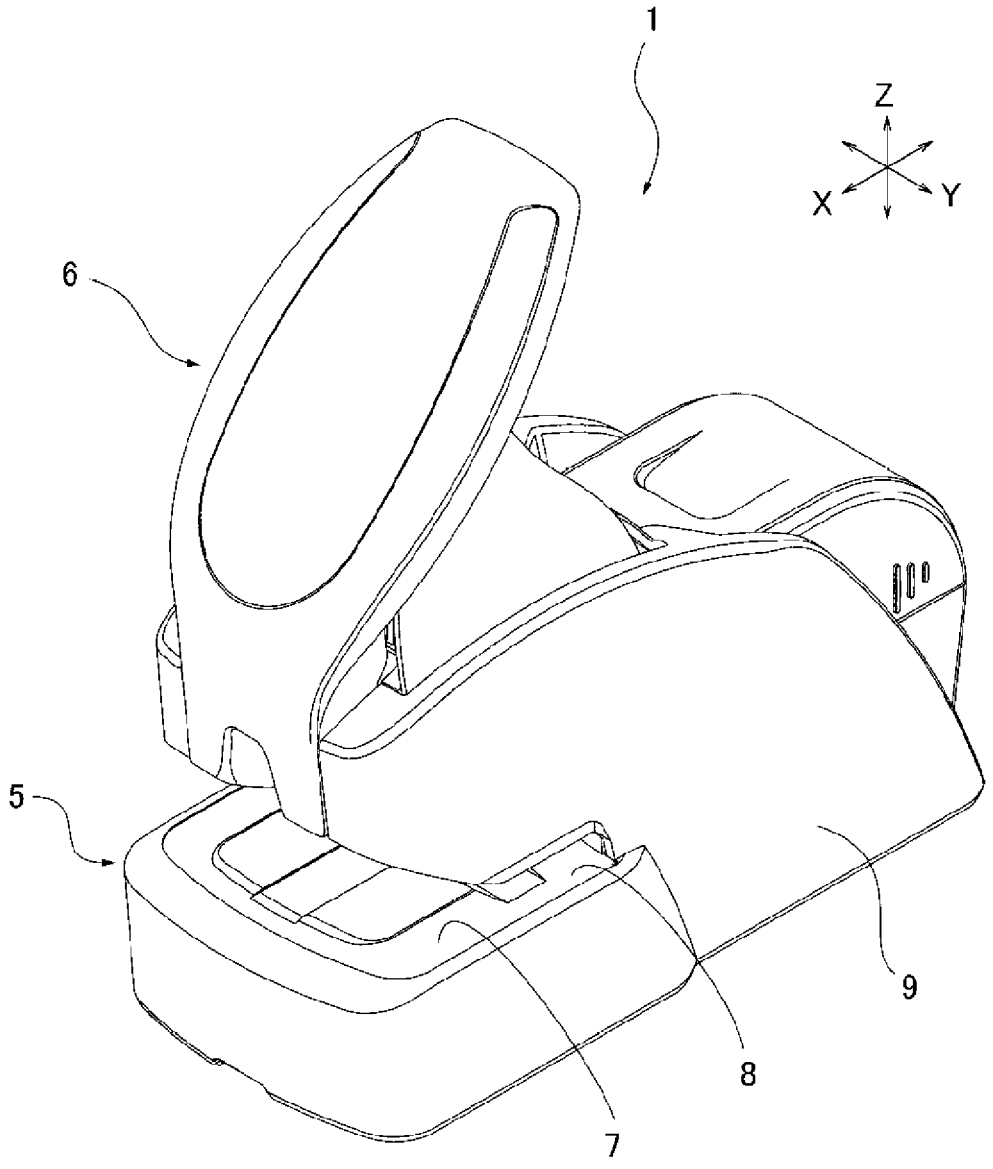

[Fig. 1B]
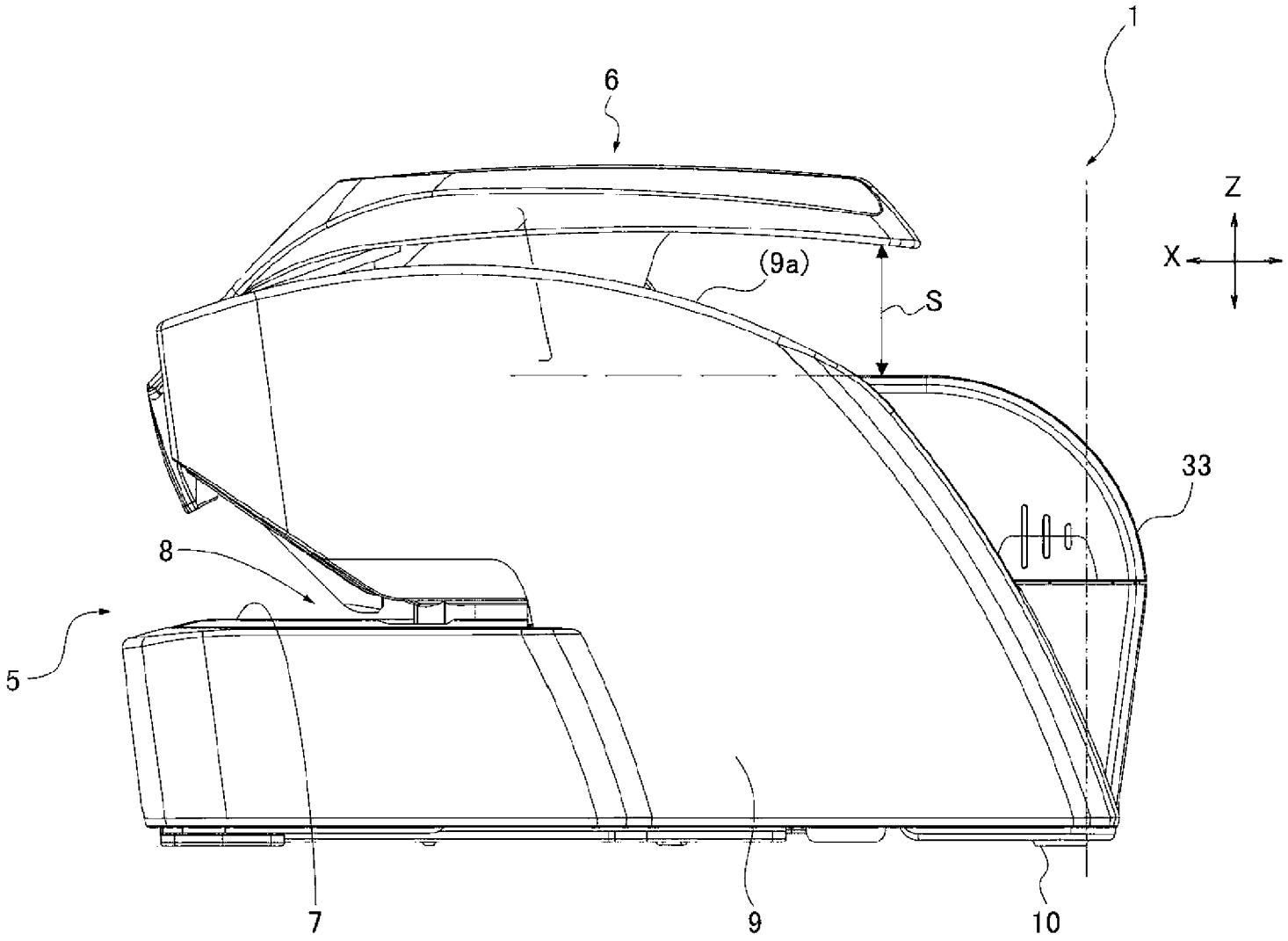

[Fig. 2]
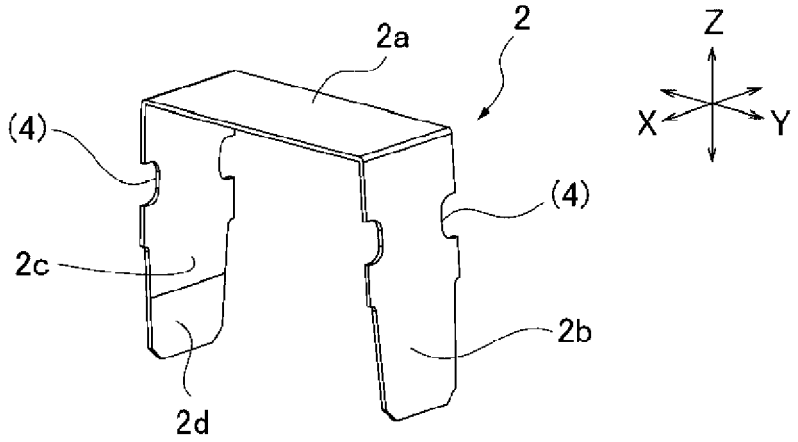
[Fig. 3]
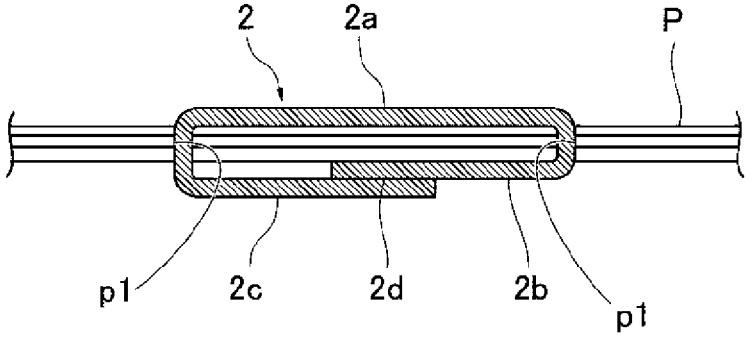
[Fig. 4]
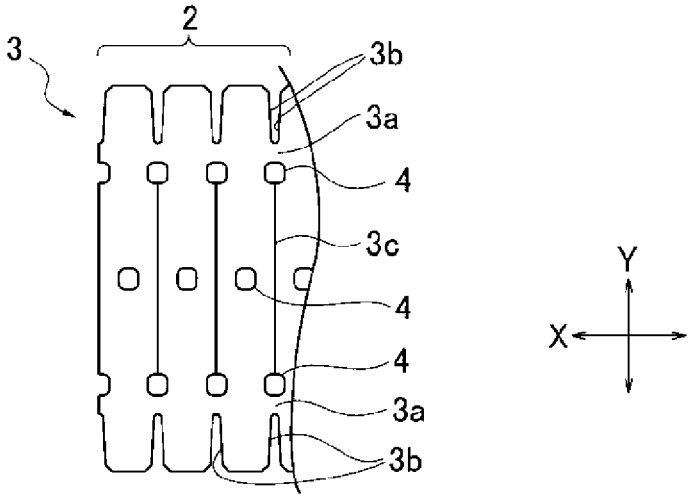

[Fig. 5]
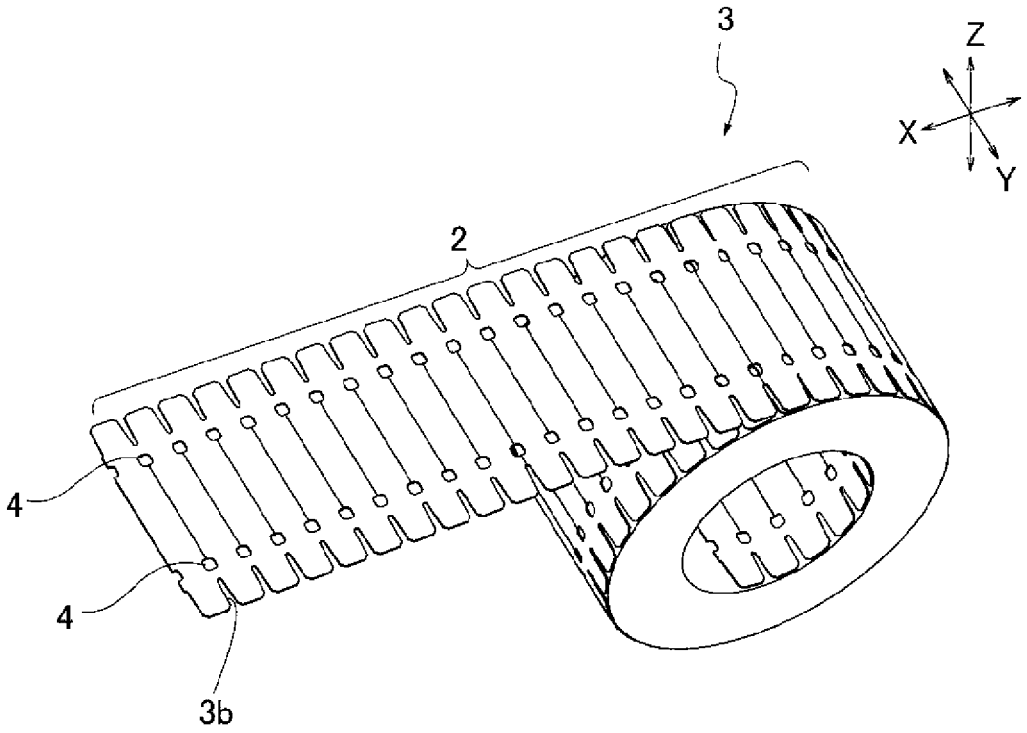
[Fig. 6]
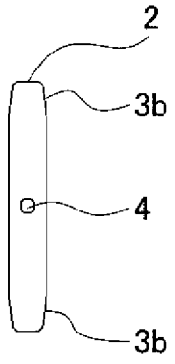

[Fig. 7]
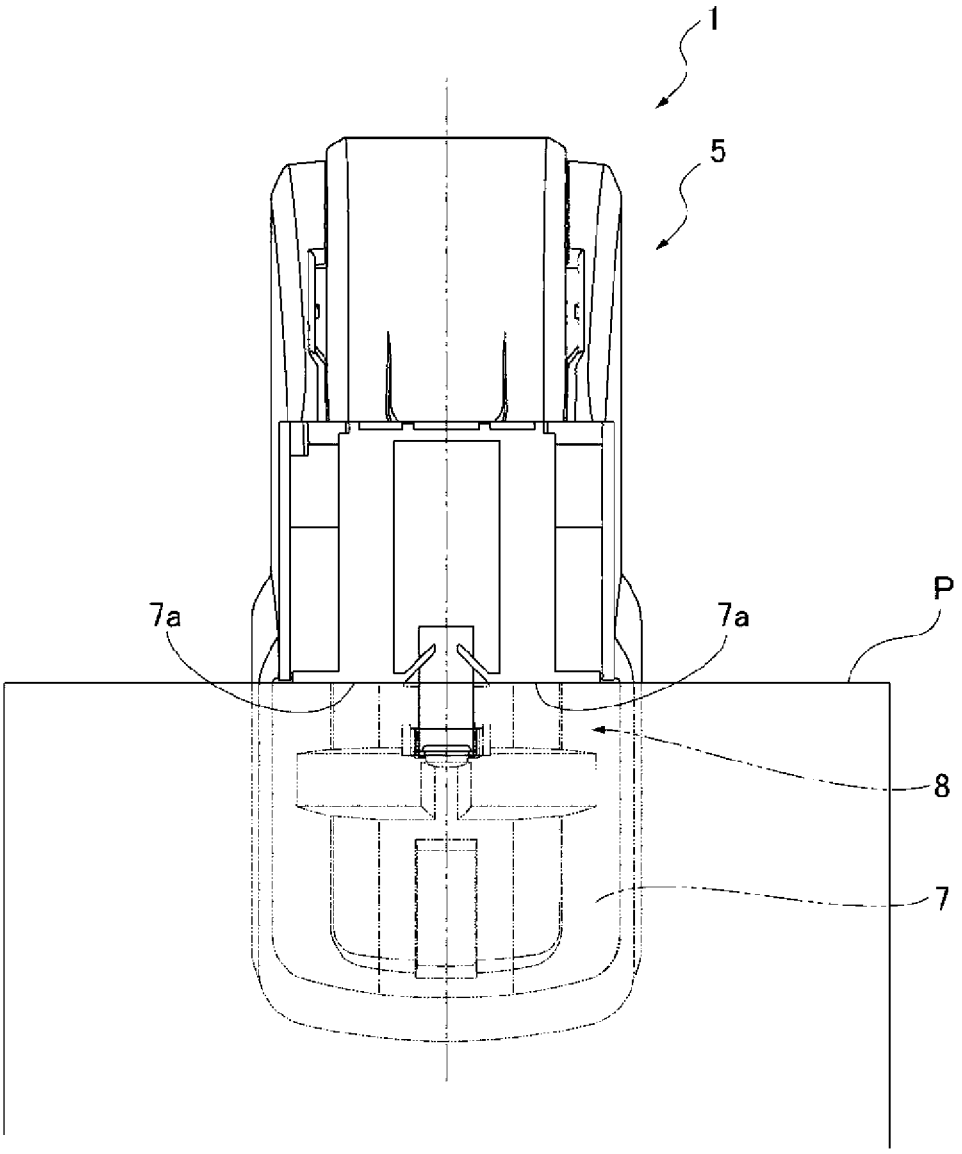

[Fig. 8]
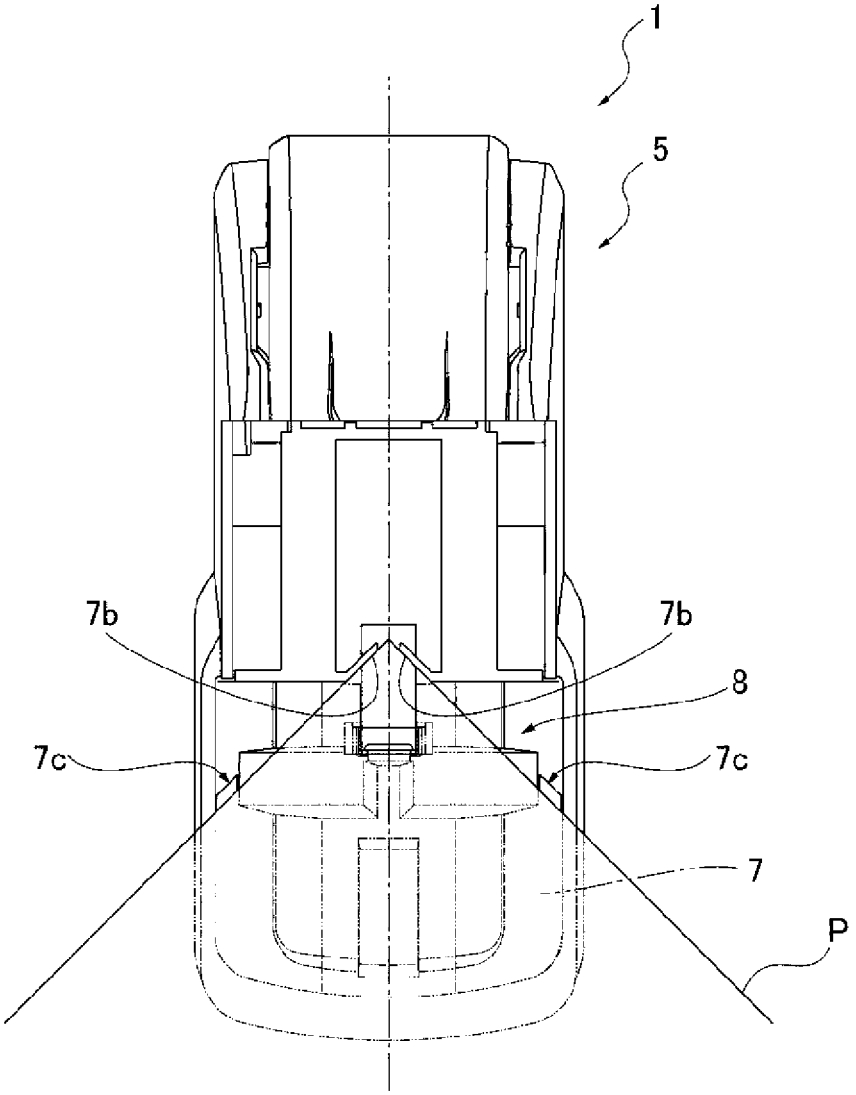

[Fig. 9]
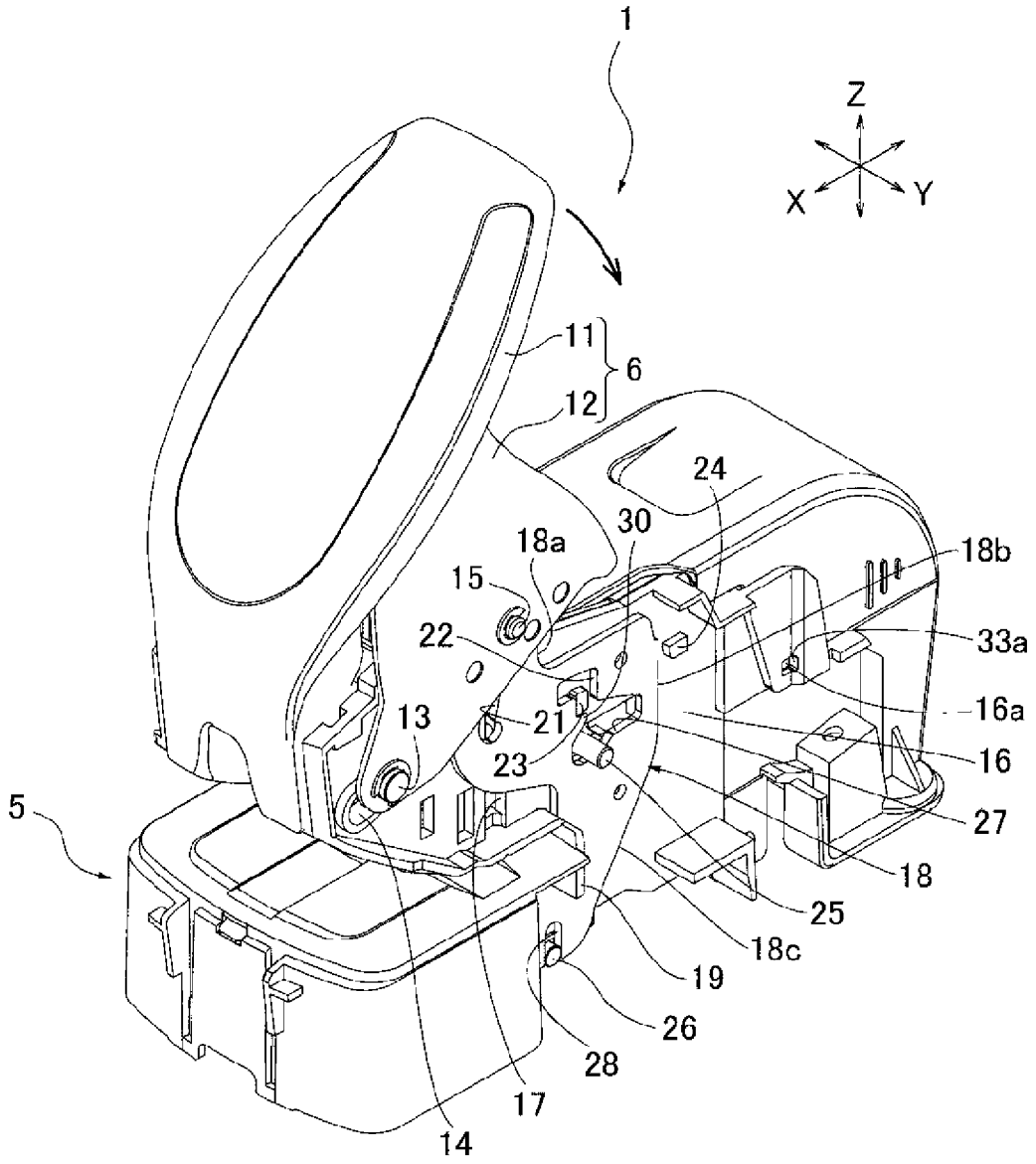

[Fig. 10]
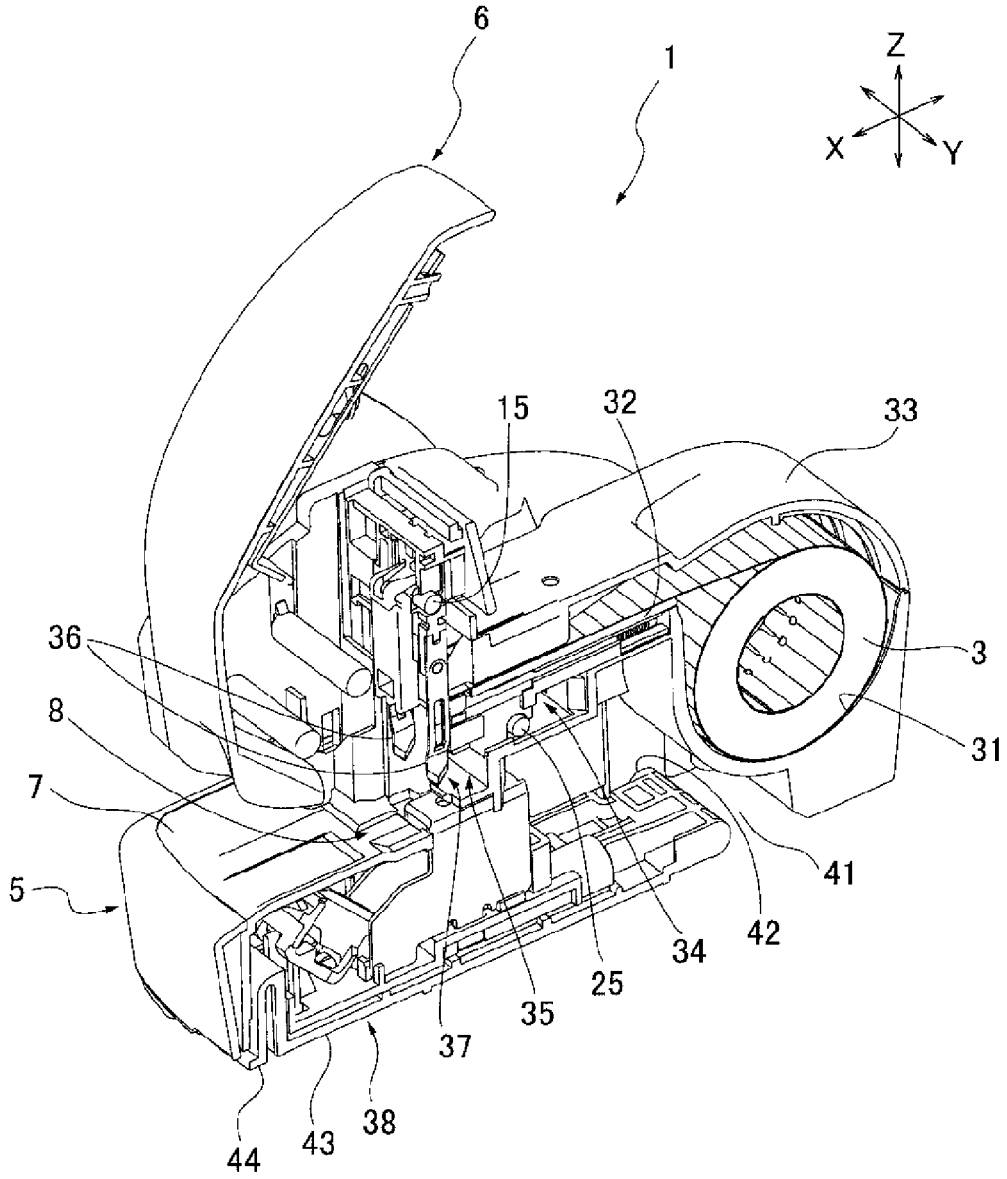

[Fig. 11]
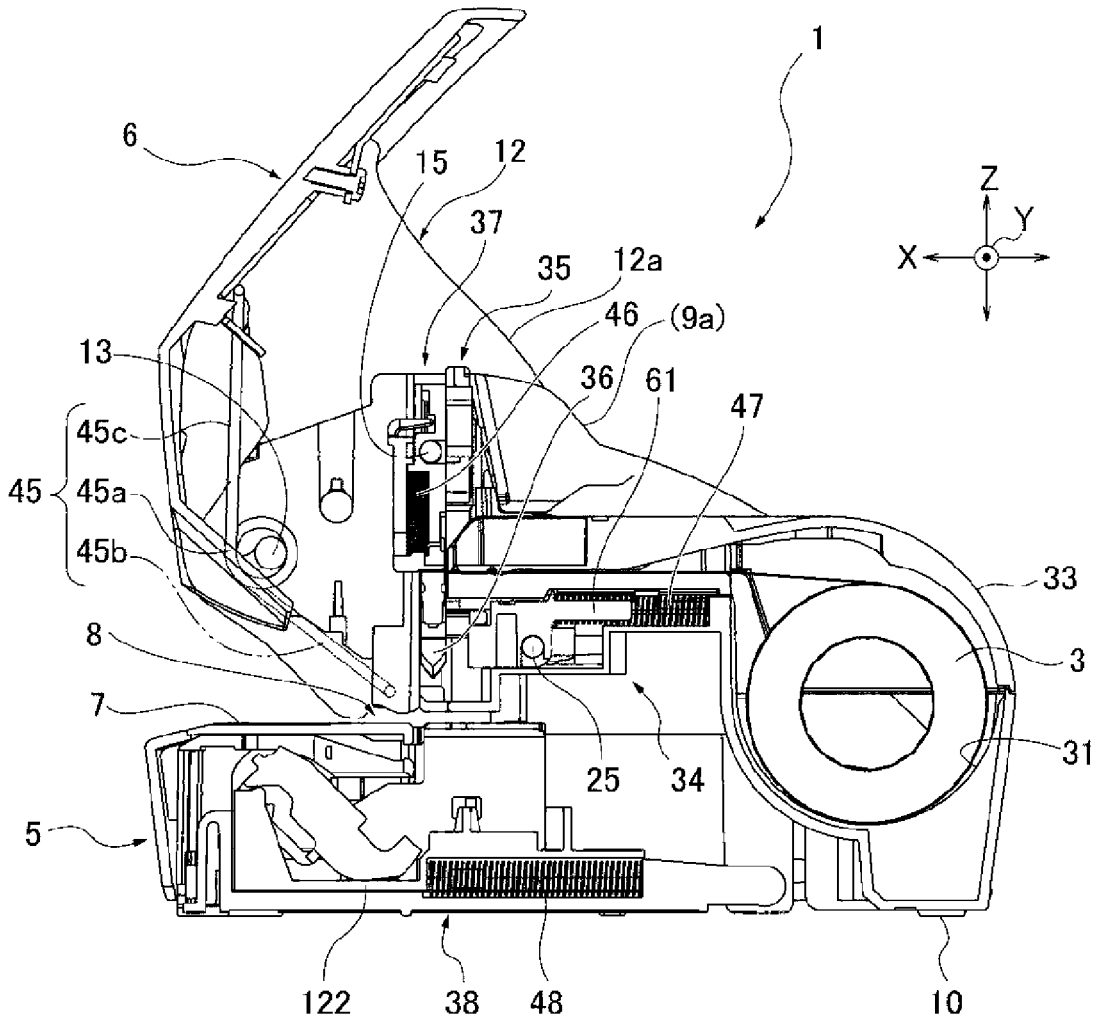

[Fig. 12A]
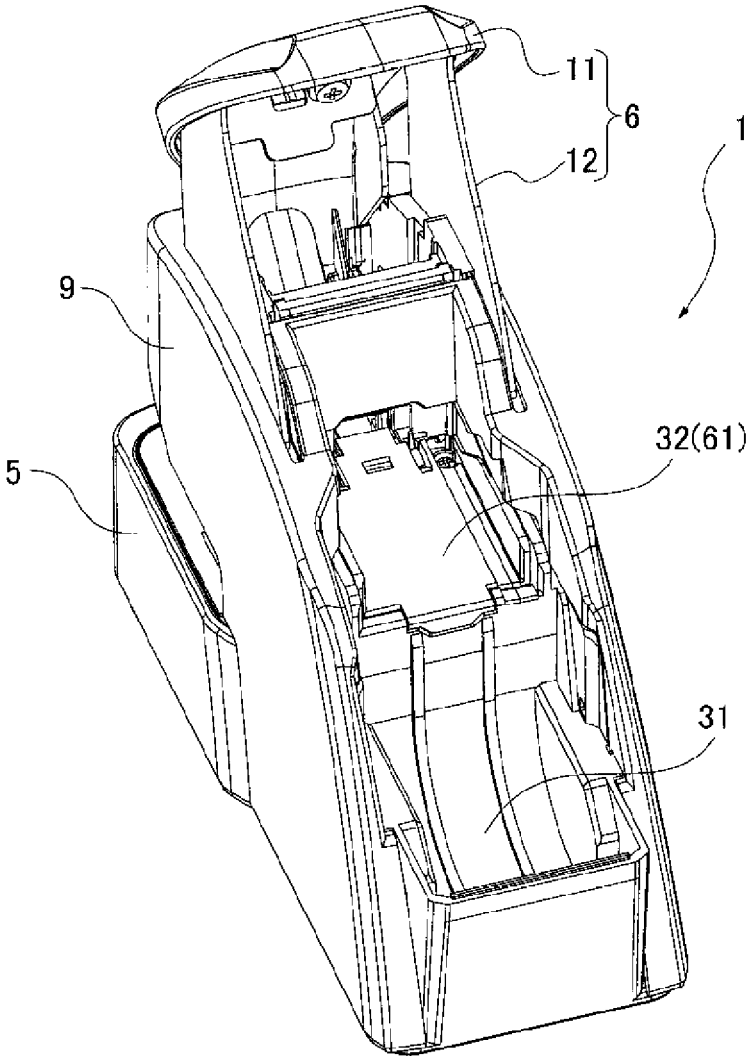
[Fig. 12B]
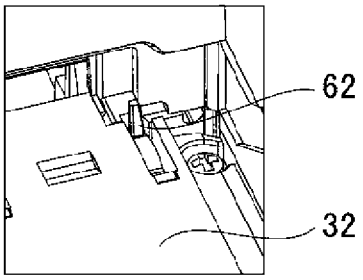

[Fig. 13A]
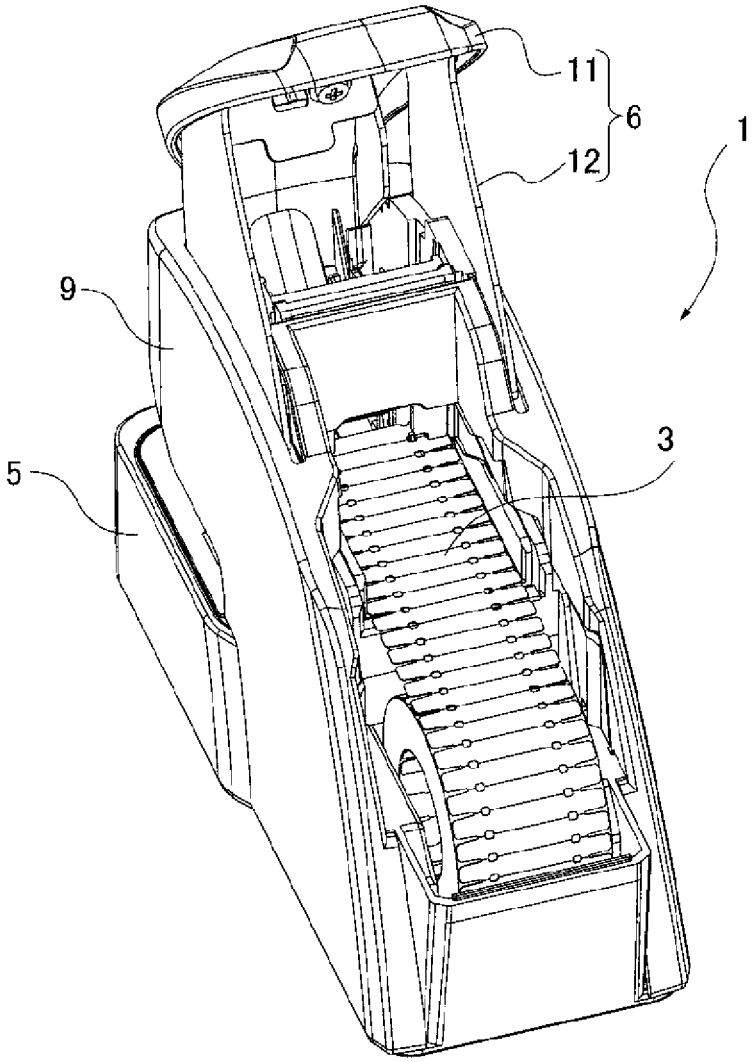
[Fig. 13B]
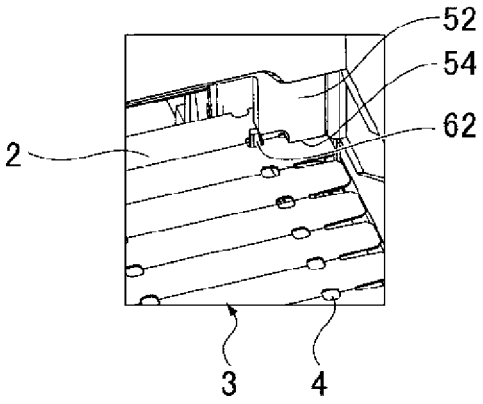

[Fig. 14A]
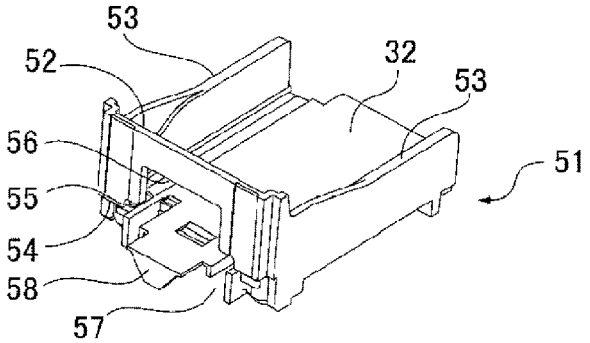
[Fig. 14B]
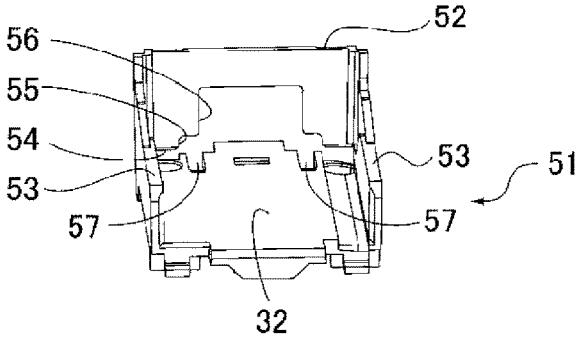
[Fig. 14C]
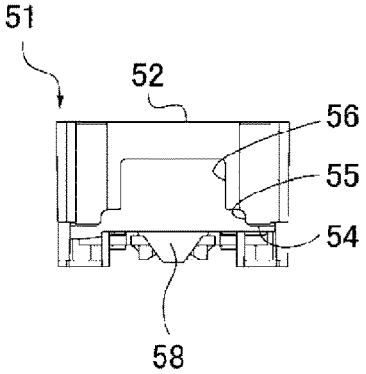
[Fig. 14D]
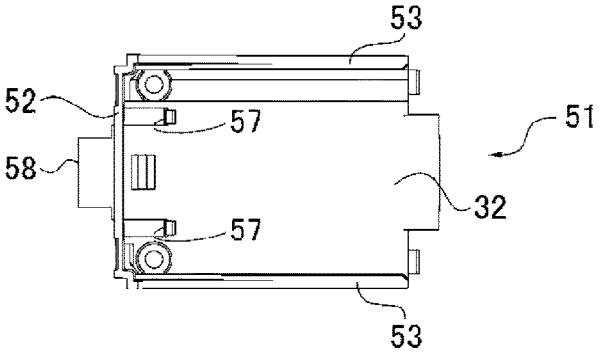

[Fig. 14E]
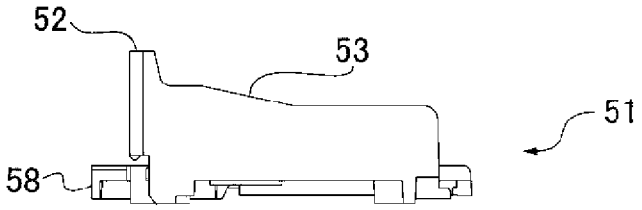

[Fig. 15]
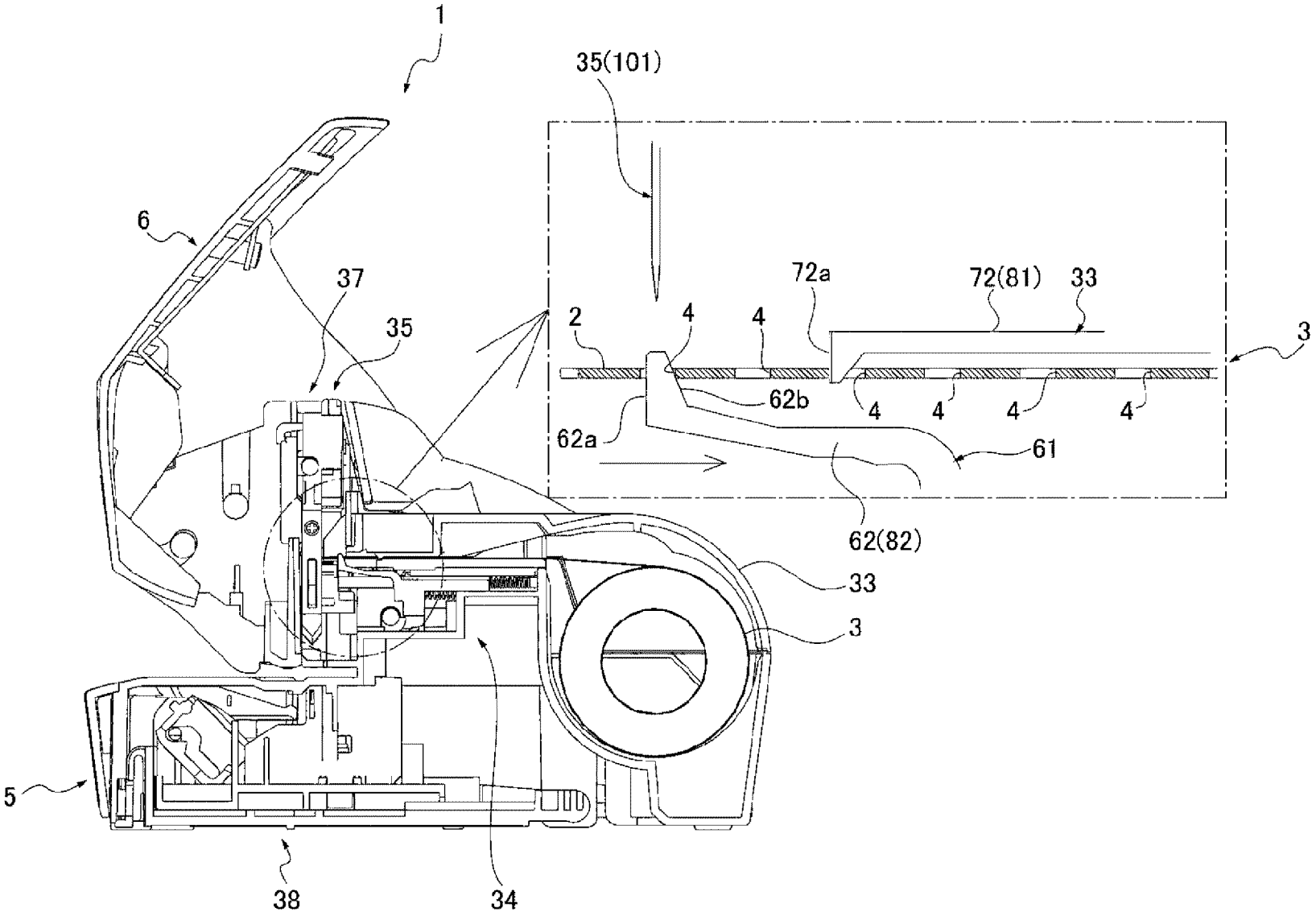

[Fig. 16A]
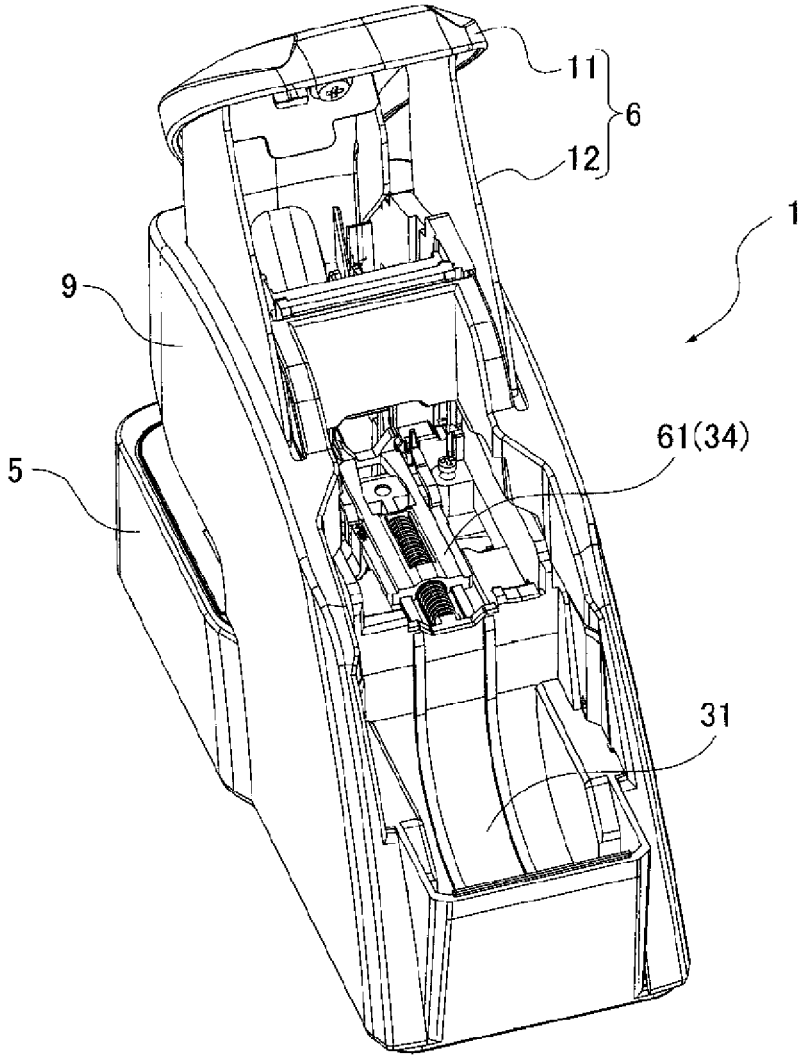
[Fig. 16B]
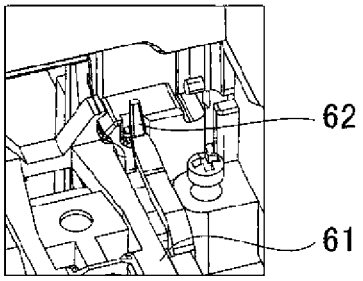

[Fig. 17A]
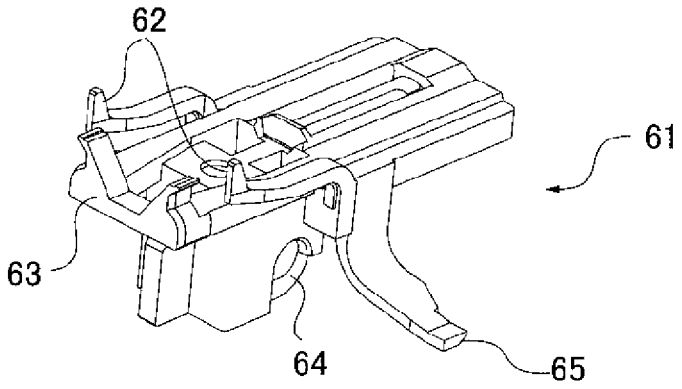
[Fig. 17B]
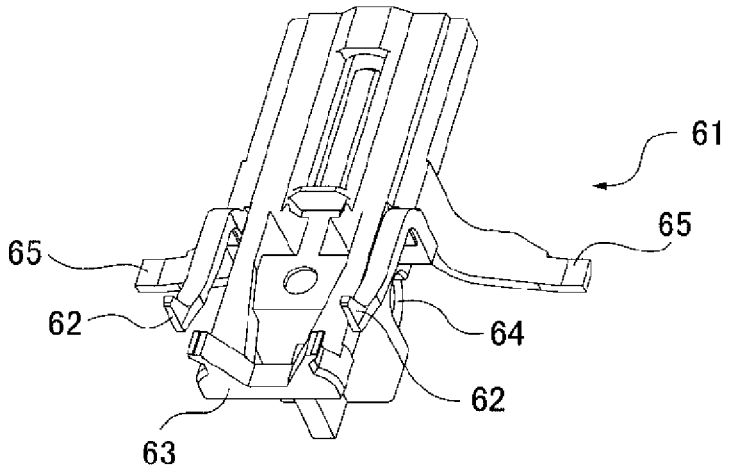
[Fig. 17C]
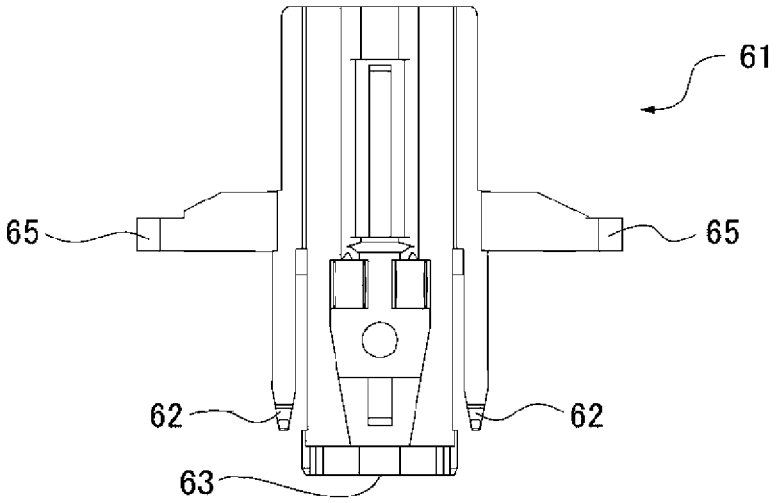

[Fig. 18]
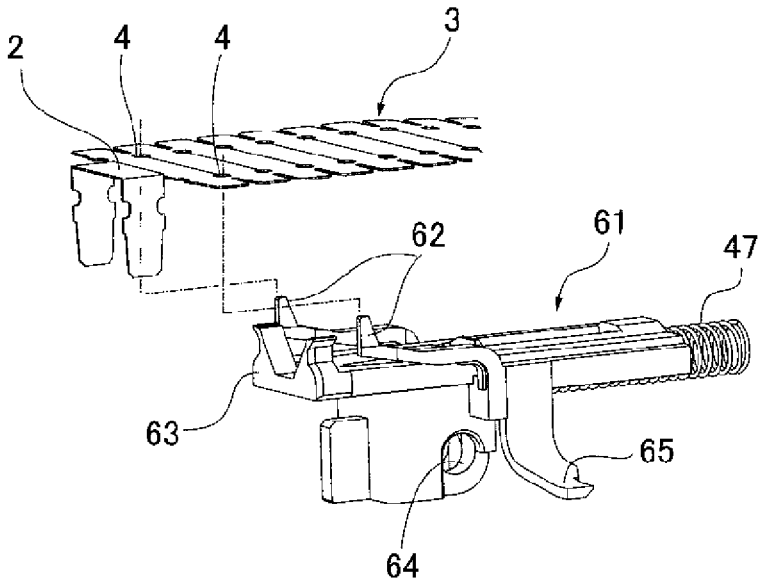
[Fig. 19]
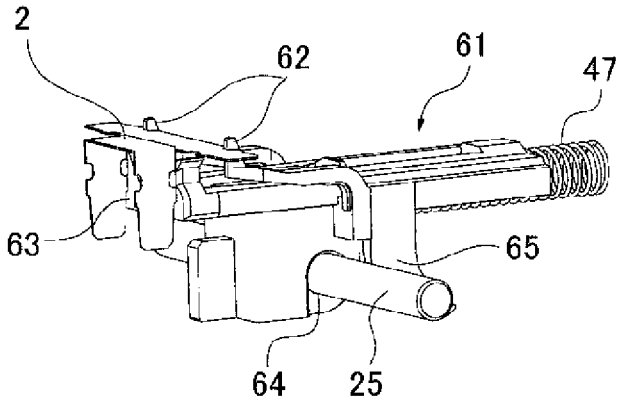

[Fig. 20]
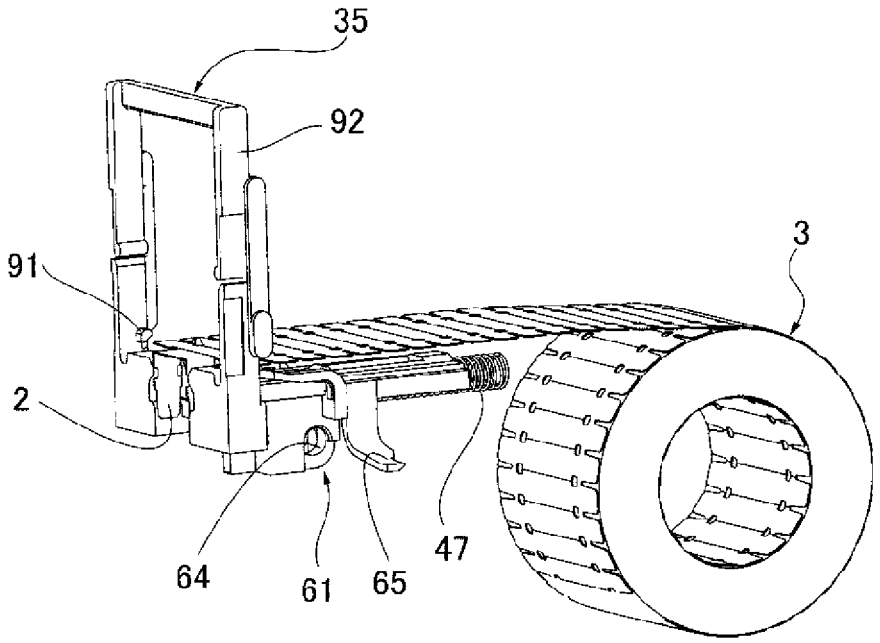
[Fig. 21]
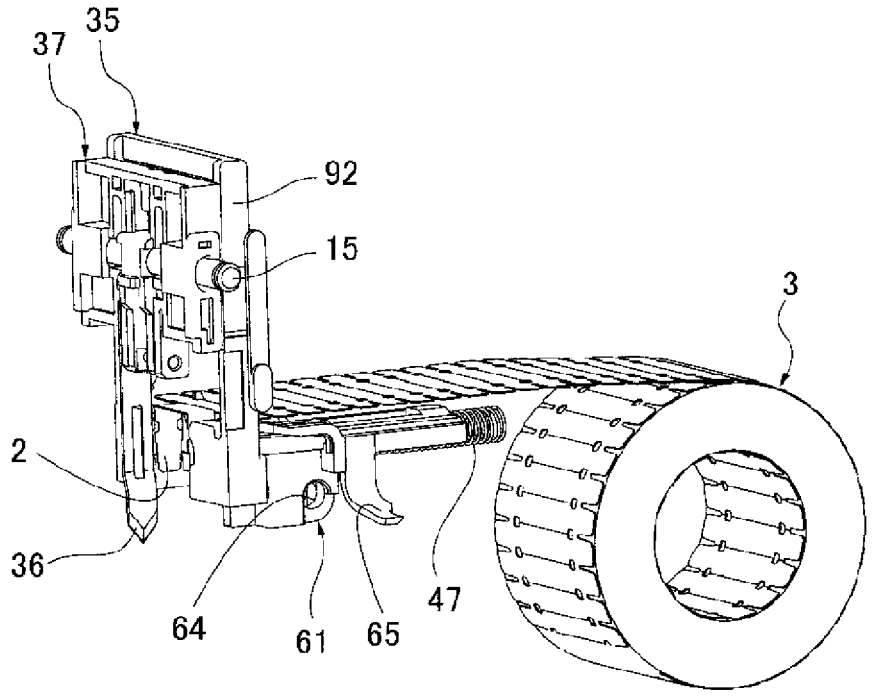

[Fig. 22]
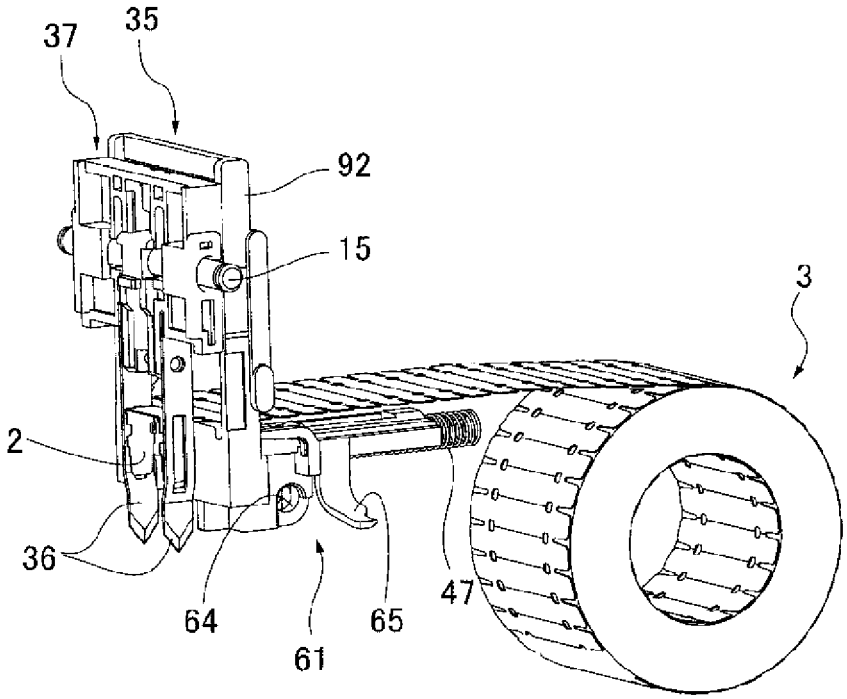

[Fig. 23]
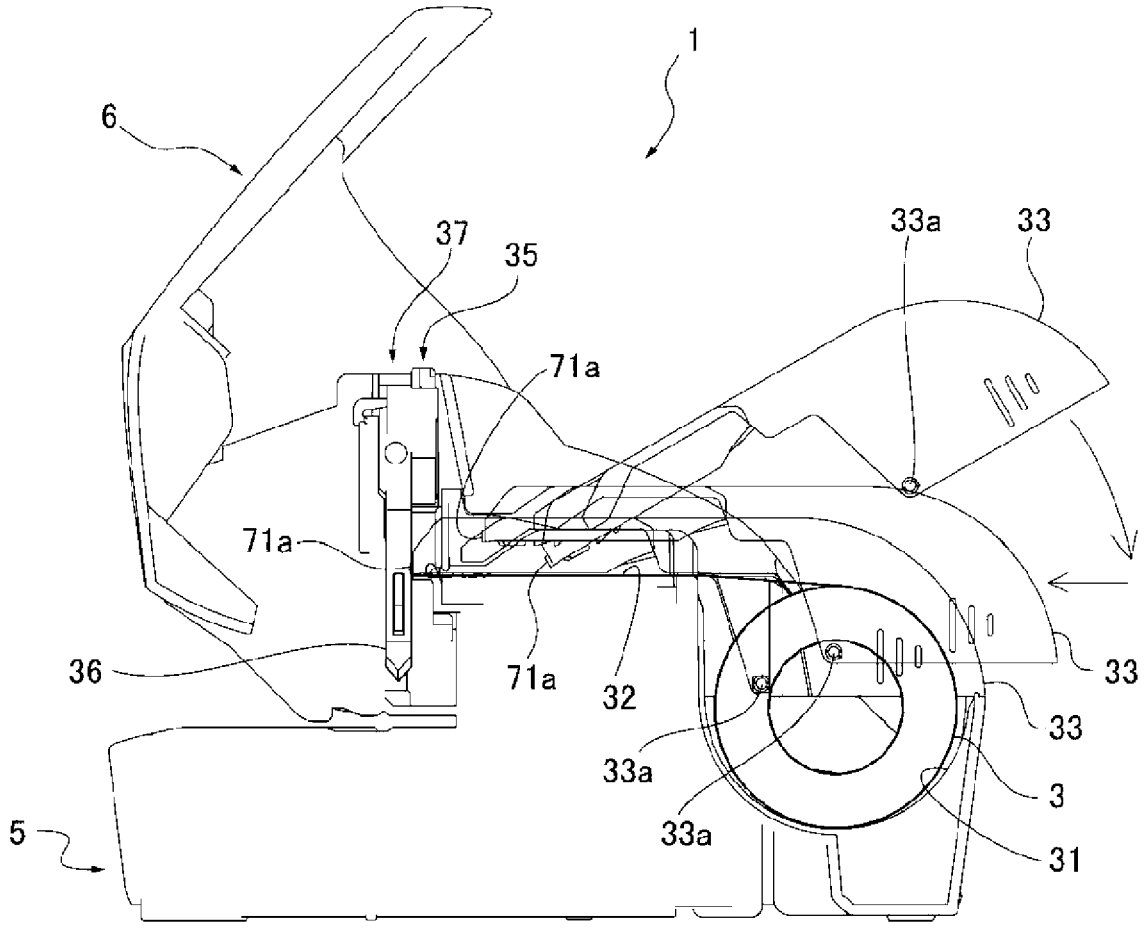

[Fig. 24A]
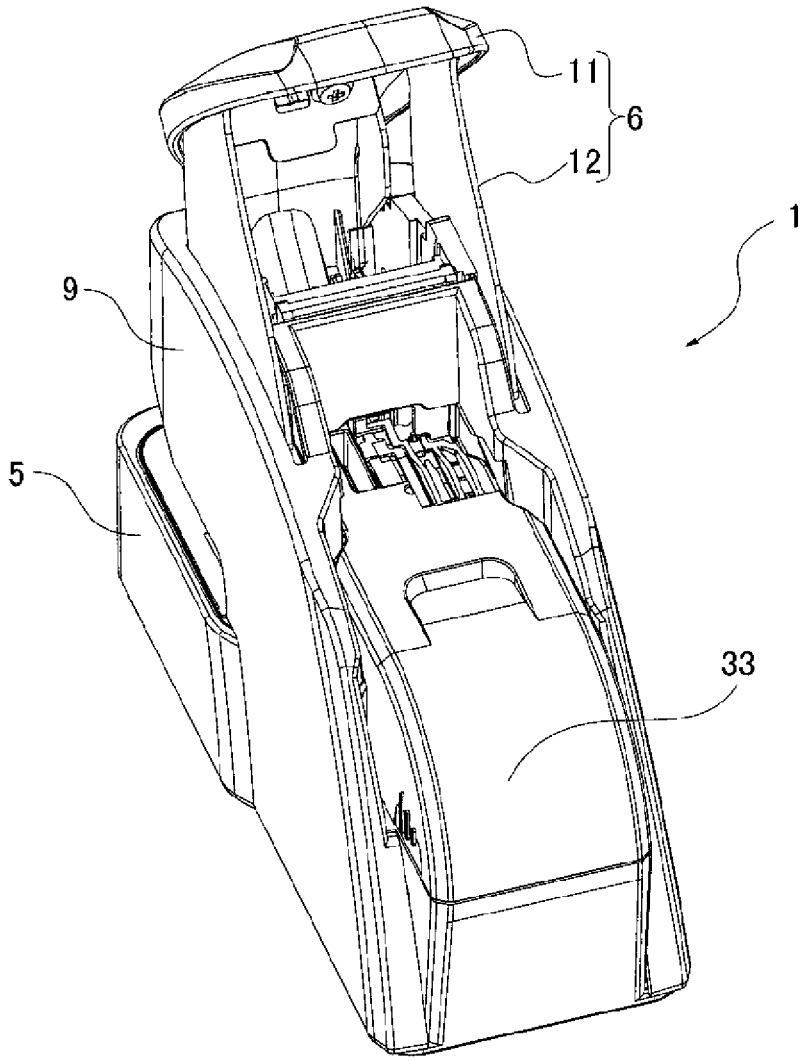
[Fig. 24B]
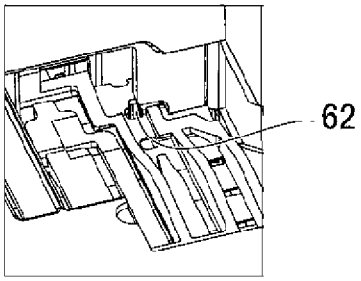

[Fig. 25A]
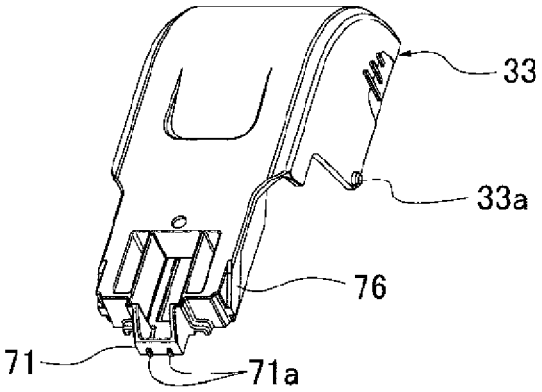
[Fig. 25B]
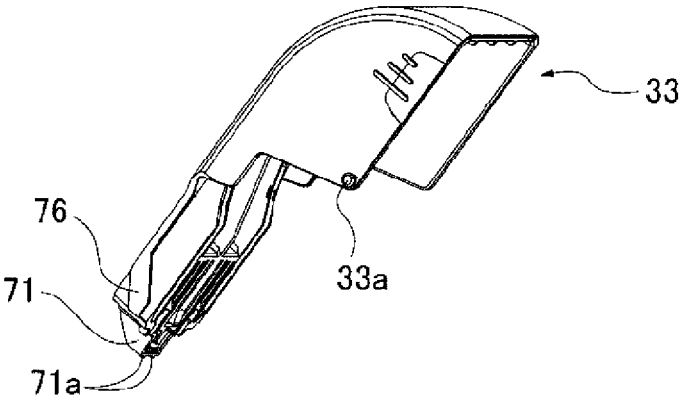
[Fig. 25C]
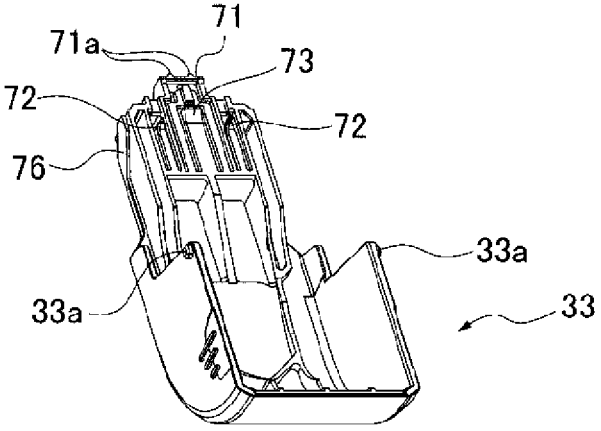

[Fig. 25D]
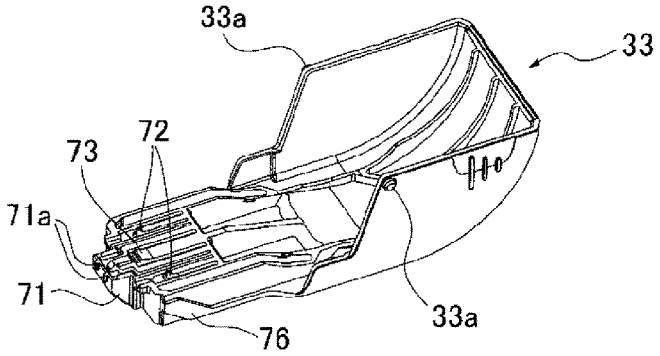
[Fig. 26A]
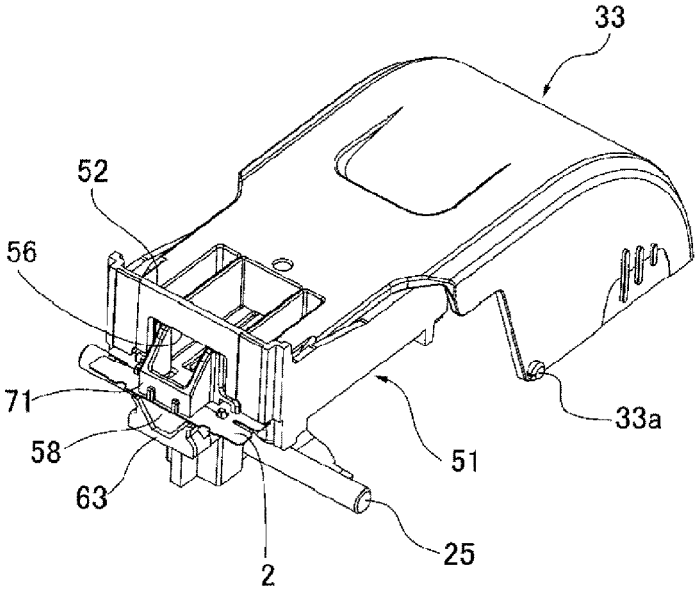
[Fig. 26B]
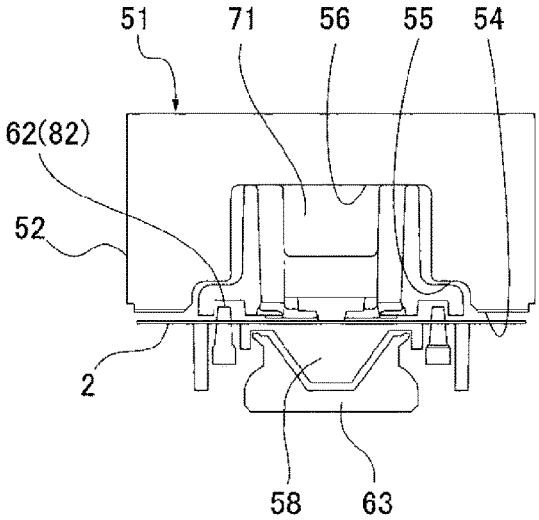

[Fig. 27A]
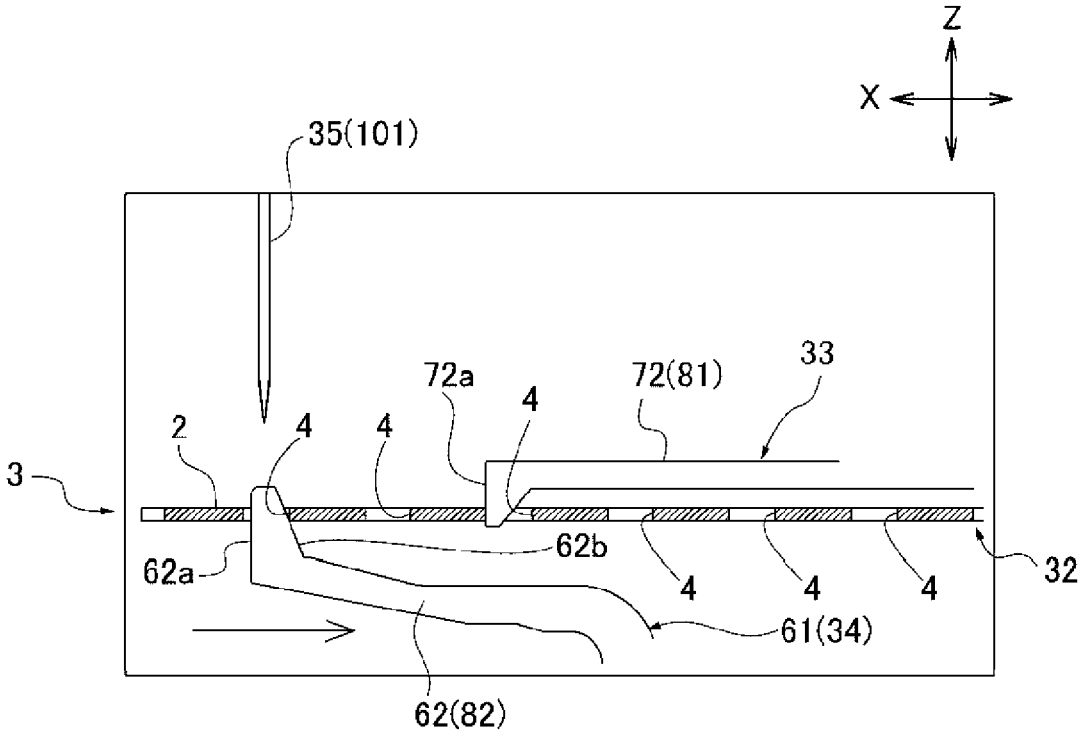
[Fig. 27B]
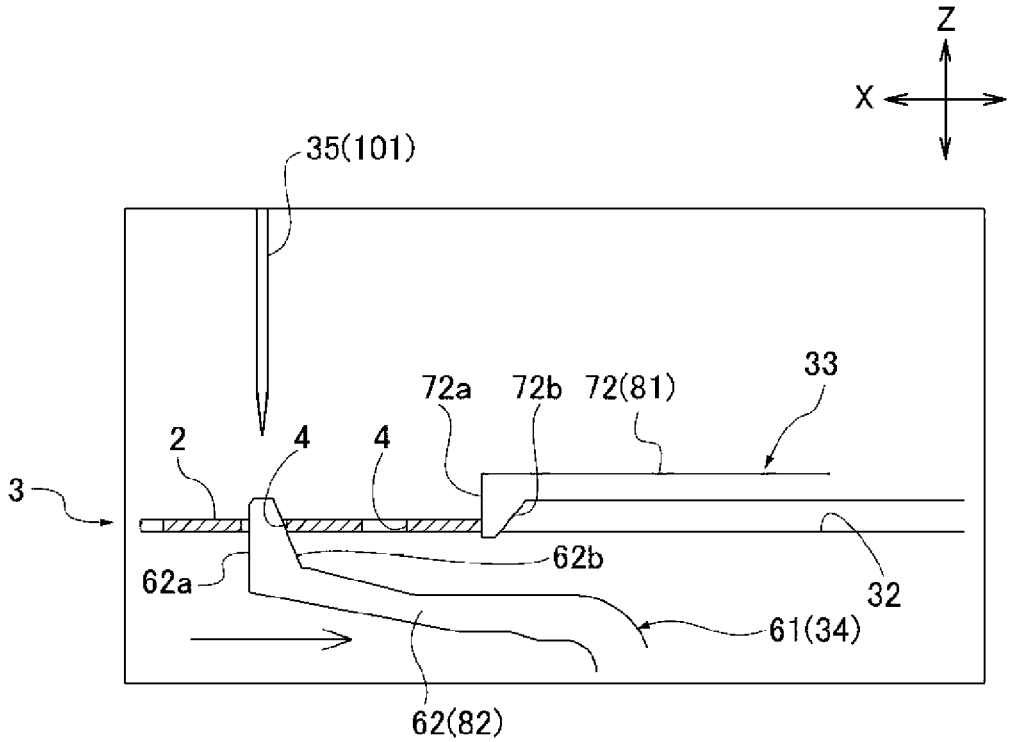

[Fig. 28]
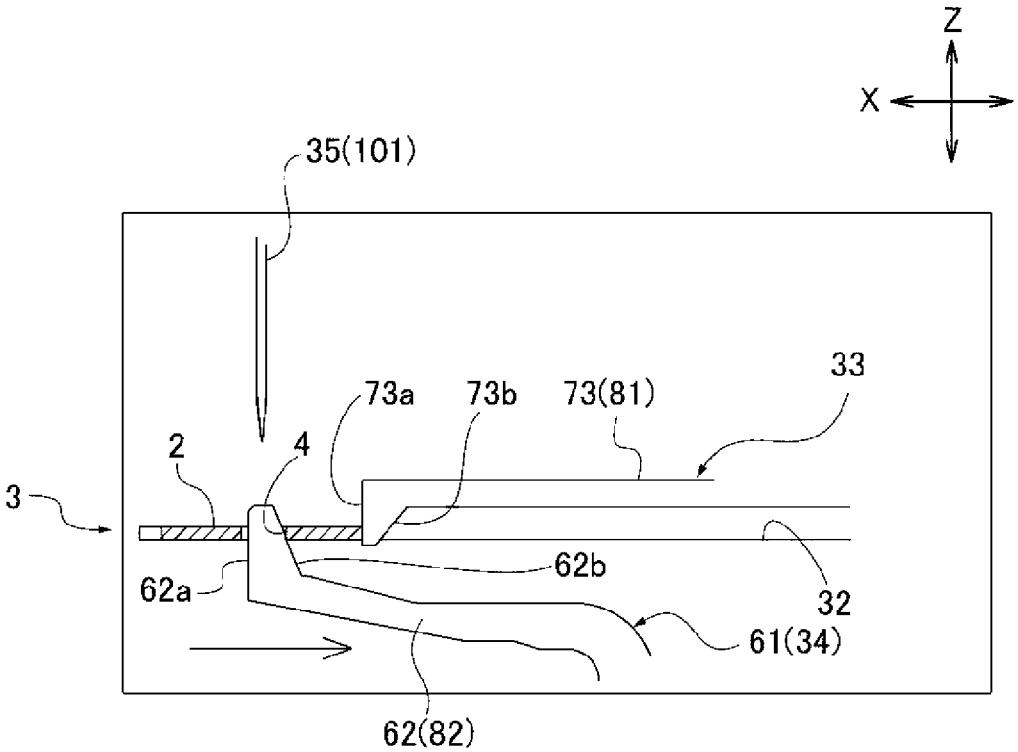
[Fig. 29]
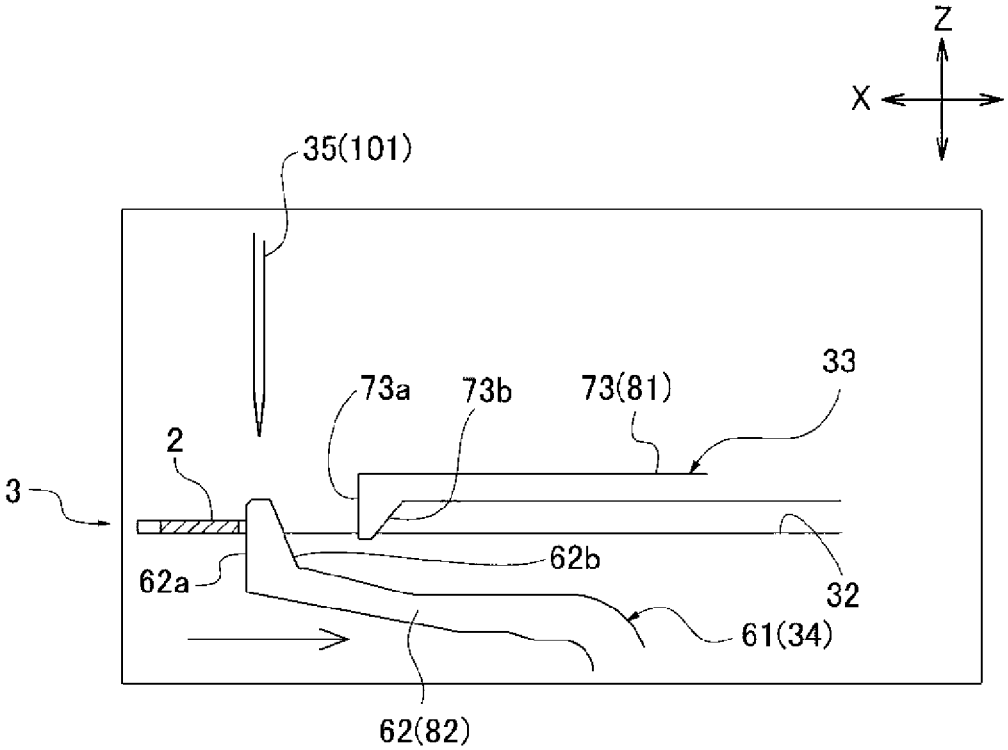

[Fig. 30A]
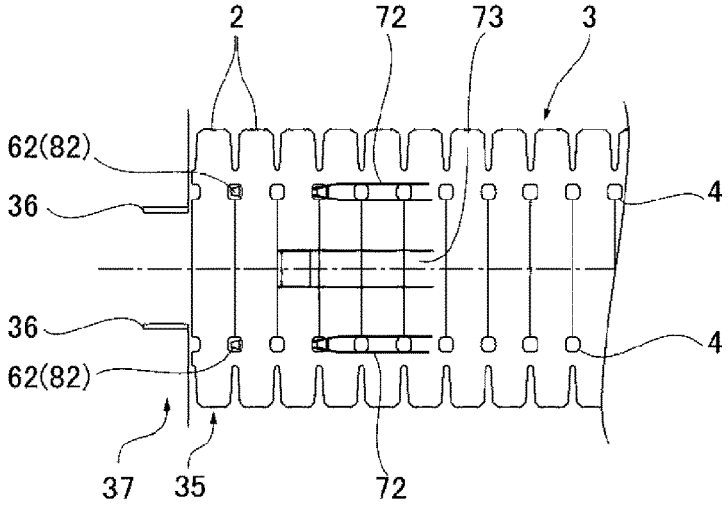
[Fig. 30B]
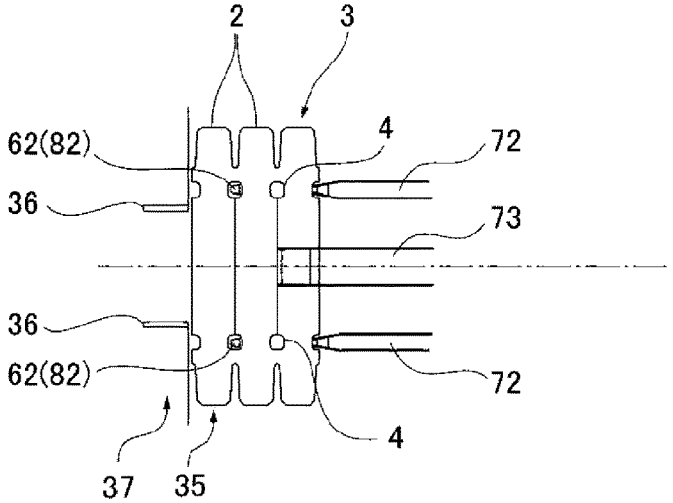
[Fig. 30C]
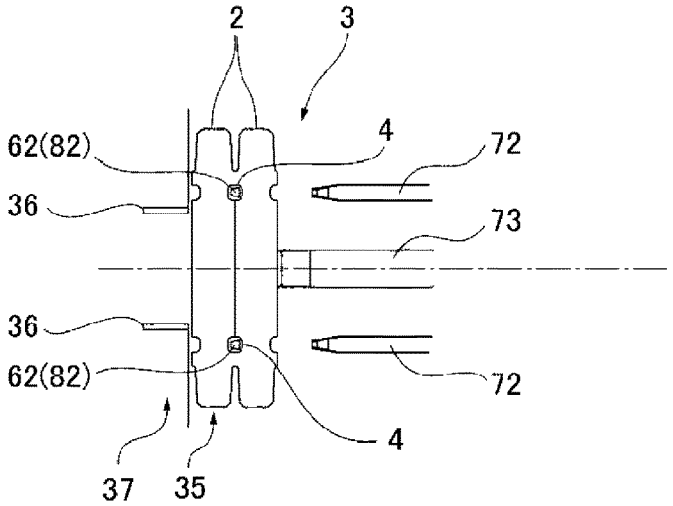

[Fig. 31A]
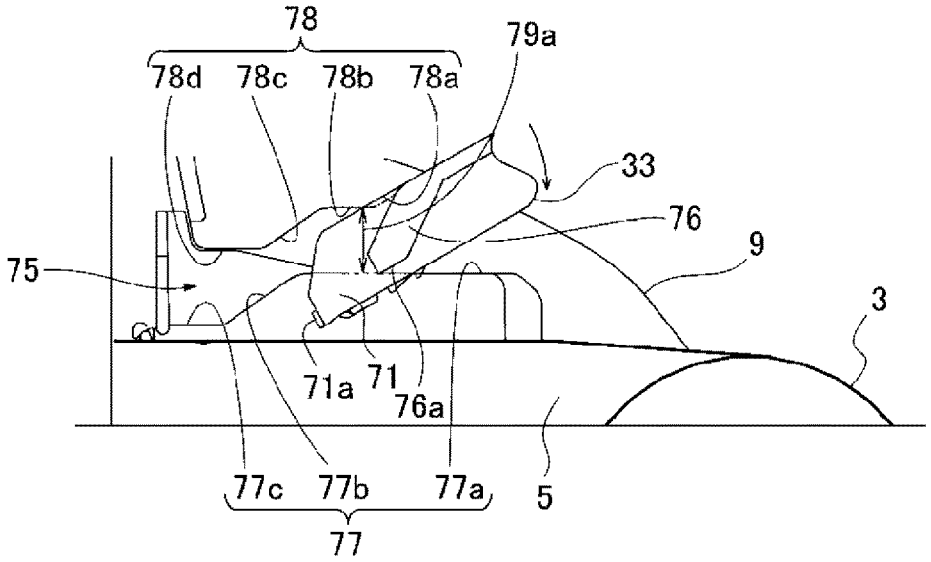
[Fig. 31B]
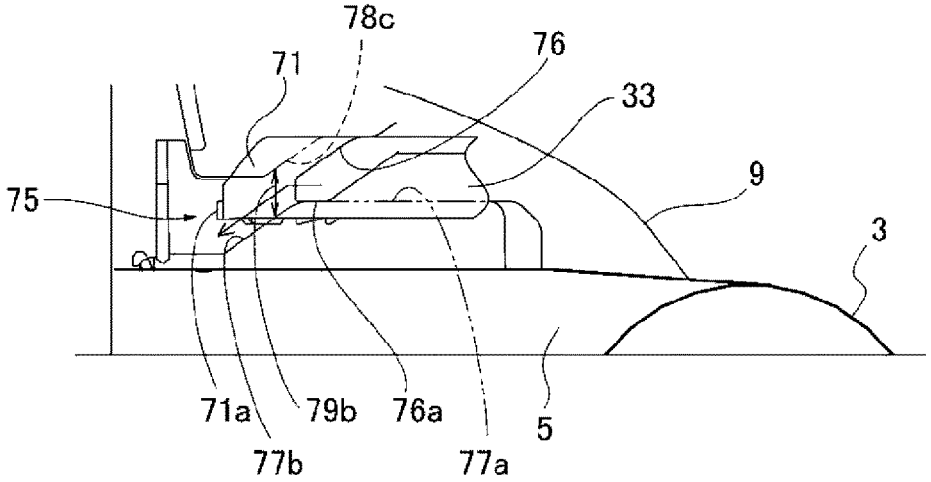
[Fig. 31C]
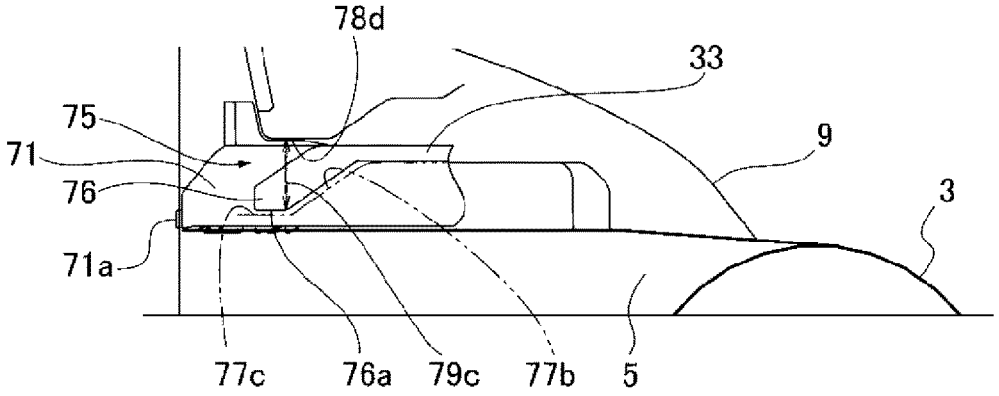

[Fig. 32]
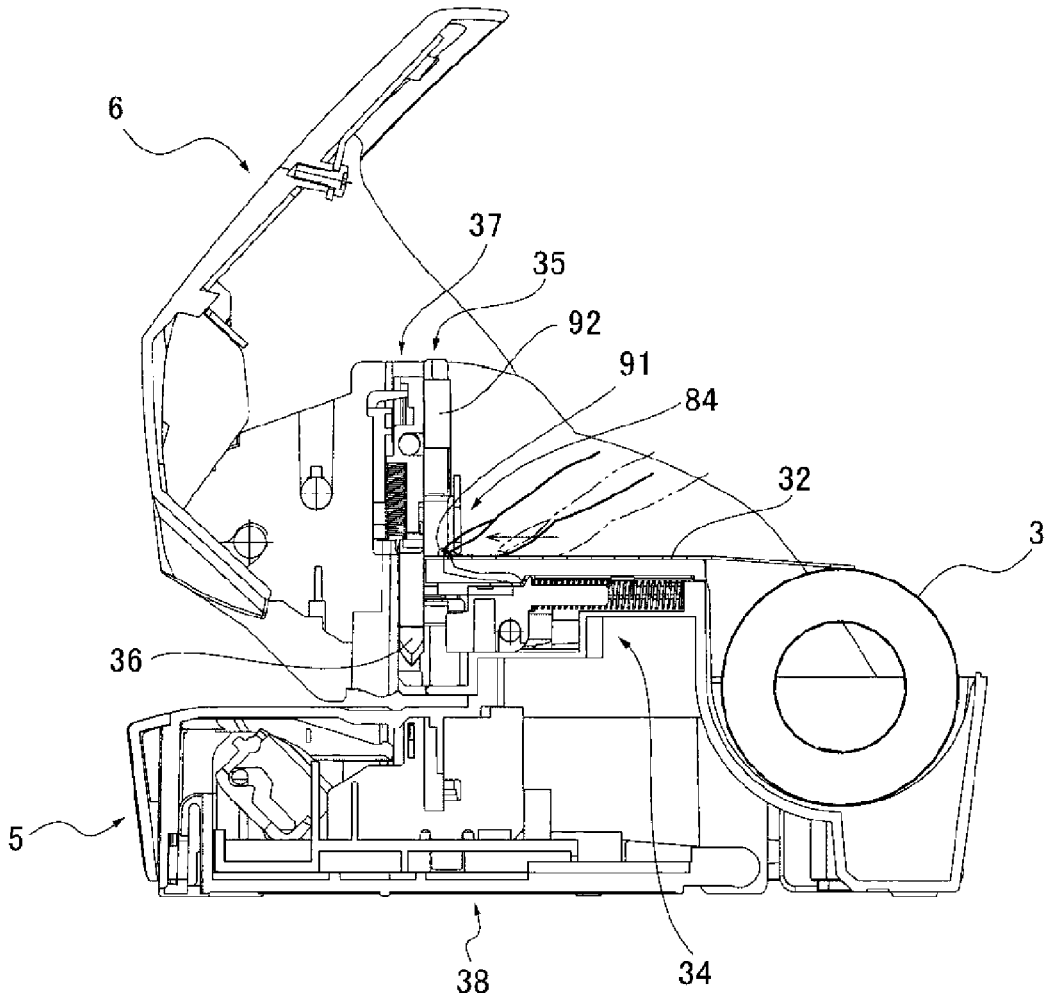
[Fig. 33]
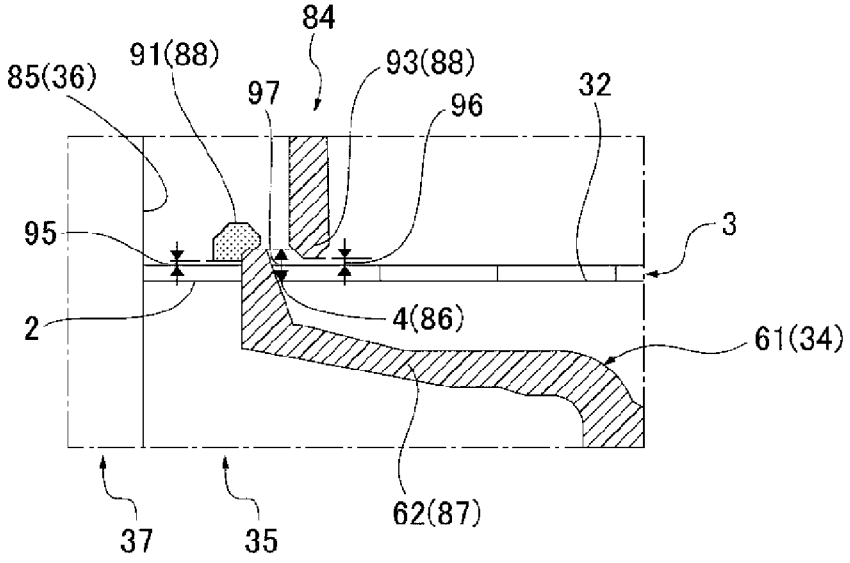

[Fig. 34]
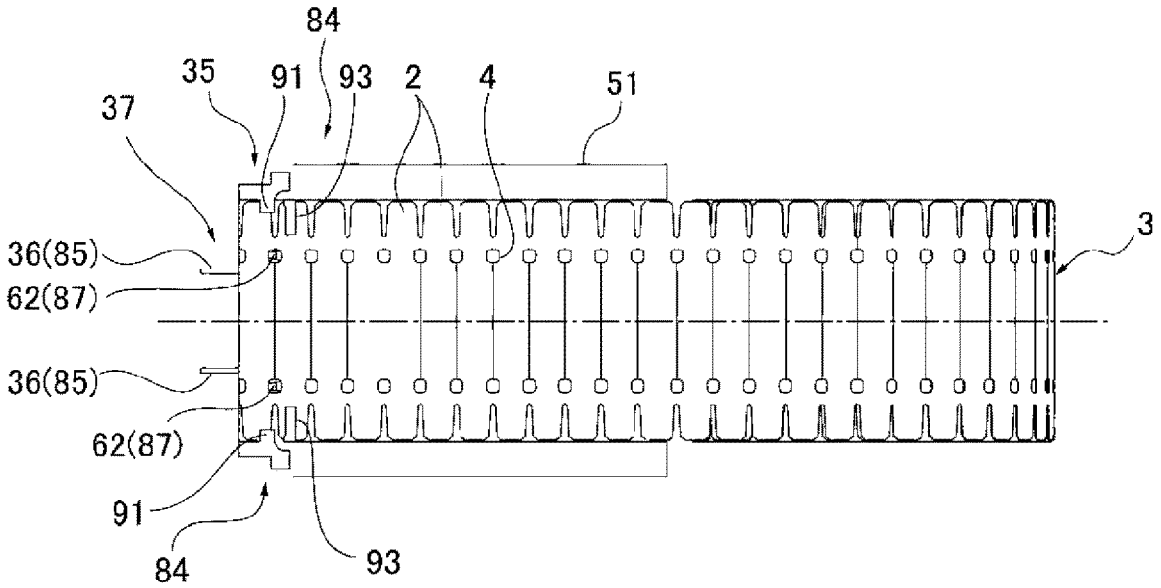
[Fig. 35]
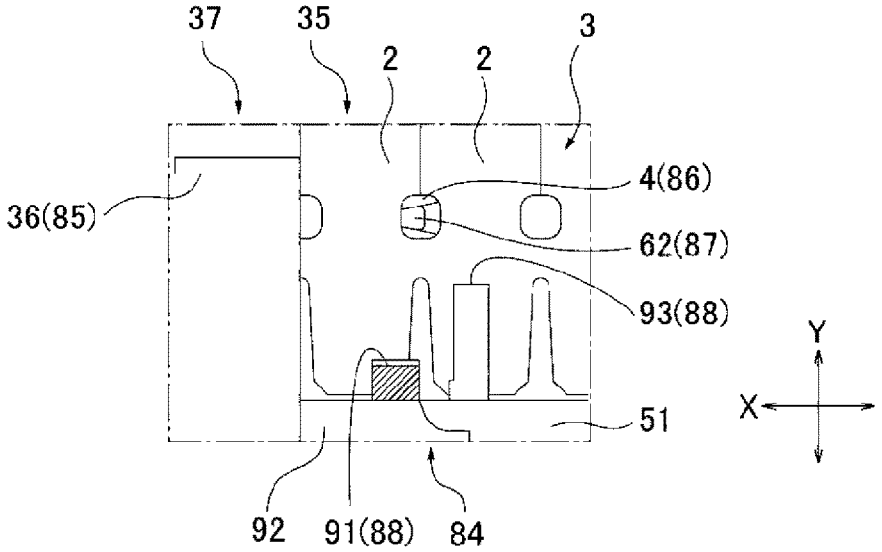

[Fig. 36]
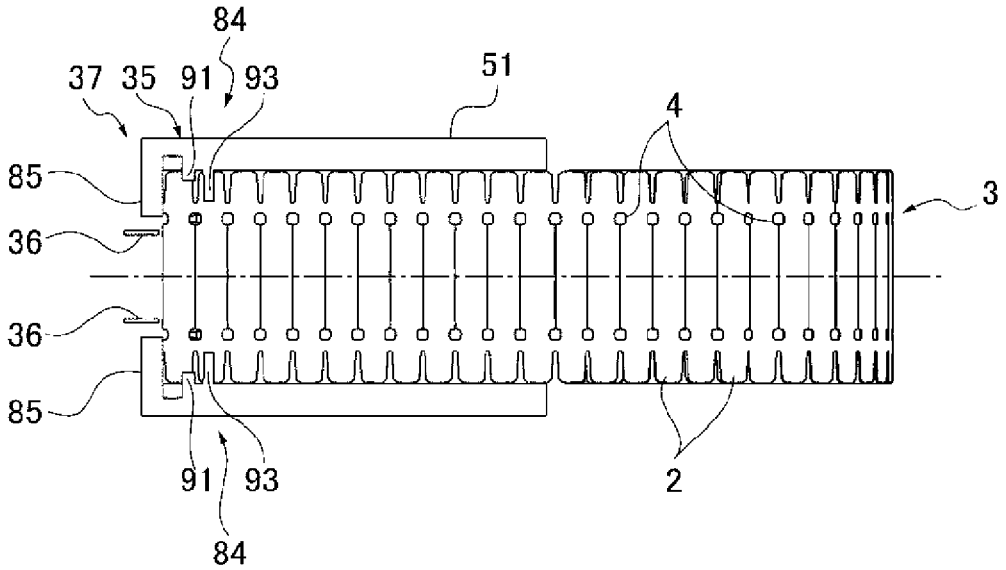
[Fig. 37]
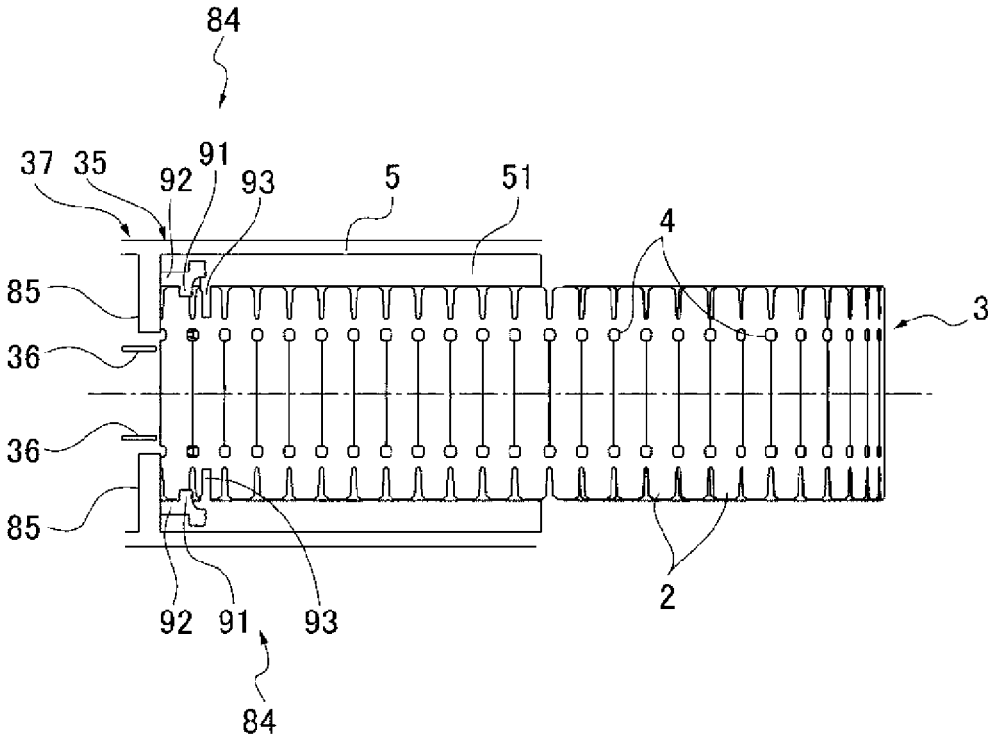

[Fig. 38]
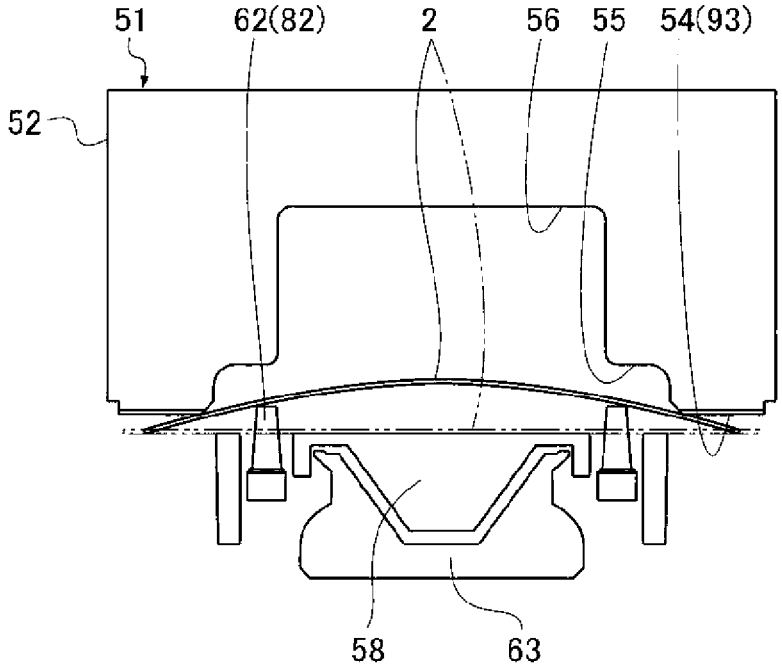

[Fig. 39]
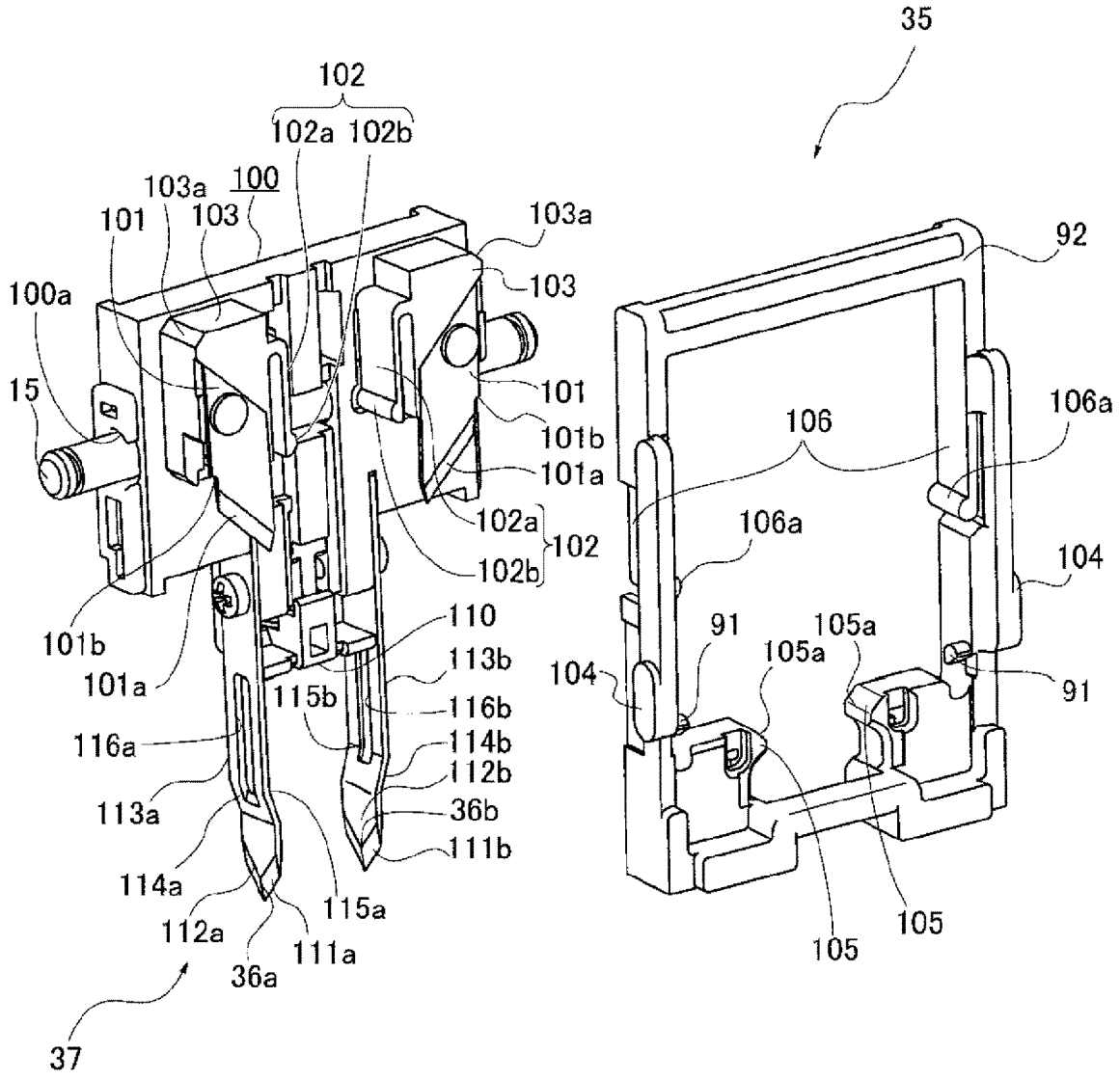

[Fig. 40A]
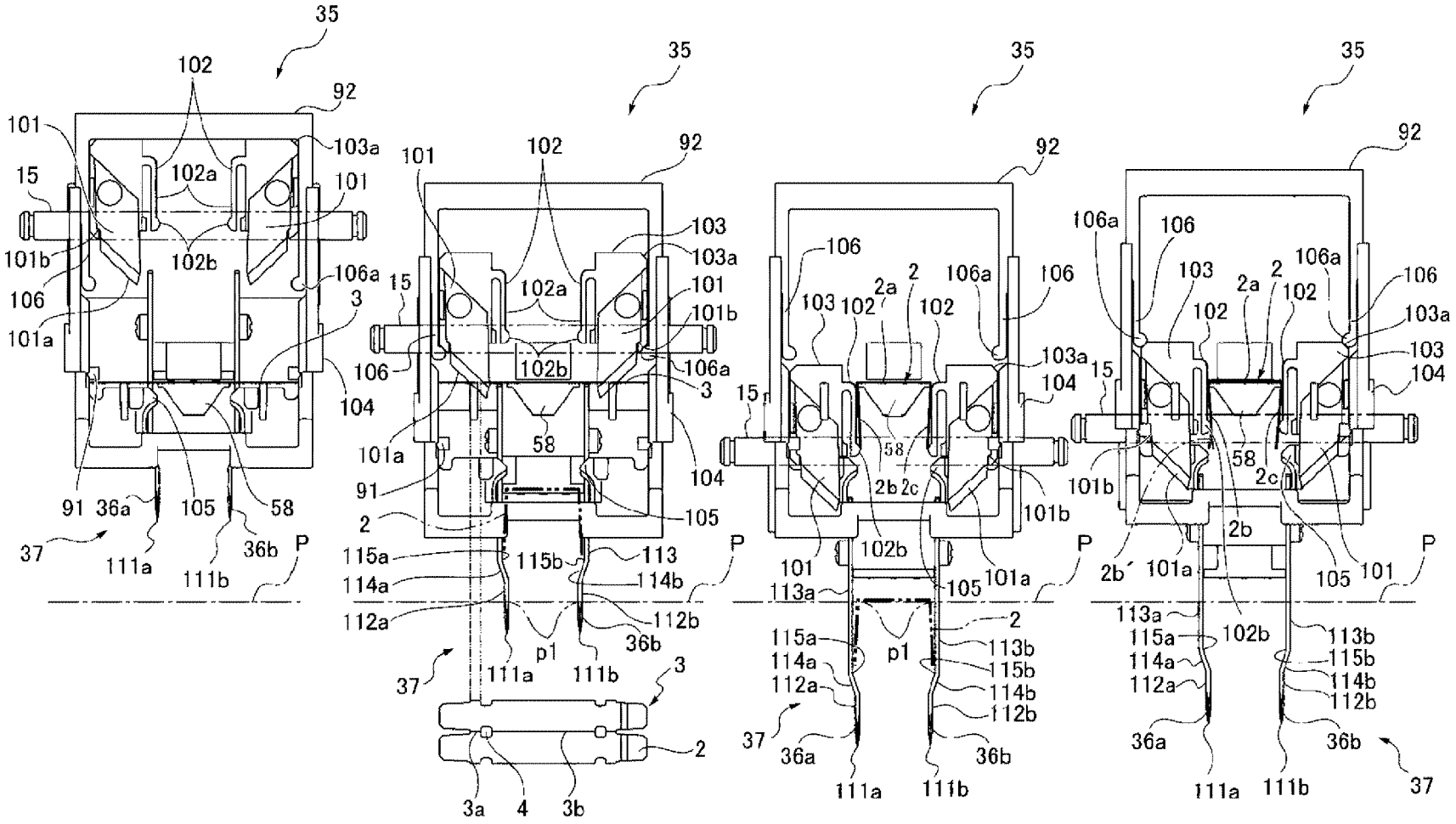

[Fig. 40B]
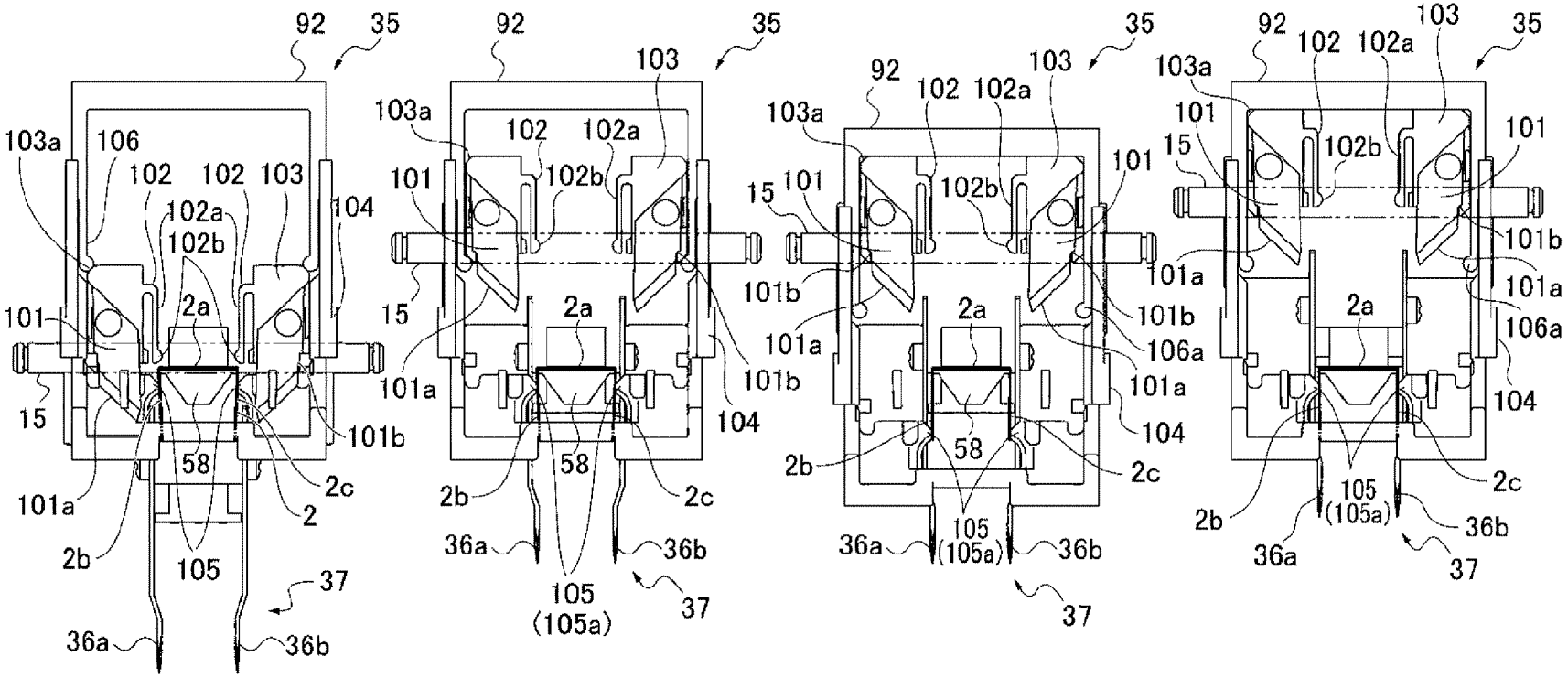

[Fig. 41A]
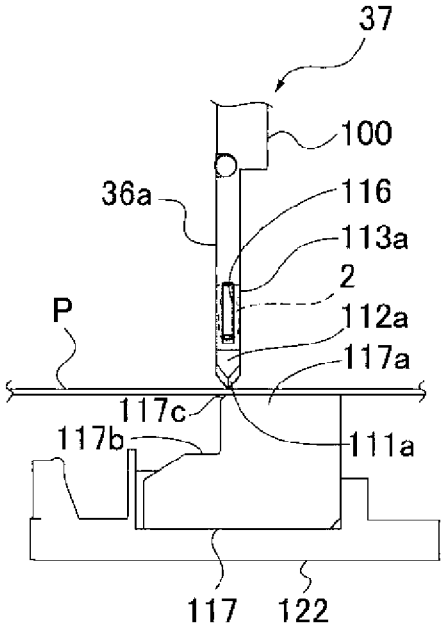
[Fig. 41B]
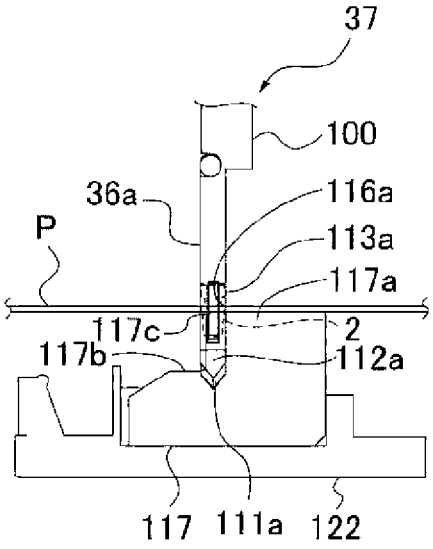

[Fig. 41C]
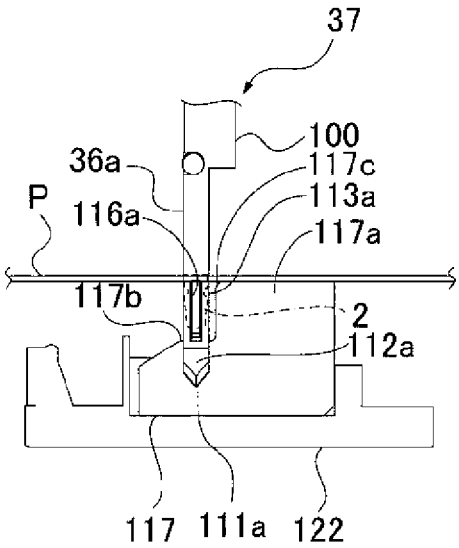
[Fig. 41D]
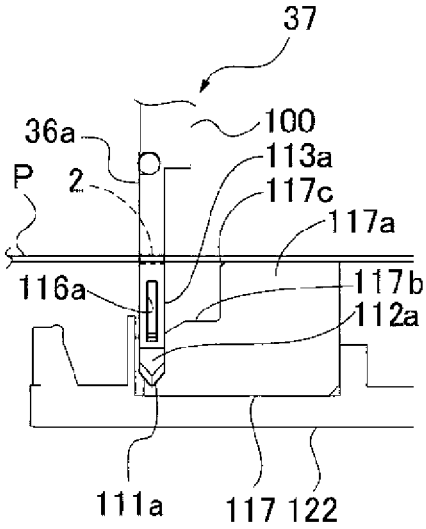

[Fig. 42A]
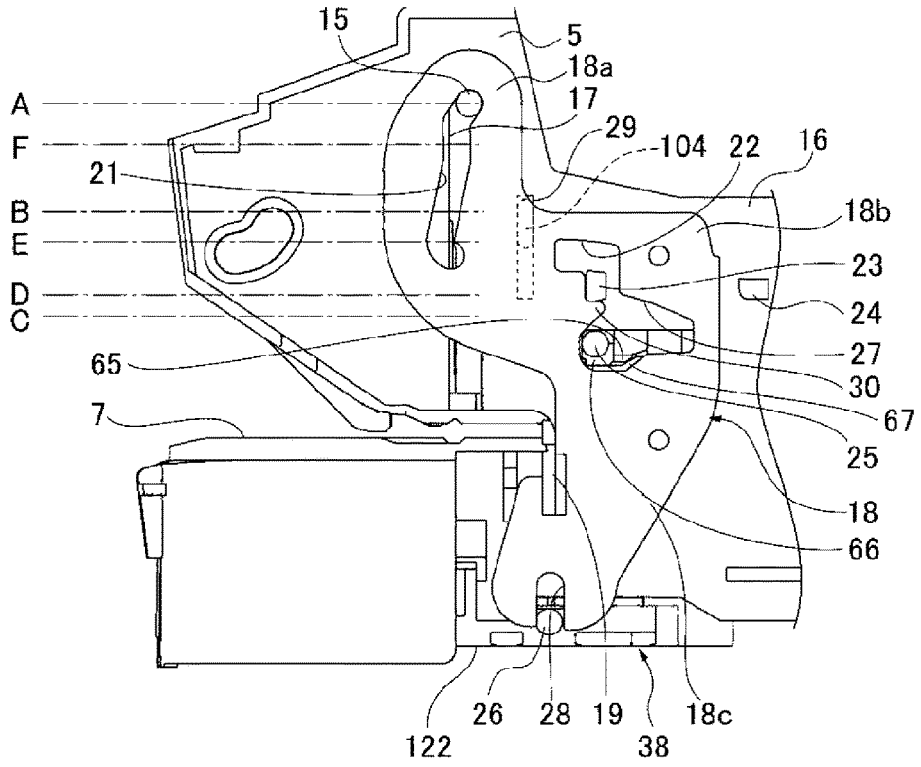
[Fig. 42B]
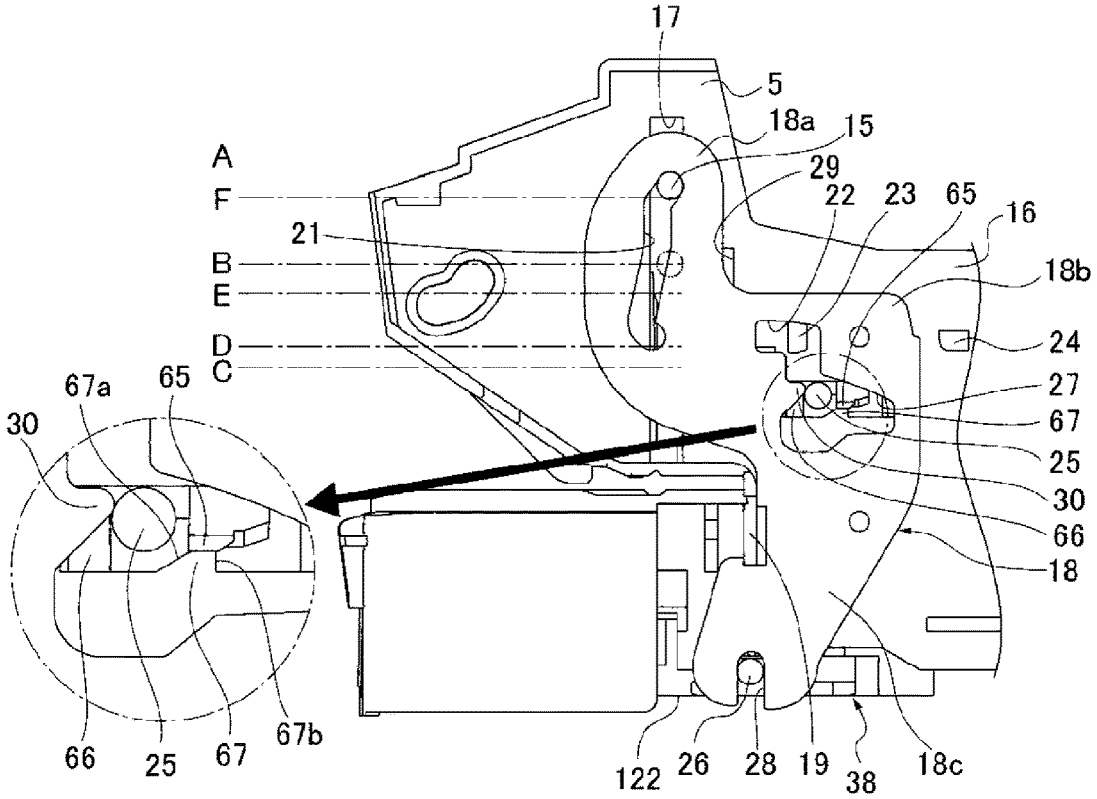

[Fig. 42C]
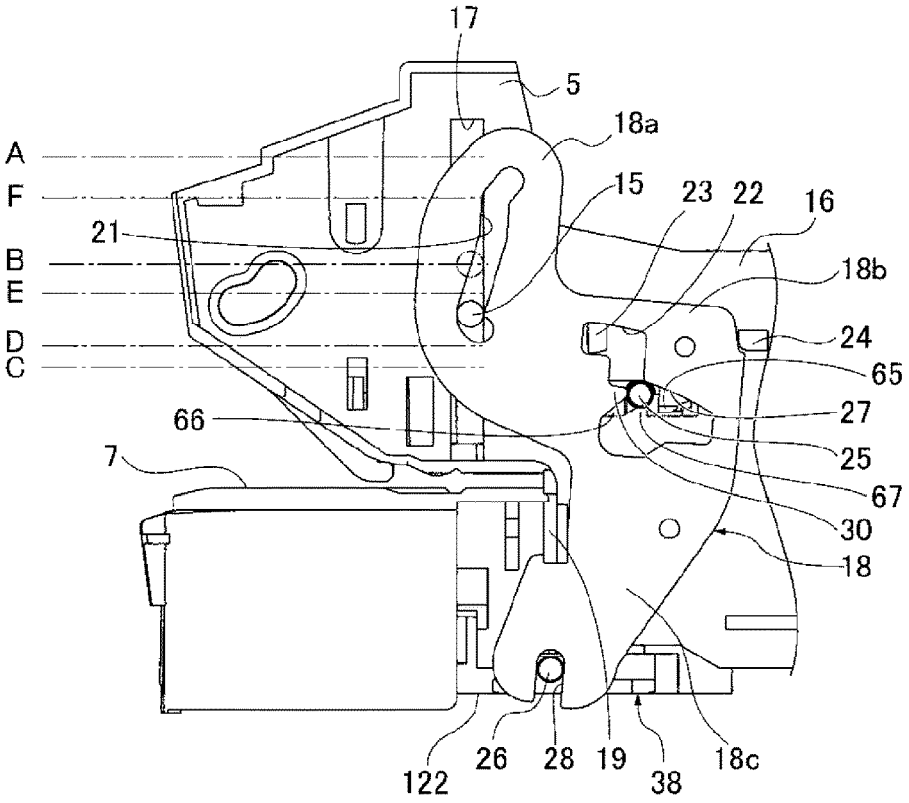
[Fig. 42D]
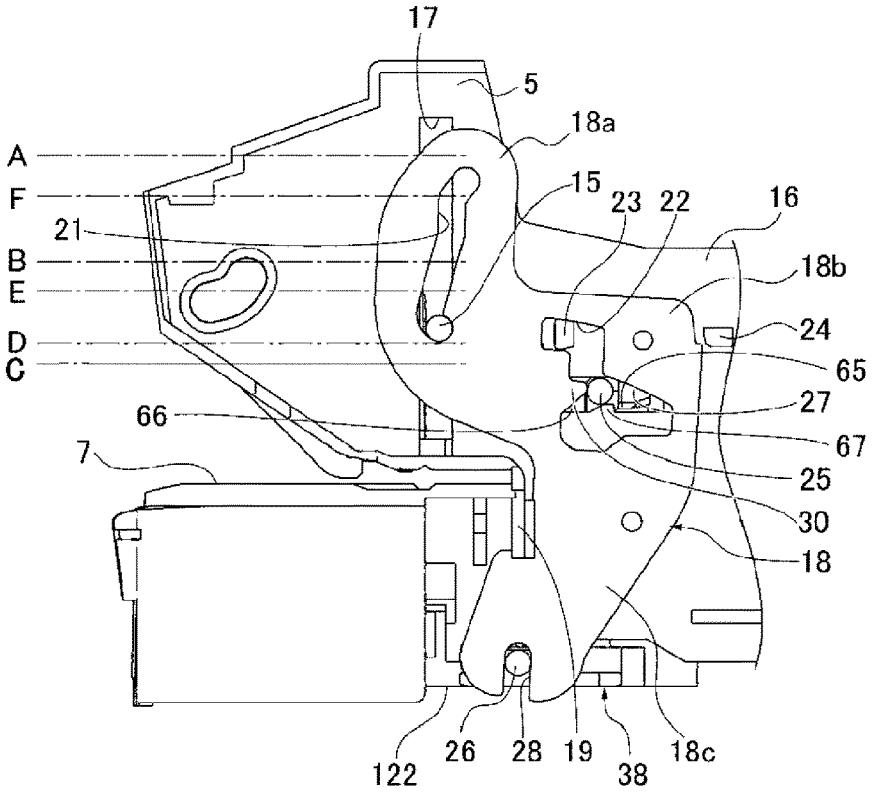

[Fig. 42E]
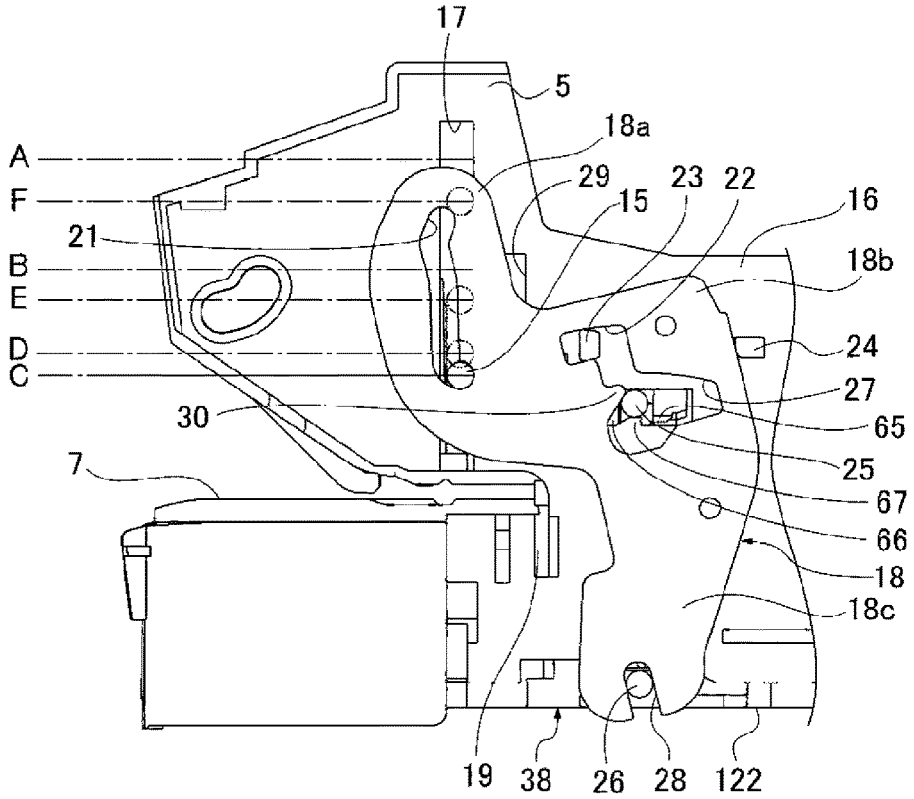
[Fig. 42F]
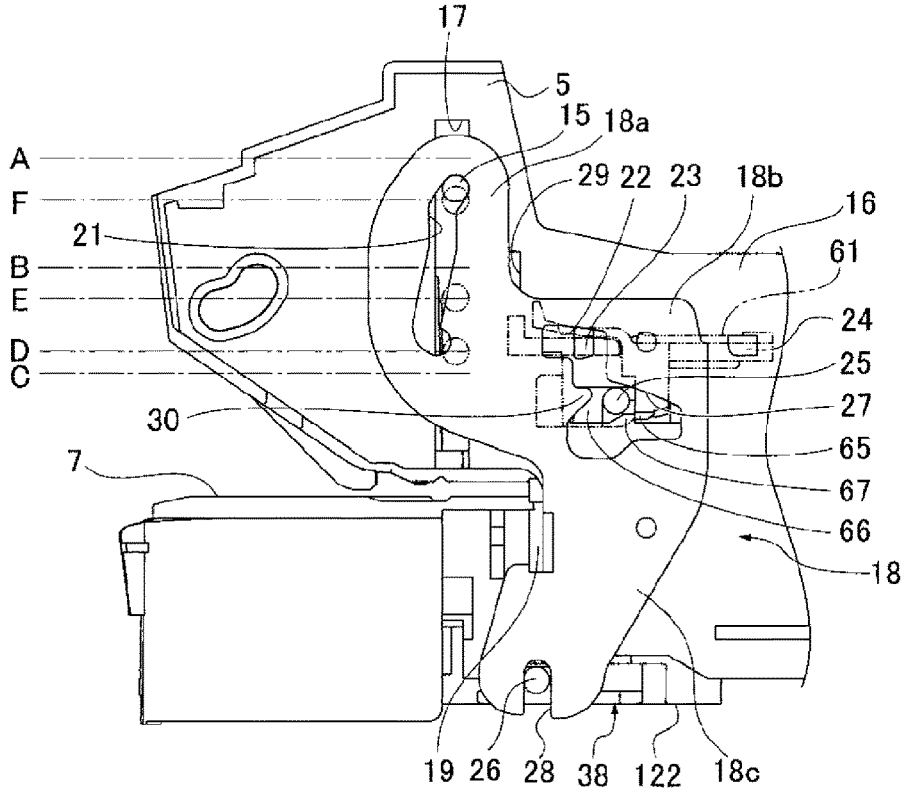

[Fig. 43A]
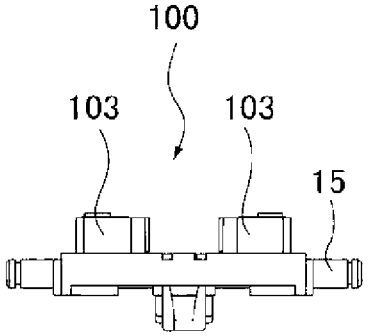
[Fig. 43B]
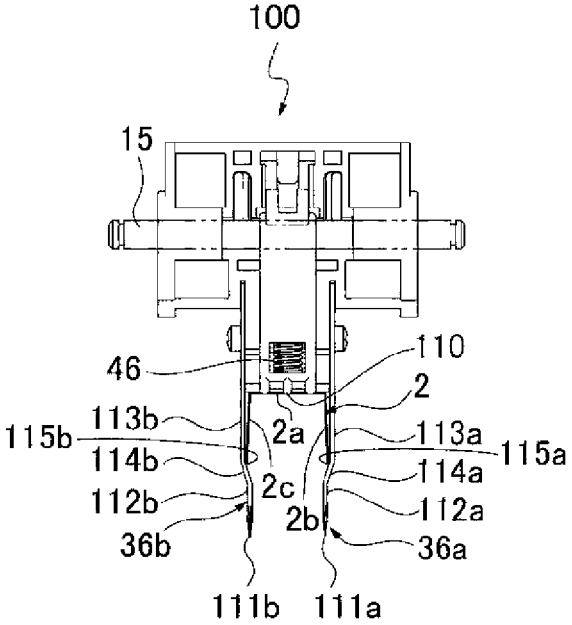

[Fig. 43C]
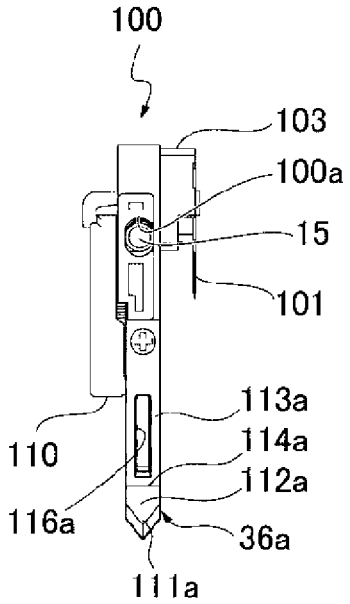
[Fig. 43D]
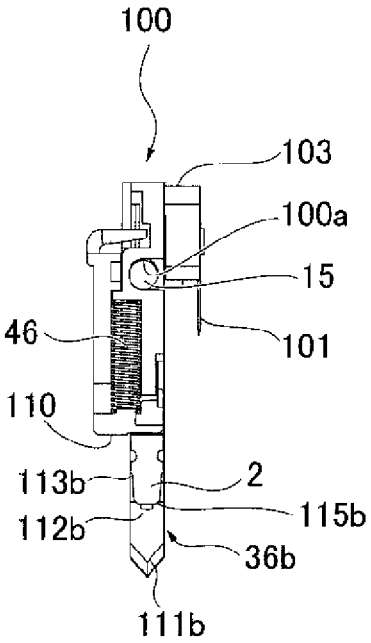

[Fig. 43E]
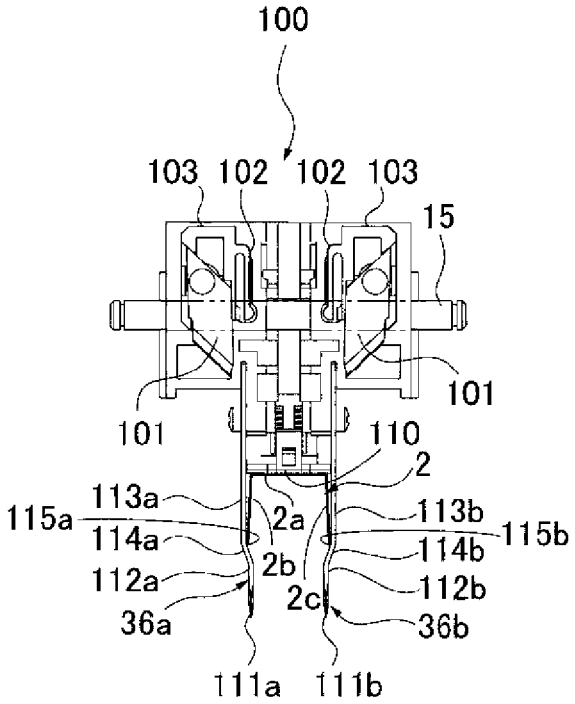
[Fig. 44A]
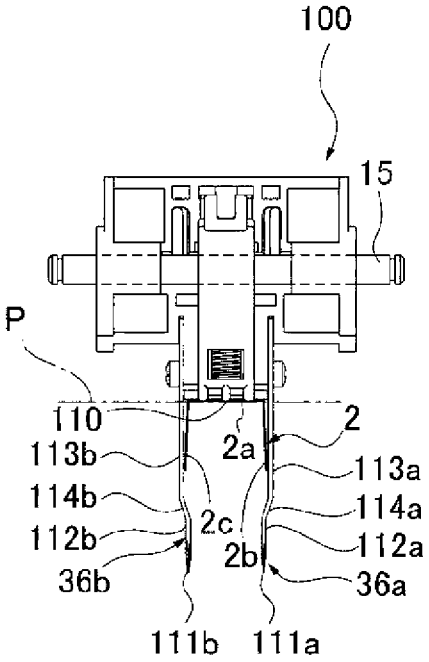

[Fig. 44B]
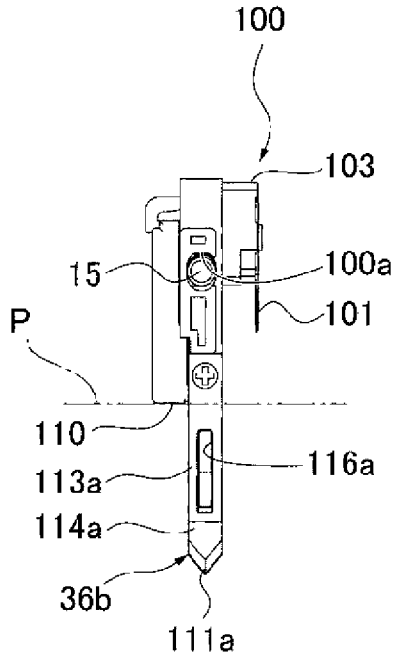
[Fig. 44C]
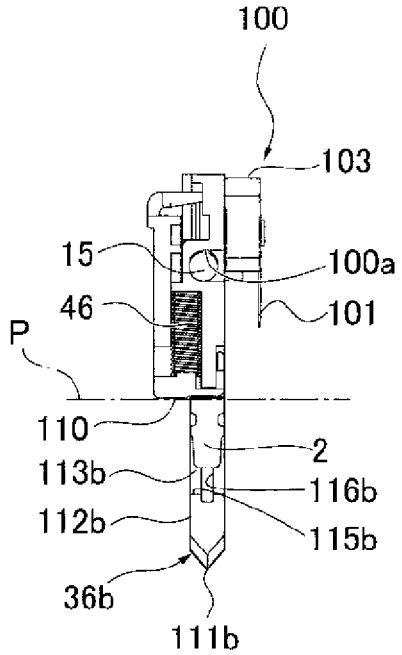

[Fig. 45A]
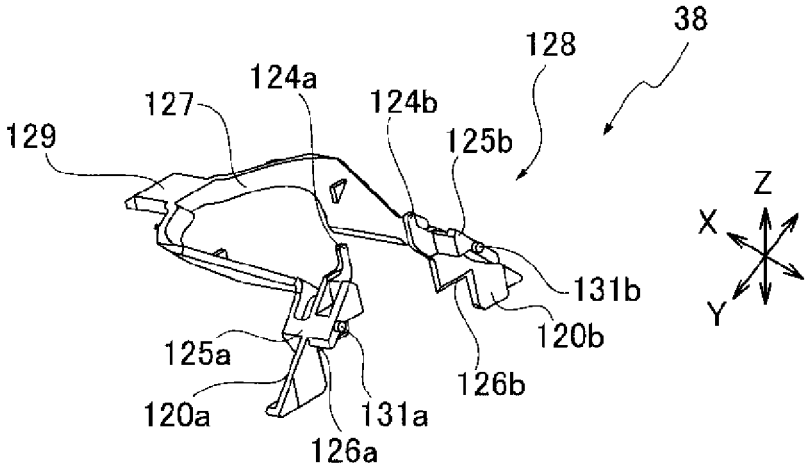
[Fig. 45B]
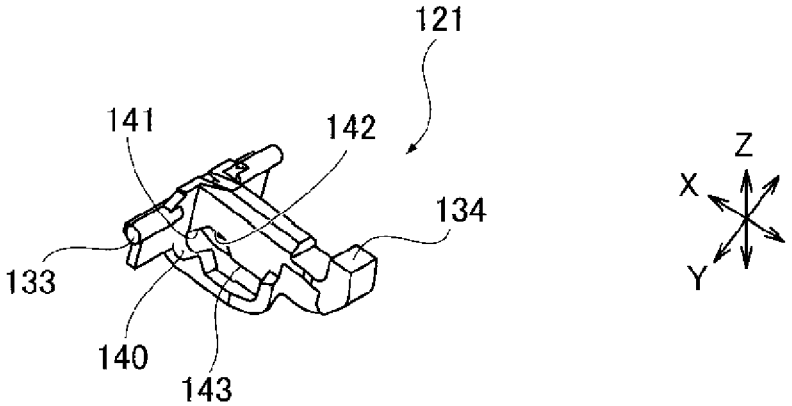
[Fig. 45C]
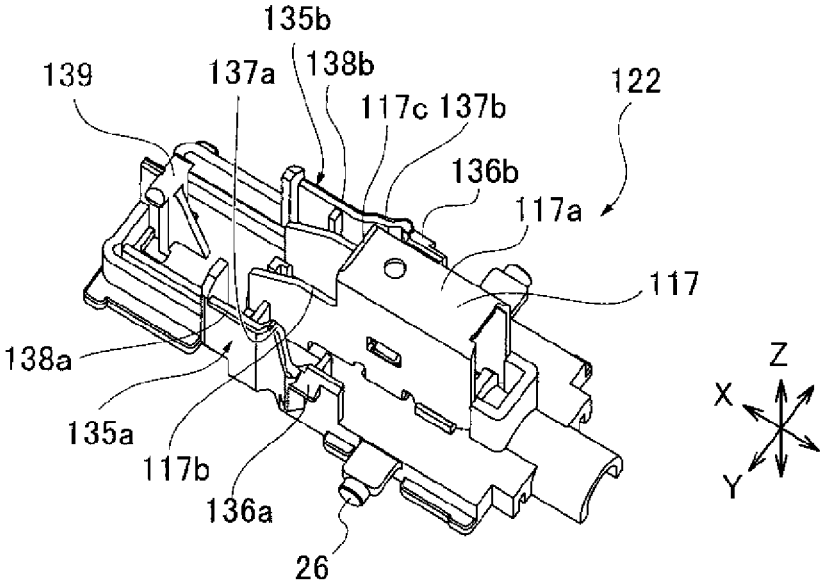

[Fig. 46]
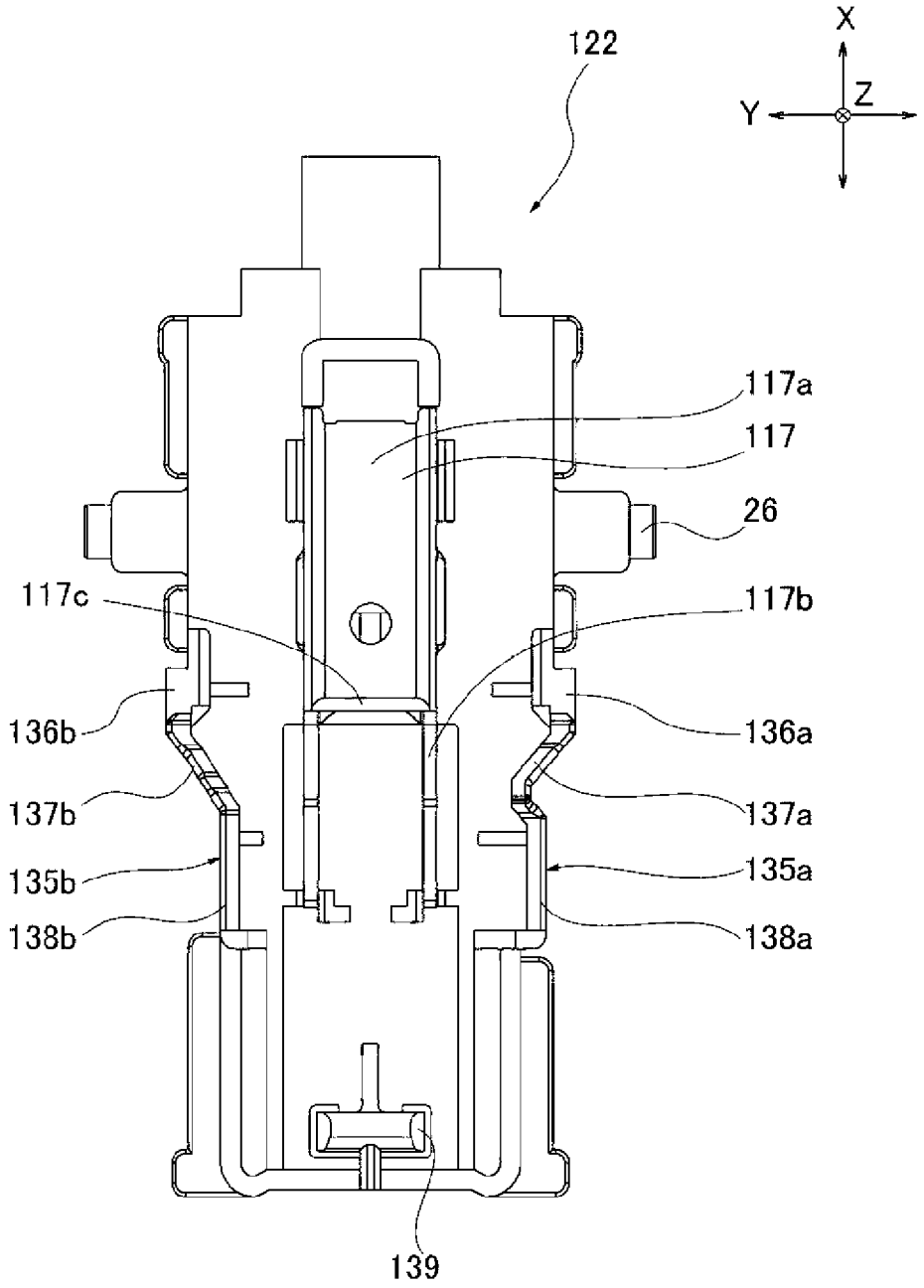

[Fig. 47]
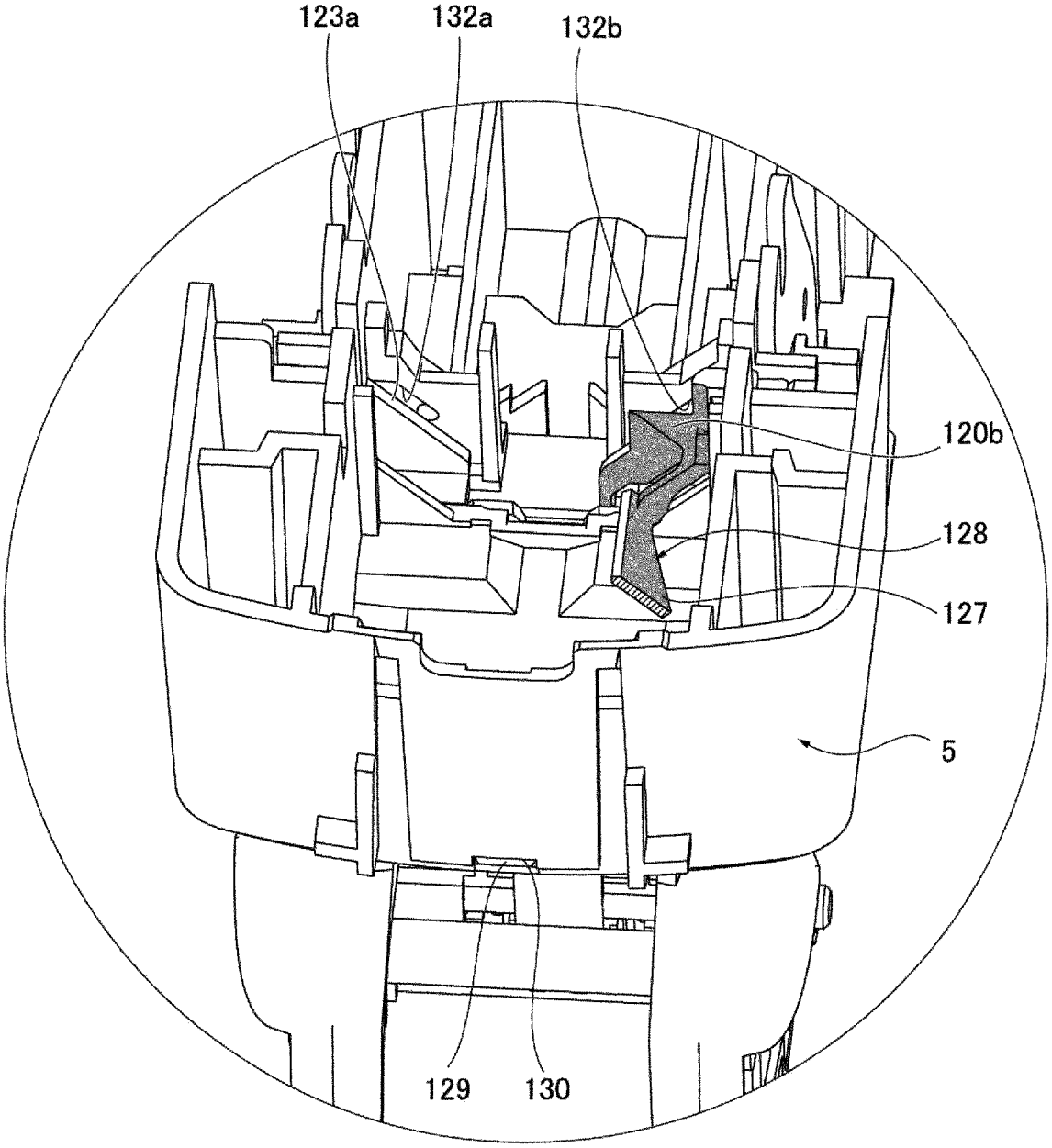

[Fig. 48]
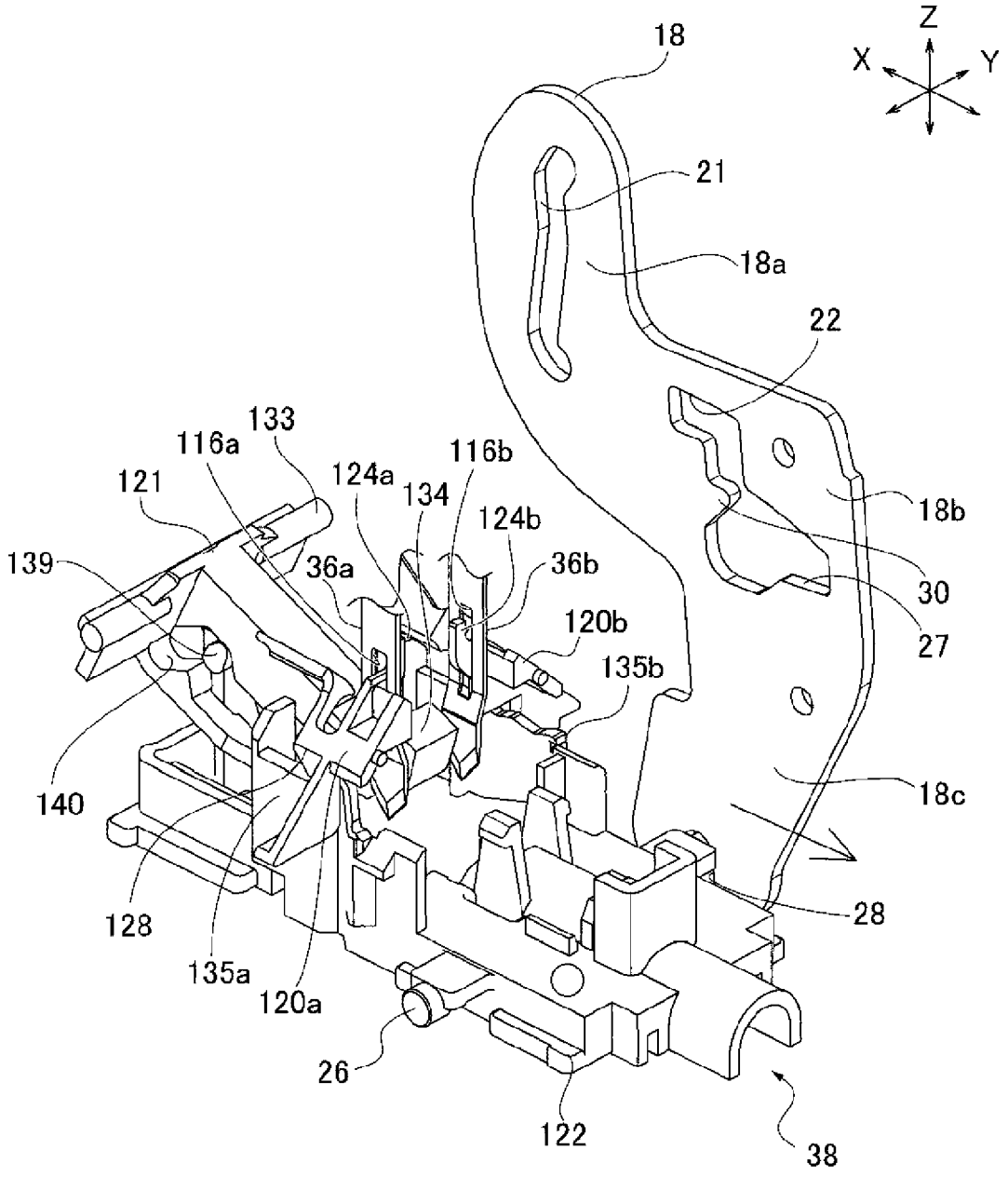

[Fig. 49A]
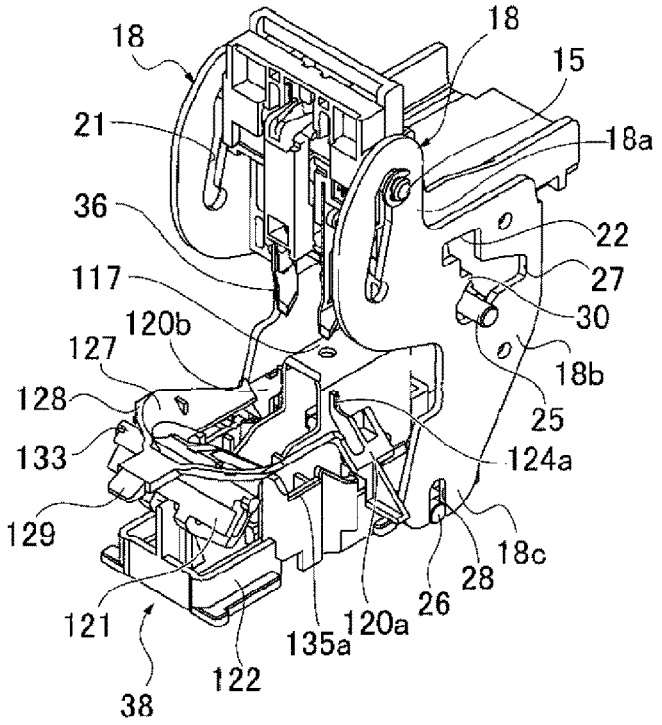
[Fig. 49B]
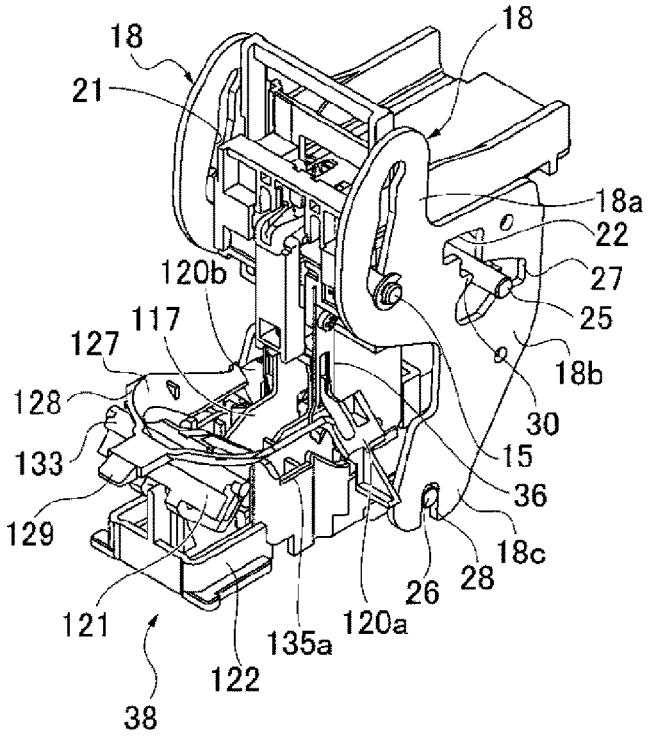

[Fig. 49C]
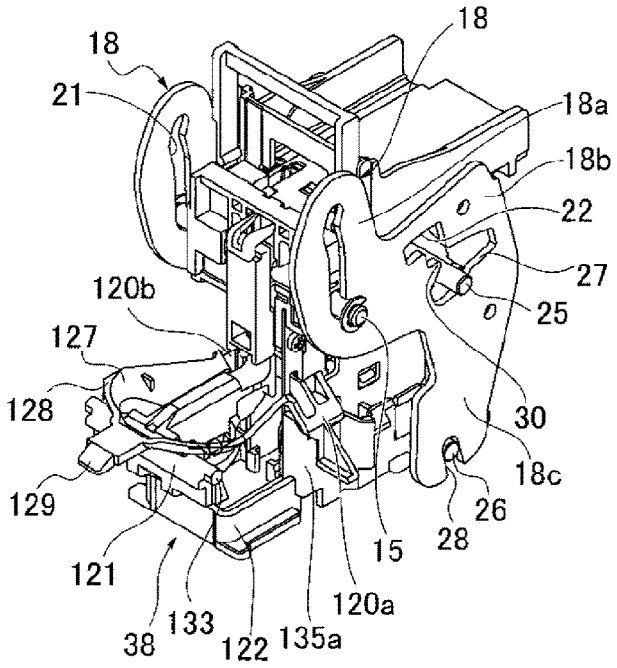
[Fig. 50A]
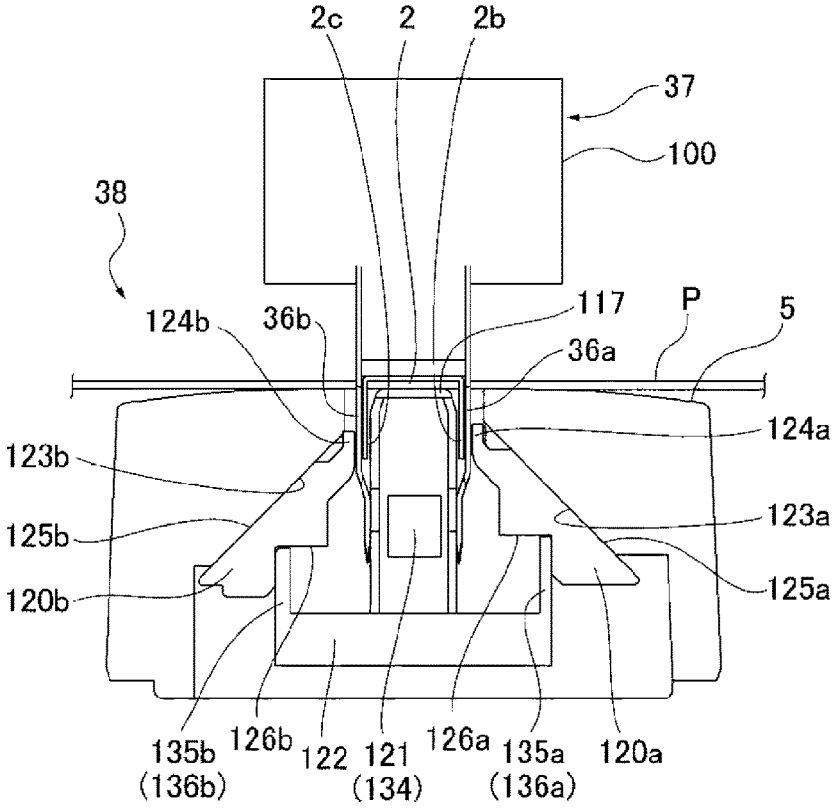

[Fig. 50B]
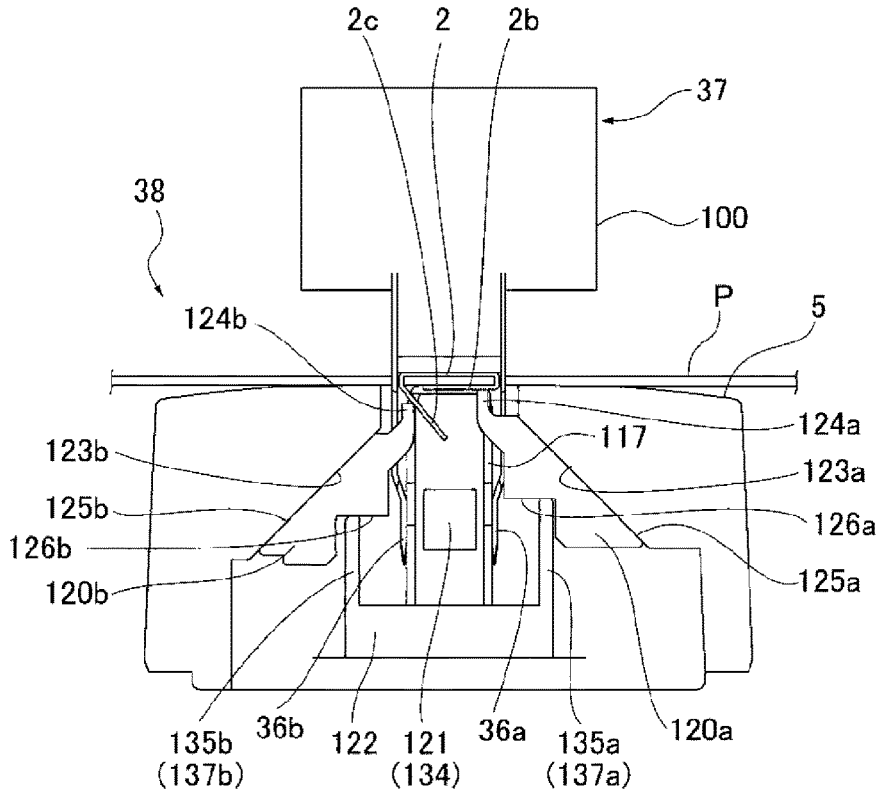
[Fig. 50C]
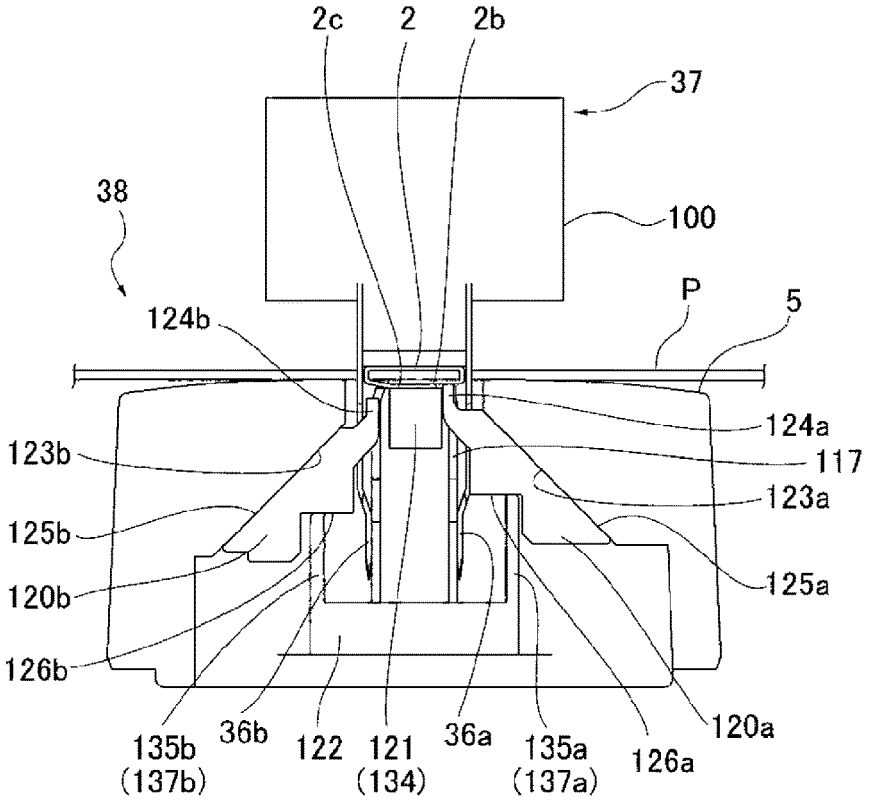

[Fig. 50D]
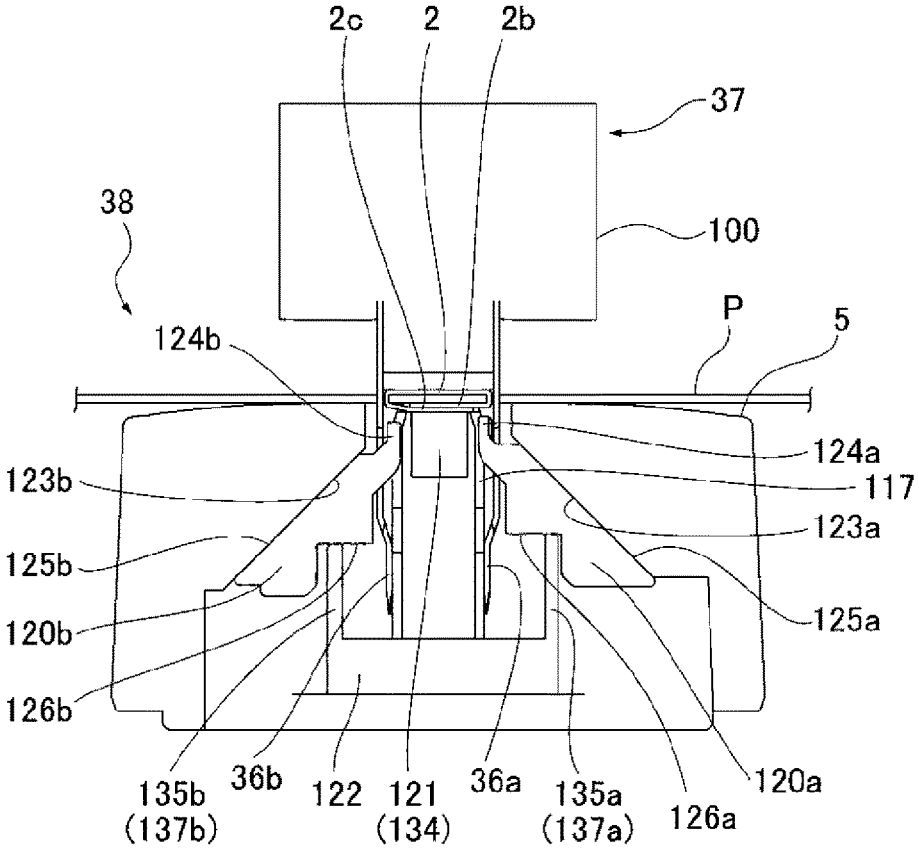
[Fig. 51A]
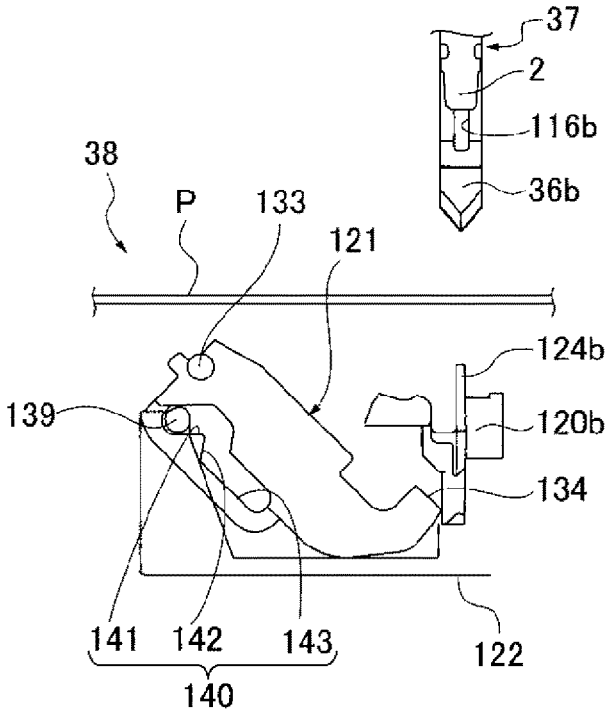

[Fig. 51B]
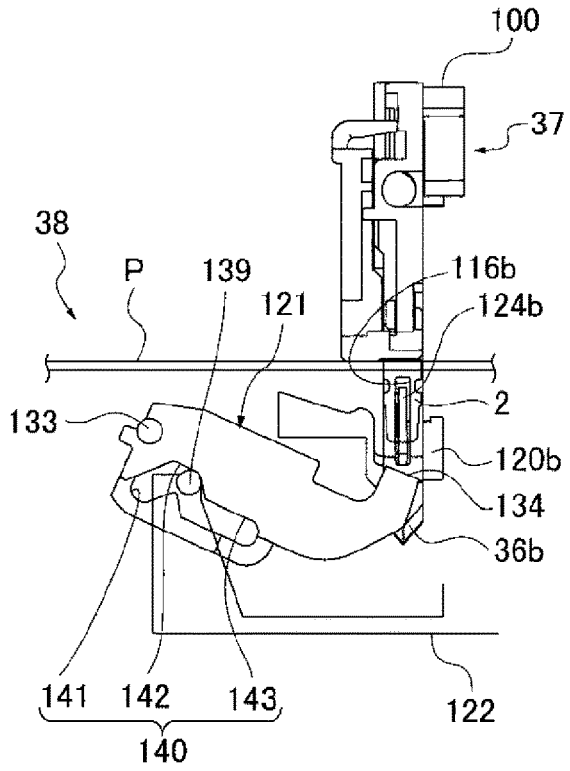
[Fig. 51C]
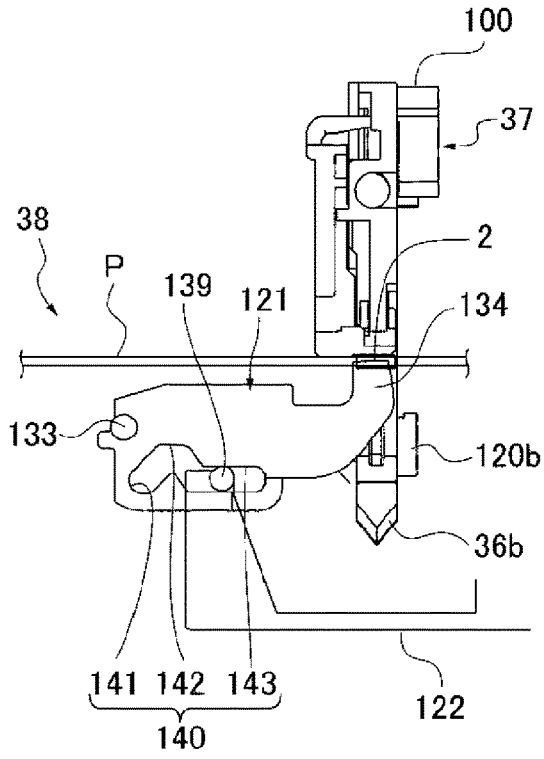

[Fig. 52A]
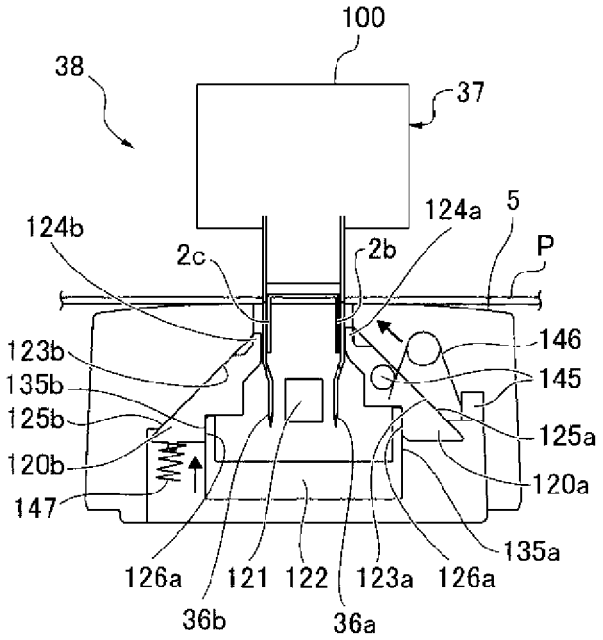
[Fig. 52B]
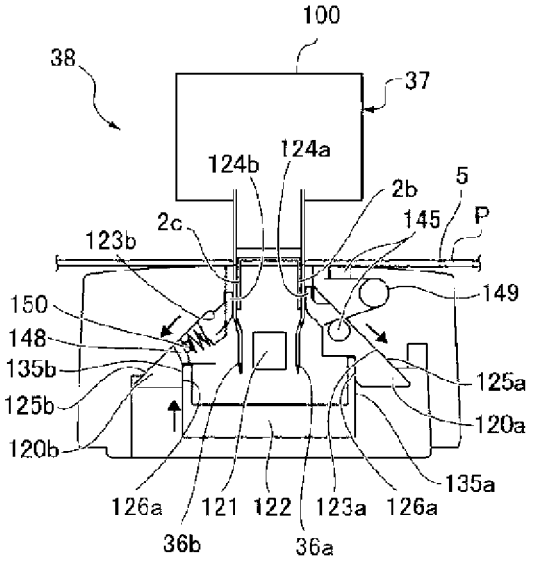

[Fig. 52C]
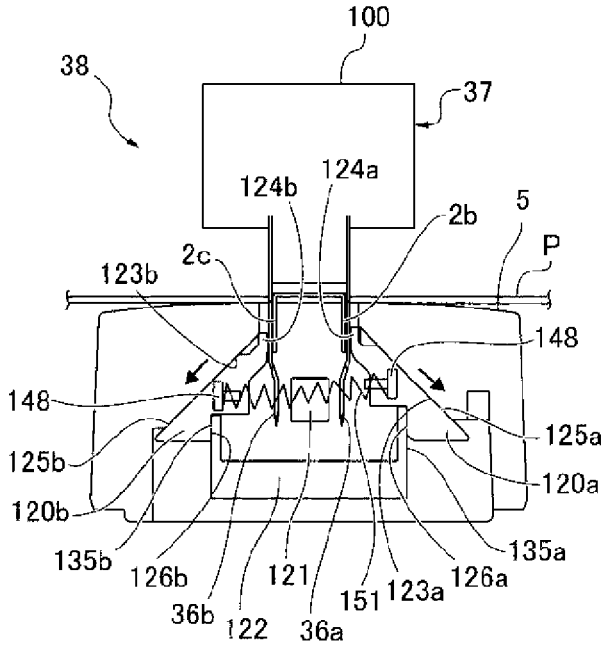

STAPLER

CROSS REFERENCE TO RELATED APPLICATIONS

This application is a 35 U.S.C. 371 National Phase Entry Application from PCT/JP2017/016115, filed Apr. 21, 2017, which claims priority to Japanese Patent Application No. 2016-086604, filed Apr. 22, 2016, the disclosures of which are incorporated herein in their entirety by reference, and priority is claimed to each of the foregoing.

TECHNICAL FIELD

The present invention relates to a stapler.

BACKGROUND ART

A stapler is used to bind a plurality of overlapped sheets. Such a stapler generally uses a metal staple. However, when a sheet is incinerated or shredded, or when a sheet is recycled, it is necessary to remove the metal staple for differentiation, which takes effort. In addition, in the case of a food-related use, it is desired to avoid a mix of an iron staple which is a foreign matter. In this regard, there is a stapler which uses a nonmetal staple made of paper, synthetic resin, or the like which does not require such an effort (see Patent Literature 1).

The stapler using such a nonmetal staple binds a plurality of sheets in such a manner that the through hole is formed in the sheet, the nonmetal staple formed in a U shape is inserted from one surface side of the sheet, and staple legs of the nonmetal staple protruding to the other surface side of the sheet are bent.

For this reason, the stapler includes, at least, a penetration mechanism which moves up and down a pair of right and left cutting blades capable of holding the U-shaped nonmetal staple with respect to the sheet, and a bending mechanism which bends the staple legs of the nonmetal staple, which protrude to the other surface side of the sheet, inward along the other surface of the sheet, and sticks the right and left staple legs to each other.

In order to enable continuous operations, a plurality of nonmetal staples are connected in a flat state to be a belt-shaped connection staple.

The stapler includes a transportation mechanism which transports a tip of the belt-shaped connection staple along a transportation path, and a cutting forming mechanism which cuts the nonmetal staple positioned in a top one by one from the tip of the connection staple transported by the transportation mechanism and performs forming in a U shape. The nonmetal staple cut and formed by the cutting forming mechanism is loaded between the pair of right and left cutting blades of the penetration mechanism by the above-described transportation mechanism.

Additionally, the belt-shaped connection staple is wound in a roll shape in order to make the connection staple longer and easier to use. Further, the stapler has a structure which can handle a roll-shaped connection staple.

CITATION LIST

Patent Literature

[Patent Literature 1]: JP-U-62-35779
[Patent Literature 2]: JP-A-2007-167978

[Patent Literature 3]: JP-A-2008-44053
[Patent Literature 4]: JP-A-2014-113679

SUMMARY OF INVENTION

Technical Problem

However, the stapler described in Patent Literatures 1 to 4 has following problems. That is, the stapler for nonmetal staples described in Patent Literatures 2 to 4 includes the bending mechanism having a pair of bending members which bend the pair of staple legs of the nonmetal staple penetrating the sheet in order, and a sticking member which sticks the pair of staple legs. In the bending mechanism, the pair of bending members or the sticking member are moved up and down while avoiding the cutting blade, and the pair of staple legs are bent by pressing upward from a lower side. For this reason, an extruding member for bending the tip of the staple leg inward in advance, a wall surface for preventing an escape of the staple legs in a front and rear direction, and the like are provided, so that the number of components increases, and a configuration becomes complicated.

Patent Literature 2 does not disclose a specific driving mechanism which operates the bending mechanism. However, Patent Literatures 3 and 4 disclose a driving member which drives respective members of the bending mechanism in a determined order (sequence) in correspondence to an operation in which the cutting blade forms the through hole in the sheet by the penetration mechanism. Such a driving member includes a lot of components such as a cam and a shaft, so that a configuration or a timing matching becomes complicated.

On the other hand, Patent Literature 1 discloses a configuration in which an inclined surface is provided on a lower surface of the pair of bending members which bend the pair of staple legs of the metal staple, and the pair of bending members are moved through the inclined surface in a direction of approaching to each other by the driving member so as to bend the staple legs. However, the stapler described in Patent Literature 1 binds the sheet by penetrating the sheet by using the metal staple itself without the cutting blade. Therefore, even when the bending mechanism in Patent Literature 1 is applied to the stapler for nonmetal staples, the staple leg cannot be bent while avoiding the cutting blade, which is a room for improvement.

The invention was made to solve the above-described problems, and an object thereof is to provide a stapler in which a staple leg of a nonmetal staple can be reliably bent with a small number of components and a simple configuration, so as to reduce a cost.

Solution to Problem

In order to solve the above-described problems, in the invention, a stapler includes a penetration mechanism that is mounted with a pair of cutting blades which allow a pair of staple legs of a nonmetal staple to penetrate a binding object, and a bending mechanism that bends the pair of staple legs which penetrate the binding object along the binding object. In the pair of cutting blades, hole parts or notched parts are provided in penetration parts which penetrate the binding object. The bending mechanism includes a pair of bending members which move along a bending direction in which the pair of staple legs bend inward and which protrude from the hole parts or the notched parts toward between the pair of cutting blades so as to bend the pair of staple legs, guide surfaces which guide the pair of bending members in the bending direction, and a driving member which drives the pair of bending members. The pair of bending members are provided between the guide surfaces and the driving member.

Advantageous Effects of the Invention

According to the invention, with the above-described configuration, a stapler can be provided in which a staple leg of a nonmetal staple can be reliably bent with a small number of components and a simple configuration so as to reduce a cost.

BRIEF DESCRIPTION OF DRAWINGS

FIG. 1A is a perspective view illustrating the entire stapler.

FIG. 1B is a side view of FIG. 1A.

FIG. 2 is a perspective view illustrating the entire nonmetal staple.

FIG. 3 is a view illustrating in a state where sheets are bound with the nonmetal staple.

FIG. 4 is a plan view illustrating a state where the nonmetal staple is connected to be a connection staple.

FIG. 5 is a perspective view illustrating a state where the connection staple is wound in a roll shape.

FIG. 6 is a plan view illustrating a modification of the nonmetal staple.

FIG. 7 is a view for describing a parallel binding guide part.

FIG. 8 is a view for describing a corner binding guide part.

FIG. 9 is a perspective view illustrating the entire stapler in which a body cover is removed similarly to FIG. 1A.

FIG. 10 is a perspective view of the stapler taken vertically.

FIG. 11 is a side view of the stapler taken vertically in a width center position.

FIG. 12A illustrates a transportation path, and is a perspective view illustrating the entire stapler when viewed from an obliquely rear upper side.

FIG. 12B is a partially enlarged view of FIG. 12A.

FIG. 13A is a perspective view illustrating a state where the connection staple is passed through the transportation path similarly to FIG. 12A.

FIG. 13B is a partially enlarged view of FIG. 13A.

FIG. 14A is a perspective view illustrating transportation path components when viewed from a front side.

FIG. 14B is a perspective view illustrating transportation path components when viewed from a rear side.

FIG. 14C is a front view illustrating transportation path components.

FIG. 14D is a plan view illustrating transportation path components.

FIG. 14E is a side view illustrating transportation path components.

FIG. 15 is a vertical sectional view of the stapler when a transportation mechanism is viewed from the side.

FIG. 16A illustrates the transportation mechanism, and is a perspective view illustrating the entire stapler when viewed from the obliquely rear upper side (a state where the transportation path components are removed).

FIG. 16B is a partially enlarged view of FIG. 16A.

FIG. 17A is a perspective view illustrating a pusher when viewed from an obliquely front side.

FIG. 17B is a perspective view illustrating a pusher when viewed from an upper side.

FIG. 17C is a plan view illustrating a pusher.

FIG. 18 is an exploded perspective view illustrating a relation between a feed pawl of the pusher and a hole part 4 (feed hole) of the connection staple.

FIG. 19 is a perspective view illustrating a relation between the feed pawl of the pusher and the hole part (feed hole) of the nonmetal staple.

FIG. 20 is a perspective view illustrating an operating state of the pusher (in a state where the nonmetal staple is in a cutting forming mechanism).

FIG. 21 is a perspective view illustrating an operating state of the pusher (a state before the nonmetal staple is fed between cutting blades of a penetration mechanism).

FIG. 22 is a perspective view illustrating an operating state of the pusher (a state where after the nonmetal staple is fed between the cutting blades of the penetration mechanism).

FIG. 23 illustrates an aspect of attachment and detachment of a staple cover, and is a schematic side view illustrating the stapler. A portion of the staple cover is omitted to illustrate an interior of the staple cover.

FIG. 24A is a perspective view illustrating the entire stapler attached with the staple cover when viewed from the obliquely rear upper side.

FIG. 24B is a partially enlarged view of FIG. 24A.

FIG. 25A is a perspective view illustrating the staple cover when viewed from an obliquely upper side.

FIG. 25B is a perspective view illustrating the staple cover when viewed from an obliquely lateral side.

FIG. 25C is a perspective view illustrating the staple cover when viewed from an obliquely rear lower side.

FIG. 25D is a perspective view illustrating the staple cover when viewed from an obliquely front lower side.

staple FIG. 26A is an entire perspective view illustrating a relation between a receiving base of the transportation path and a staple protecting protrusion of the staple cover.

FIG. 26B is a partially enlarged front view illustrating a relation between a receiving base of the transportation path and a staple protecting protrusion of the staple cover.

FIG. 27A is a side view illustrating a state where a first non-return claw is used.

FIG. 27B is a side view illustrating a state where the first non-return claw is used (a state where three non-connection staples remain).

FIG. 28 is a side view illustrating a state where a second non-return claw is used.

FIG. 29 is a side view illustrating a state after the second non-return claw is used.

FIG. 30A is a plan view illustrating an arrangement and a use state of the first non-return claw and the second non-return claw in a case where many connection staples remain.

FIG. 30B is a plan view illustrating an arrangement and a use state of the first non-return claw and the second non-return claw in a case corresponding to FIG. 27B (the state of the three remaining non-connection staples).

FIG. 30C s a plan view illustrating an arrangement and a use state of the first non-return claw and the second non-return claw in a case corresponding to FIG. 28 (the state of two remaining non-connection staples).

FIG. 31A is an enlarged side view illustrating a relation between a cover guide of the stapler and a guide protrusion of the staple cover in a state of an initial attachment period.]

FIG. 31B is an enlarged side view illustrating a relation between a cover guide of the stapler and a guide protrusion of the staple cover in a state of an intermediate attachment period.

FIG. 31C is an enlarged side view illustrating a relation between a cover guide of the stapler and a guide protrusion of the staple cover in a state of a latter attachment period.

FIG. 32 illustrates a self-holding structure of the connection staple, and is a vertical sectional view of the entire stapler.

FIG. 33 is a partially enlarged view of FIG. 32.

FIG. 34 illustrates the self-holding structure of the connection staple, and is a plan view of the tip of the connection staple.

FIG. 35 is a partially enlarged view of FIG. 34.

FIG. 36 illustrates a modification of an abutting surface provided in the transportation path component, and is a plan view similarly to FIG. 34.

FIG. 37 illustrates another modification of an abutting surface provided in a stapler body, and is a plan view similarly to FIG. 34.

FIG. 38 illustrates a state where the connection staple is removed, and is a partially enlarged front view similarly to FIG. 26B.

FIG. 39 is a perspective view illustrating components of the cutting forming mechanism and the penetration mechanism.

FIG. 40A is an operation view of the cutting forming mechanism and the penetration mechanism, and illustrates from a standby state to a state where the nonmetal staple is formed to catch staple tips by a staple pressing part of a staple pressing plate.

FIG. 40B is an operation view of the cutting forming mechanism and the penetration mechanism, and illustrates from a state where the staple pressing plate holds the formed nonmetal staple to a state where the nonmetal staple is extruded into the cutting blade by the pusher.

FIG. 41A is an operation view of a cutting blade guide to illustrate an initial position of the cutting blade guide.

FIG. 41B is an operation view of a cutting blade guide in a state where the cutting blade guide retreats, and a first guide part starts to be retracted from between the cutting blades while guiding the cutting blade.

FIG. 41C is an operation view of a cutting blade guide in a state where the second guide part is disposed between the cutting blades, and a bending operation is performed by a bending mechanism.

FIG. 41D is an operation view of a cutting blade guide in a state where the bending operation of the cutting blade guide is completed, and the cutting blade guide stops.

FIG. 42A is an operation view of a link, and illustrates a standby state.

FIG. 42B is an operation view of the link, and illustrates a state where the link is lowered by lowering a link shaft, and the pusher retreats to be deviated from the staple pressing plate.

FIG. 42C is an operation view of the link, and illustrates a state where the link is rotated so that a slide member starts to retreat.

FIG. 42D is an operation view of the link, and illustrates a state where the slide member retreats.

FIG. 42E is an operation view of the link, and illustrates a state where the link shaft reaches a bottom point, and the slide member retreats the most.

FIG. 42F is an operation view of the link, and illustrates a state where the link is rotated in a returning direction by the rise of the link shaft, and the slide member advances to return to a standby position.

FIG. 43A is a plan view for describing a driver body.

FIG. 43B is a front view for describing a driver body.

FIG. 43C is a side view for describing a driver body.

FIG. 43D is a sectional view for describing a driver body.

FIG. 43E is a back view for describing a driver body.

FIG. 44A is a front view to illustrate the driver body when a crown presser is bottomed.

FIG. 44B is a side view to illustrate the driver body when a crown presser is bottomed.

FIG. 44C is a sectional view to illustrate the driver body when a crown presser is bottomed.

FIG. 45A is a perspective view illustrating a bending unit as a component of the bending mechanism.

FIG. 45B is a perspective view illustrating a sticking member as a component of the bending mechanism.

FIG. 45C is a perspective view illustrating the slide member as a component of the bending mechanism.

FIG. 46 is a plan view of the slide member.

FIG. 47 is a view for describing a guide surface provided in the stapler body, and is a perspective view illustrating the stapler body when viewed from an obliquely lower side.

FIG. 48 is a perspective view illustrating a state where respective components of the bending mechanism are assembled with the link FIG. 49A is an operation view of the slide member in a standby state before the slide member is operated.

FIG. 49B is an operation view of the slide member in a state where the slide member starts to operate.

FIG. 49C is an operation view of the slide member in a state where the slide member stops.

FIG. 50A is an operation view of the bending member, and illustrates a standby state where the nonmetal staple is inserted into the sheet, and the bending member is not operated yet.

FIG. 50B is an operation view of the bending member, and illustrates a state where a first bending member and a second bending member are operated in order, and one and the other staple legs are bent in the same order.

FIG. 50C is an operation view of the bending member, and illustrates a state where one and the other staple legs are stuck by the sticking member.

FIG. 50D is an operation view of the bending member, and illustrates a state where the first bending member is lowered to avoid interference with the other staple leg.

FIG. 51A is an operation view of the sticking member in a standby state before the sticking member is operated.

FIG. 51B is an operation view of the sticking member in a state where the sticking member is rotated.

FIG. 51C is an operation view of the sticking member in a state where the sticking member sticks a pair of staple legs.

FIG. 52A is a view for describing a modification of the bending mechanism to illustrate an example in which the first and second bending members are biased in a direction of pressing upward by two coil springs.

FIG. 52B is a view for describing a modification of the bending mechanism to illustrate an example in which the first and second bending members are biased in a depressing direction by two coil springs.

FIG. 52C is a view for describing a modification of the bending mechanism to illustrate an example in which the first and second bending members are biased in a direction of pressing upward by one coil spring.

DESCRIPTION OF EMBODIMENTS

Hereinafter, this embodiment will be described in detail with reference to the drawings.

FIGS. 1A to 52C are views for describing the embodiment.

First Embodiment

<Entire Configuration of Stapler>

Hereinafter, the entire configuration of a stapler of the embodiment will be described.

First, "directions" will be described by using a perspective view (or a side view of FIG. 1B) of FIG. 1A. In the embodiment, by using a direction of inserting a sheet as a reference, in the stapler 1, the near side is set as a front direction, the back side is set as a rear direction, a right side is set as a right direction, a left side is set as a left direction, an upper side is set as an upper direction, and a lower side is set as a lower direction. That is, a front and rear direction is set as X, a right and left direction is set as Y, and a vertical direction is set as Z. However, the directions are relative.

Next, a staple (staple) used in the stapler 1 will be described with reference to FIG. 2. As the staple, a nonmetal staple 2 (or soft staple) is used which can be made of paper, synthetic resin, or the like. In addition, the directions of the nonmetal staple 2 are described with reference to a state of being mounted in the stapler 1.

One nonmetal staple 2 has a reverse U shape (or downward U shape) which has a pair of right and left staple legs 2*b* and 2*c* bent at a substantially right angle in both ends of a central crown 2*a* as a top. In the nonmetal staple 2, the crown 2*a* is mounted in the stapler 1 in the state of being directed in the right and left direction Y. The pair of right and left staple legs 2*b* and 2*c* are bent toward the lower side in the stapler 1. Incidentally, the nonmetal staple 2 has a necessary length in the front and rear direction X (a width of the nonmetal staple 2, or a length of the nonmetal staple 2 in a transverse direction).

As illustrated in FIG. 3, the pair of right and left staple legs 2*b* and 2*c* are inserted into the through hole p1 of the sheet P, and the staple legs 2*b* and 2*c* protruding to a back surface side of the sheet P are bent inward in order along the back surface of the sheet P, so that a plurality of sheets P are bound in an overlapped state. In order that the inward-bent staple legs 2*b* and 2*c* are overlapped, a sum length of the pair of right and left staple legs 2*b* and 2*c* is set to be longer than the crown 2*a*.

At that time, an inner surface (or a back surface) of the staple leg 2*c* bent inward from a rear side is provided with an adhesive part 2*d* which can be fixed by adhesion on the outer surface (or a surface) of the staple leg 2*b* previously bent inward when the staple legs 2*b* and 2*c* are bent inward along the back surface of the sheet P. With regard to this, a non-adhesion process for not being adhered by the adhesive part 2*d* (when the nonmetal staple 2 is wound in a roll shape, or is overlapped vertically) is performed at least on the outer surface (or the surface) of the staple leg 2*c*, which is bent inward from the rear side, of the nonmetal staple 2.

As illustrated in FIG. 4, in order to enable a continuous operation, the plural nonmetal staples 2 are connected in the state of flatly extending so as to be a belt-shaped connection staple 3 (or a soft connection staple). Further, as illustrated in FIG. 5, by winding the belt-shaped connection staple 3 in a roll shape, the connection staple 3 is elongated, and the connection staple 3 is contained in the stapler 1 to be used compactly (roll-shaped connection staple).

As illustrated in FIG. 4, the connection staple 3 is obtained in such a manner that a plurality of nonmetal staples 2 having a slender rectangular shape in the state of extending straight in the right and left direction Y are partially connected in the front and rear direction X by a connection part 3*a*. The connection parts 3*a* are provided in two positions in the vicinity of both ends in the right and left direction Y. Taper-shaped slits 3*b* for forming the connection staple 3 in a tapered shape are provided in portions (front and rear edges) outer from the right and left connection parts 3*a*, so that the connection staple 3 is easily inserted into the through hole p1 of the sheet P. In addition, inner portions of the right and left connection parts 3*a* are formed as a continuous slit 3*c* which separates the rear edge and the front edge of the nonmetal staples 2 adjacent in a front and rear direction.

A pair of right and left hole parts 4 for operating the connection staple 3 are provided in a boundary portion between respective connection parts 3*a* and the inner slits 3*c* thereof. The hole parts 4 are used as a locking hole, a feed hole, a positioning hole, or the like for operating the connection staple 3. The hole part 4 can be formed as a round hole, a square hole, an elongate hole, or the like. In this case, the hole part 4 is formed in a rounded-corner square shape.

However, the position or the number of the connection part 3*a* and the hole part 4 is not limited thereto. For example, in FIG. 4, in addition to the pair of right and left hole parts 4 provided in the boundary portion of the front and rear nonmetal staples 2 as described above, a third hole part 4 is provided in the center of each of the nonmetal staples 2 in the front and rear direction X and the right and left direction Y. However, the third hole part 4 may be not provided when not necessary. In addition, as illustrated in FIG. 6, only one hole part 4 may be provided in the center of each of the nonmetal staples 2 in the front and rear direction X and the right and left direction Y. Alternatively, three of more hole parts 4 may be provided in the right and left direction Y.

Incidentally, the above-described nonmetal staple 2 is bent downward to form a crease which is positioned closer to the center in the right and left direction Y compared to the pair of right and left hole parts 4 of FIG. 4 and extends straight in the front and rear direction X (see FIG. 2). The connection staple 3 can be obtained, for example, in such a manner that a punching process is performed on a paper or synthetic resin sheet and the like which are flat in uniform thickness to have the above-described shape.

Next, the stapler 1 will be described.

Returning to FIG. 1A, the above-described stapler 1 includes a stapler body 5 placeable on a base, and an operation handle 6 which is attached in the stapler body 5 to be depressible.

A sheet base 7 for setting the sheet P (see FIGS. 7 and 8) is provided on the front side of the stapler body 5, and a sheet insertion part 8 (binding part) is provided in a position of binding the sheet P on the back side of the sheet base 7. The sheet base 7 and the sheet insertion part 8 are provided substantially horizontally. In the upper portion of the sheet base 7, the front portion of the stapler body 5 is notched to have a substantially rearward descending inclined shape toward the sheet insertion part 8, and the sheet base 7 and the sheet insertion part 8 are provided altogether in a substantially lateral Y shape in the front portion of the stapler body 5.

In the back portion of the sheet insertion part 8, a parallel binding guide part 7*a* for binding the sheet P in parallel to the side of the sheet P is provided as illustrated in FIG. 7, and a corner binding guide part 7*b* for binding a corner of the sheet P obliquely is provided as illustrated in FIG. 8. In addition, the sheet base 7 is provided with a mark 7*c* which is a guide for aligning positions of two sides forming the corner of the sheet P when a corner of the sheet P is set in the corner binding guide part 7*b*.

The stapler body 5 is attached with a body cover 9 (hereinafter, see FIG. 1A together) as an exterior. When the body cover 9 is removed, an inner structure of the operation handle 6 or the stapler body 5 is exposed as illustrated in FIG. 9. Further, the operation handle 6 is configured by a resin handle operation part 11 and a metal handle body 12. Incidentally, convex portions 9*a* and 12*a* (see FIG. 11) for not generating pinching of an object and the like can be provided in a portion where the body cover 9 and the handle body 12 are intersected with each other. In at least one of the rear edge of the body cover 9 and the rear edge of the handle body 12, the convex portions 9*a* and 12*a* are formed in a shape of protruding curvilinearly to the rear side with respect to a portion corresponding to a movable range of the handle body 12.

The resin handle operation part 11 extends to an obliquely rear upper side from a position of the front end side of a portion (upper overhanging portion), which overhangs to the upper side of the sheet base 7 from the sheet insertion part 8, of the front portion of the stapler body 5.

The metal handle body 12 has a substantially triangular shape in side view. A corner portion positioned on the front and lower side is pivotally supported to be vertically rotatable about a spindle 13 extending in the right and left direction Y. With regard to this, a shaft hole 14 pivotally supporting the spindle 13 is provided in (the upper overhanging portion of) the stapler body 5. Further, a portion of the corner portion positioned on the upper side of the metal handle body 12 which has a substantially triangular shape in side view is attached in the intermediate portion of the resin handle operation part 11 in the front and rear direction X.

By vertically rotating about the center of the spindle 13 of the metal handle body 12, the resin handle operation part 11 is vertically tilted from the standby state of being inclined to a rear upper side from the upper overhanging portion of the stapler body 5 to a substantially horizontal pressed state. Accordingly, in the operation handle 6, a pressing operation is performed substantially downward from the upper side. At that time, as illustrated in FIG. 1B, a gap S for not generating the pinching of an object and the like is secured between the handle operation part 11 and the stapler body 5 in a horizontal state.

In a position close to the rear side along the side of the lower side of the metal handle body 12 which has a substantially triangular shape in side view, a link shaft 15 extending in the right and left direction Y is attached (or disposed in an inserting manner) to be movable up and down with respect to the stapler body 5 by the rotation of the operation handle 6. When the link shaft 15 moves up and down, the operation of the operation handle 6 transmits to respective mechanisms of the stapler 1.

In order to move up and down the link shaft 15 in the vertical direction Z, a guide groove 17 extending in the vertical direction Z is provided in the side surface 16 (side wall) of the stapler body 5. In addition, in order to allow the link shaft 15 to move up and down in the vertical direction Z, the shaft hole 14 pivotally supporting the spindle 13 is set as a long hole, and the spindle 13 is used as a movable fulcrum. When the spindle 13 is set as a movable fulcrum, it is possible to reduce the operating force of the operation handle 6.

For example, the shaft hole 14 is set as a refracting hole which has a horizontal portion on the front side, and has a rearward ascending inclined portion on the rear side. Accordingly, when the handle operation part 11 is raised upward, the spindle 13 is positioned in the upper end of the inclined portion of the shaft hole 14. When the handle operation part 11 is pressed so that such a state becomes a horizontal state, the spindle 13 moves to the front end of the horizontal portion down on the inclined portion of the shaft hole 14. Further, when the spindle 13 moves downward on the inclined portion of the shaft hole 14 according to depressing the handle operation part 11, that is, when the fulcrum moves, it is possible to reduce a pressing force in an initial period of pressing downward. In addition, when the handle operation part 11 approaches to a lower limit position, the spindle 13 enters the horizontal portion of the shaft hole 14, that is, the position of the fulcrum is fixed, and thus it is possible to generate a large operating force.

For example, the link shaft 15 is used to move a metal link 18 interposed between the side surface 16 of the stapler body 5 and the metal handle body 12. A function of the link 18 will be described later.

In the link 18, the upper portion thereof is held to be movable in a direction along the side surface 16 of the stapler body 5 (for example, the front and rear direction X, the vertical direction Z, and the like) in the state of being interposed between the side surface 16 of the stapler body 5 and the metal handle body 12. In addition, in the link 18, the lower portion thereof is held lockingly to be movable in a direction along the side surface 16 of the stapler body 5 by a hook-shaped link holding part 19 provided in the side surface 16 of the stapler body 5.

The link 18 is set in a substantially crank shape in side view which has an upper extension part 18*a* which is positioned on the upper side to extend substantially in the vertical direction Z, an intermediate rear extension part 18*b* which extends rearward from the lower end portion of the upper extension part 18*a*, and a lower extension part 18*c* which is positioned on the lower side to extend downward from the rear end portion of the rear extension part 18*b*.

The upper extension part 18*a* on the upper side of the link 18 is provided with a first guide groove 21 which extends substantially in the vertical direction Z and guides the up and down movement of the link shaft 15.

The intermediate rear extension part 18*b* of the link 18 is provided with a guide hole 22 which guides the movement of the link 18 itself, and the side surface 16 of the stapler body 5 is provided with a guide protrusion 23 which is fitted into the guide hole 22. The guide protrusion 23 has a substantially square shape in side view.

On the rear portion of the side surface 16 of the stapler body 5, a regulation protrusion 24 which regulates the rearward movement of the link 18 such that the rear edge of the link 18 abuts thereon is provided. The regulation protrusion 24 has a square shape in side view.

The link 18 controls the respective movements of two shafts 25 and 26 (to be described later) by a movement thereof. The two shafts 25 and 26 are guided by a second guide groove 27 and a third guide groove 28 which are respectively provided in the intermediate rear extension part 18*b* of the link 18 and the lower extension part 18*c* on the lower side of the link 18. Incidentally, the guide hole 22 and the second guide groove 27 of the rear extension part 18*b* of the link 18 are connected, but this application is not limited thereto.

The link 18 is provided with the pressing protrusion 30 which protrudes into the second guide groove 27 and presses one shaft 25 to the rear side or the like in conjunction with a lowering operation and a rotating operation of the link 18.

As illustrated in a perspective view, which illustrates a section of the stapler 1 taken vertically in a width center position, of FIG. 10, the rear portion of the stapler body 5 is provided with a containing part 31 which directly contains the roll-shaped connection staple 3, and a transportation path 32 which guides the tip drawn from the roll-shaped portion of the connection staple 3. On the upper side of the containing part 31 and the transportation path 32, a staple cover 33 which covers the upper sides is attached detachably.

A transportation mechanism 34 which can transport the tip of the connection staple 3 drawn from the roll-shaped connection staple 3 contained in the containing part 31 forward (transporting direction) along the transportation path 32 is provided on the lower side of the transportation path 32.

A cutting forming mechanism 35 which has both functions of a cutting mechanism cutting the nonmetal staple 2 positioned in the top of the connection staple 3 and a forming mechanism forming the cut nonmetal staple 2 in a U shape, and a penetration mechanism 37 which moves up and down a pair of right and left cutting blades 36 which can hold the nonmetal staple 2 formed in a U shape by the cutting forming mechanism 35 to form the through hole p1 in the sheet P are provided on the front side of the transportation path 32.

Incidentally, the transportation mechanism 34 sends the connection staple 3 forward by the amount of one nonmetal staple 2. In addition, each of the cutting forming mechanism 35 and the penetration mechanism 37 is configured to be contained in substantially the same dimension as a dimension of one nonmetal staple 2 in the front and rear direction X.

A cutting mechanism and a forming mechanism can be configured separately. In addition, the main components of the cutting forming mechanism 35 and the penetration mechanism 37 can be integrated as described later. The cutting blade 36 extends substantially in the vertical direction Z and is made of metal. The cutting blade 36 has substantially the same width as the width (the length in the transverse direction) of the nonmetal staple 2, and the surface thereof is attached in the same direction (that is, a direction substantially perpendicular to the right and left direction Y) as those of the staple legs 2*b* and 2*c* of the nonmetal staple 2. The penetration mechanism 37 is provided in a position of the sheet insertion part 8.

A bending mechanism 38 which bends the staple legs 2*b* and 2*c*, which are inserted into the through hole p1 together with the cutting blade 36 to protrude to the back surface side of the sheet P, of the nonmetal staple 2 inward along the back surface of the sheet P, and sticks the right and left staple legs 2*b* and 2*c* is provided on the lower side of the sheet insertion part 8. Incidentally, the above-described two shafts 25 and 26 drive the transportation mechanism 34 and the bending mechanism 38, respectively.

An opening 41 is provided on the lower surface of the stapler body 5. A cover 43, which can be opened and closed by being rotated downward and rearward about a hinge 42 provided on the rear side at the time of clogging of the nonmetal staple 2 and the like, is attached in the opening 41. A lock part 44 which holds the cover 43 in a closed state is provided on the front side of the cover 43. Incidentally, a portion of the above-described bending mechanism 38 may be separately attached on the inner surface side of the cover 43.

In the stapler 1 using the nonmetal staple 2, when the operation handle 6 is operated to be depressed, the penetration mechanism 37 moves through the above-described link shaft 15, and the transportation mechanism 34 and the bending mechanism 38 move through the above-described link 18 in conjunction with the penetration mechanism 37.

At that time, as illustrated in FIG. 11, the stapler 1 performs the returning operation and the like by four springs.

The first spring is a handle returning spring 45 which returns the operation handle 6 (to the upper standby position). The second spring is a crown pressing spring 46 which presses the crown 2*a* of the nonmetal staple 2 at the time of bending the sheet P. The third spring is a pusher returning spring 47 provided in the transportation mechanism 34. The fourth spring is a slider returning spring 48 provided in the bending mechanism 38.

Among them, the first handle returning spring 45 is a screw coil spring in which a coil part 45*a* is externally locked with the spindle 13, one arm 45*b* is locked with the stapler body 5, and the other arm 45*c* is locked with the metal handle body 12. The handle returning spring 45 biases the metal handle body 12 in a direction of rotating upward.

The second crown pressing spring 46 adjusts a state of the penetration mechanism 37 and the like in correspondence to the thickness of the bound sheet P, and is a coil spring extending in the vertical direction Z. Each of the third pusher returning spring 47 and the fourth slider returning spring 48 is a coil spring extending in the front and rear direction X.

Hereinbefore, the entire configuration of the stapler has been described.

<Configuration of Respective Parts of Stapler 1>

Next, the characteristics of respective parts of the stapler 1 of the embodiment will be described in order.

Operation Handle 6

(Configuration 1) The stapler 1 of the embodiment includes the stapler body 5 which has the penetration mechanism 37 and provides a sheet placement part (sheet base 7) on which the sheet P can be placed on one end side (front end side in the embodiment), and the operation handle 6, which is connected to the one end side of the stapler body 5 and has the handle operation part 11 which can perform a pressing operation, wherein the penetration mechanism 37 forms the through hole p1 in the sheet P placed on the sheet placement part (sheet base 7), and allows the nonmetal staple 2 supplied from the other end side (rear end side in the embodiment) to penetrate through the through hole p1.

The penetration mechanism 37 is configured to form the through hole p1 in the sheet P placed on the sheet placement part (sheet base 7) in conjunction with the pressing operation of the operation handle 6, and to make the nonmetal staple 2 to penetrate therethrough.

The handle operation part 11 is formed to extend from the one end side of the stapler body 5 to the other end side.

(Operational effect 1) As described above, the handle operation part 11 of the operation handle 6 extends from the front end side (one end side) of the stapler body 5 toward the rear end side (other end side). Accordingly, in the stapler body 5, the other end portion (rear portion) of the stapler body 5 can receive a counterforce at the time of pressing the operation handle 6 (downward).

(Configuration 2) The containing part 31 in which the nonmetal staple 2 is contained is provided on the other end side of the stapler body 5.

(Operational effect 2) A structure (for example, the containing part 31 or the transportation path 32) for supplying the nonmetal staple 2 is provided in the rear portion of the stapler body 5. Accordingly, with the containing part 31 and the like, it is possible to secure a receiving part of the counterforce at the time of pressing the operation handle 6 (downward). Therefore, although it is not a case where the rear portion of the stapler body 5 is particularly enlarged (to receive the counterforce), it is possible to stably receive the counterforce as it is, and to miniaturize the stapler body 5 to that extent.

With regard to this, for example, in a case where the operation handle 6 extends from the rear end side (other end side) of the stapler body 5 toward the front end side (one end side), in order to prevent an overturn of the stapler body 5, the operation handle 6 is necessarily provided such that a portion for receiving the counterforce (for example, a V-shaped support leg portion) overhangs to the near side with respect to the front portion of the stapler body 5 at the time of pressing (downward) the operation handle 6, whereby the stapler body 5 increases in size. Therefore, when the operation handle 6 extends from the front end side (one end side) of the stapler body 5 to the rear end side (other end side), the stapler body 5 is miniaturized, which is advantageous in terms of structure.

(Configuration 3) The operation handle 6 is connected in a position (vertically) facing to the sheet placement part (sheet base 7) of the stapler body 5.

(Operational effect 3) When the operation handle 6 is disposed in a position of being overlapped with the sheet placement part (sheet base 7) of the stapler body 5, it is possible to compactly provide the operation handle 6 in the stapler body 5.

(Configuration 4) The operation handle 6 is rotatably attached in the stapler body 5.

Further, the handle operation part 11 is configured to rotate about the spindle 13 provided in the stapler body 5 at the time of the pressing operation.

(Operational effect 4) When the operation handle 6 is rotatably attached in the stapler body 5, it is possible to use the principle of the lever, and thus it is possible to obtain a large output from a small input. Accordingly, it is possible to simply operate the stapler 1.

(Configuration 5) The handle operation part 11 extends to be inclined on an upward gradient (rear upper side in the embodiment) from one end side of the stapler body 5 to the other end side. Also, the handle operation part 11 is configured such that the other end side moves upward and downward (the rear end portion in the embodiment is lowered and raised) about the spindle 13 provided in the stapler body 5 at the time of pressing the handle operation part 11.

(Operational effect 5) With the configuration, the operation handle 6 is pressed downward while a length from the spindle 13 to the link shaft 15 (action point) (for operating the penetration mechanism 37) in the front and rear direction X, and a length from the spindle 13 to the end portion (effort point) opposite to the spindle 13 of the operation handle 6 in the front and rear direction X are larger. Thus, it is possible to obtain larger output in the vicinity of a lower limit position of the operation handle 6.

(Configuration 6) The spindle 13, which pivotally supports the end portion (the front end in the embodiment) positioned on one end side of the stapler body 5 of the operation handle 6 with respect to the stapler body 5, is provided on one end side (the front side in the embodiment) from the penetration mechanism 37.

(Operational effect 6) As described above, the spindle 13 which pivotally supports the front end of the operation handle 6 with respect to the stapler body 5 is provided in a position on the front side from the penetration mechanism 37. Accordingly, it is possible to take a large lever ratio which is determined by the length from the spindle 13 (for operating the penetration mechanism 37) to the link shaft 15 (action point), and the length from the spindle 13 to the end portion (effort point) in a direction opposite to the spindle 13 of the operation handle 6. Thus, it is possible to obtain a larger output from a smaller input.

(Configuration 7) An anti-slip member 10 is provided in the lower portion on the other end side (the lower portion on the rear end side in the embodiment) of the stapler body 5.

Further, the end portion (the rear end portion in the embodiment), which is positioned on the other end side of the stapler body 5, of the operation handle 6 has such a length not to protrude to the other end side (the rear end side in the embodiment) from the anti-slip member 10 when the operation handle 6 is laid down.

(Operational effect 7) The anti-slip member 10 is provided in the lower portion (bottom portion) on the rear end side of the stapler body 5, and thus it is possible to prevent the stapler body 5 from moving rearward when the operation handle 6 is laid down. Incidentally, the anti-slip member 10 can be provided also in the lower portion (bottom portion) and the like on the front end side of the stapler body 5. As the anti-slip member 10, a material with a large frictional resistance such as rubber, elastomer, and cork can be used. Further, the rear end portion of the operation handle 6 when the operation handle 6 is laid down has such a length not to protrude to the rear side from the anti-slip member 10, or not to bulge. Accordingly, it is possible to stabilize the stapler body 5 when the operation handle 6 is pressed downward.

Transportation Path 32

As illustrated in FIGS. 12A and 12B (see FIGS. 13A and 13B together), the above-described transportation path 32 is provided in the rear portion of the stapler body 5, and is configured by a transportation path component 51 as illustrated in FIGS. 14A, 14B, 14C, 14D and 14E.

The transportation path component 51 is mainly configured by the transportation path 32 which is a substantially horizontal surface. A vertical wall 52 standing upward is provided in the front end of the transportation path 32, and side walls 53 standing upward are provided in both ends of the transportation path 32.

A staple through opening 54 through which the tip of the connection staple 3 passes is provided in the lower edge of the above-described vertical wall 52 of the transportation path component 51 (the boundary portion with the front edge of the transportation path 32). The staple through opening 54 has an oblong slit shape which has a width dimension which is substantially the same as or slightly wider than a width dimension of the connection staple 3, and a vertical dimension which is substantially the same height as or slightly higher than the thickness of the connection staple 3.

A first recess 55 in which a width is narrower than the staple through opening 54, and the height is higher, and a second recess 56 in which a width is narrower than the first recess 55, and the height is higher are integrally provided on the upper side of the staple through opening 54. Among them, the first recess 55 has a width dimension which is substantially the same as or larger than the interval of the pair of right and left hole parts 4 of the nonmetal staple 2 or the connection staple 3. In addition, the second recess 56 has a width dimension which is substantially the same as or larger than a width of the crown 2*a* of the nonmetal staple 2.

On the front side of the transportation path 32, a pair of right and left slits 57 extending in the front and rear direction are provided in a position coinciding with the pair of right and left hole parts 4 of the nonmetal staple 2 or the connection staple 3.

A receiving base 58 extending to a front side in the state of flushing with the transportation path 32 protrudes in a position between the pair of right and left slits 57 on the front side of the transportation path 32. The receiving base 58 has substantially the same width dimension as the crown 2*a*. The receiving base 58 supports the crown 2*a* of the nonmetal staple 2 from below when the nonmetal staple 2 is inserted into the above-described cutting forming mechanism 35, and is formed in a U shape by the cutting forming mechanism 35. The receiving base 58 is formed in a reverse base shape in front view.

Transportation Mechanism 34

As illustrated in FIGS. 15 and 16, the above-described transportation mechanism 34 is provided on the lower side of the transportation path 32, and the transportation mechanism 34 is mainly configured by the pusher 61 illustrated in FIGS. 17A, 17B and 17C.

A pair of right and left feed pawls 62 extending substantially forward are provided in both side portions of the pusher 61. As illustrated in FIGS. 18 and 19, the feed pawl 62 passes from the lower side through the hole part 4 (feed hole) of the nonmetal staple 2 or the connection staple 3, and sends the connection staple 3 forward. The feed pawl 62 is elastically deformable in the vertical direction Z. In order to improve an elastic deformation capability of the feed pawl 62 in the vertical direction Z, the feed pawl 62 is formed such that a base portion stands upward once, and extends forward. Incidentally, the first recess 55 in the staple through opening 54 of (the vertical wall 52 of) the transportation path component 51 of FIGS. 14A, 14B, 14C, 14D and 14E has such a height that avoids an interference with the tip of the feed pawl 62.

As illustrated in FIGS. 20 to 22 in order, a pressing surface 63 (see FIG. 18) which sends the nonmetal staple 2, which is cut and formed in a U shape by the cutting forming mechanism 35, between the pair of right and left cutting blades 36 of the penetration mechanism 37 is provided on the front surface of the pusher 61. The pressing surface 63 enters and exits the lower side of the receiving base 58 protruding from the front portion of the transportation path 32 to the front side, and has a recess shape which is notched in a reverse base shape in front view so as to match with the receiving base 58 in a reverse base shape in front view (see FIGS. 26A and 26B).

The pusher 61 is contained in the stapler body 5 movably in the front and rear direction X, and is biased normally forward by the pusher returning spring 47 mounted between the rear portion of the pusher 61 and the stapler body 5.

The lower portion of the pusher 61 has a shaft hole 64 through which one (pusher driving shaft (shaft 25), see FIG. 9) of the above-described two shafts 25 and 26 is disposed to penetrate in the right and left direction Y. The pusher driving shaft (shaft 25) is guided to the second guide groove 27 provided in the above-described link 18, and is moved against an elastic force of the pusher returning spring 47 in the front and rear direction X.

A pair of guide arms 65 extending the right and left direction Y are provided integrally in both side portions of the pusher 61. The guide arm 65 is elastically deformable in the vertical direction Z. The guide arm 65 moves along a guide part 66 (see FIG. 42B) provided in (a position in vicinity of the second guide groove 27 of) the rear portion of the stapler body 5.

A locking small convex part 67 protrudes upward in the guide part 66. When the operation handle 6 is depressed, the guide arm 65 is locked in the rear portion of the locking small convex part 67, and the pusher 61 is locked in the state of being retreated against a biasing force of the pusher returning spring 47. The locking small convex part 67 has a rearward ascending inclined surface 67*a* on the front side, and has a locking surface 67*b* extending in the vertical direction Z on the rear side.

As described later, at the time of returning the operation handle 6, the link 18 is raised, the guide arm 65 is raised in the lower edge of the second guide groove 27, and thus the guide arm 65 of the pusher 61 is deviated from the locking surface 67*b* of the locking small convex part 67 so that the lock state is released. Thus, the pusher 61 moves forward by the biasing force of the pusher returning spring 47.

At that time, the pusher 61 moves in the front and rear direction X by a distance of one nonmetal staple 2. Further, as illustrated in FIG. 15, in a state where the first (top) nonmetal staple 2 from the front side of the connection staple 3 is mounted in the cutting forming mechanism 35, the feed pawl 62 enters the first hole part 4 from the front side of the connection staple 3 when the pusher 61 advances, and the feed pawl 62 moves to the second hole part 4 from the front side of the connection staple 3 when the pusher 61 retreats. Accordingly, it is possible to send the nonmetal staple 2 to the cutting forming mechanism 35 to the last one. Incidentally, after formed in a U shape by the cutting forming mechanism 35, the last one nonmetal staple 2 is sent between the pair of right and left cutting blades 36 of the penetration mechanism 37 not by the feed pawl 62, but by the pressing surface 63 of the pusher 61. In addition, although not illustrated particularly, a stopper part for regulating the nonmetal staple 2 sent by the pusher 61 not to protrude forward from the penetration mechanism 37 is provided on the front side of the penetration mechanism 37.

Staple Cover 33

As illustrated in FIGS. 23 and 24, the above-described staple cover 33 is detachably attached on the upper side of the containing part 31 and the transportation path 32 of the rear portion of the stapler body 5.

An attachment protrusion 33*a* is provided on the side surface of the staple cover 33. The attachment protrusion 33*a* fixes lockingly the staple cover 33 in the stapler body 5 by entering an attachment hole part 16*a* (see FIG. 9) provided in the side surface 16 of the stapler body 5. The attachment protrusion 33*a* is configured to perform an accurate positioning on the connection staple 3 by aligning in the edge on the rear side of the attachment hole part 16*a* (rear alignment). For this reason, the attachment hole part 16*a* has a slight clearance for positioning in the front and rear direction X with respect to the attachment protrusion 33*a*.

The staple cover 33 is configured mainly by a transparent resin having the upper surface and both right and left side surfaces as illustrated in FIGS. 25A through 25D. Further, the staple protecting protrusion 71 protruding forward protrudes on the tip side of the above-described staple cover 33. As illustrated in FIGS. 26A and 26B, the staple protecting protrusion 71 is provided on the upper side of the receiving base 58 in correspondence to the receiving base 58 of the transportation path 32.

The staple protecting protrusion 71 has a width dimension which is substantially the same as or smaller than the crown 2*a* of the nonmetal staple 2. The staple protecting protrusion 71 protects the crown 2*a* of the nonmetal staple 2 by covering the crown 2*a* from above when the nonmetal staple 2 is inserted into the cutting forming mechanism 35, and is formed in a U shape by the cutting forming mechanism 35. The staple protecting protrusion 71 penetrates through the second recess 56 on the upper side of the staple through opening 54 in the vertical wall 52 of the transportation path component 51 and is disposed in the cutting forming mechanism 35. Incidentally, the second recess 56 in the staple through opening 54 of the transportation path component 51 has such a height that the staple protecting protrusion 71 can be inserted.

A narrow gap through which the nonmetal staple 2 or the connection staple 3 passes is provided between the receiving base 58 of the transportation path component 51 and the staple protecting protrusion 71 of the staple cover 33. Vertical guide protrusions 71*a* (see FIGS. 25A through 25D) which can be fitted into the guide groove provided in the cutting forming mechanism 35 are protrudingly provided integrally in the tip of the staple protecting protrusion 71.

As illustrated in FIGS. 27A and 27B (see FIGS. 30A through 30C together), a first non-return claw 72 which lightly presses the connection staple 3 from above, and prevents the connection staple 3 from returning rearward is provided in the upper portion on the front side of the staple cover 33. In the case, a pair of right and left first non-return claws 72 are provided to be inserted from the upper side to the right and left hole parts 4 of the connection staple 3. The first non-return claw 72 is formed as a separate resin elastic claw integrally with the staple cover 33, and prevents that an excessive pressing force is applied to the upper surface of the connection staple 3. In the first non-return claw 72, a claw which has a locking surface 72*a* extending in the vertical direction Z on the front side and has a forward descending slant surface 72*b* on the rear side is provided with respect to a tip of an arm extending forward.

Additionally, as illustrated in FIGS. 28 and 29 (see FIGS. 30A through 30C together), a second non-return claw 73, which lightly presses the connection staple 3 from the upper side, and is switched to the first non-return claw 72 to be used when the remaining connection staple 3 is less, is provided between a pair of right and left first non-return claws 72 (the central position of the connection staple 3 in the right and left direction Y). The second non-return claw 73 is disposed in the state of protruding forward from the first non-return claw 72. The second non-return claw 73 is formed as a separate resin elastic claw integrally with the staple cover 33, and prevents that an excessive pressing force is applied to the upper surface of the connection staple 3. In the second non-return claw 73, a claw which has a locking surface 73*a* extending in the vertical direction Z on the front side and has a forward descending slant surface 73*b* on the rear side is provided with respect to the tip of the arm extending forward. In this case, the second non-return claw 73 is disposed to be close to the front side from the first non-return claw 72 by a length of one nonmetal staple 2 in the front and rear direction X.

As illustrated in FIGS. 31A through 31C (see FIGS. 25A through 25D together), the staple cover 33 includes, with respect to both side portions of the tip, a guide protrusion 76, which is guided along a cover guide 75 provided in the stapler 1 (stapler body 5 and body cover 9) at the time of attaching in the stapler 1.

The staple cover 33 is attached in the stapler 1 by moving from the rear side to the front side (cover attaching direction), and the cover guide 75 and the guide protrusion 76 are provided to guide the attachment. At that time, the cover guide 75 is formed in a non-linear groove shape (guide groove). That is, a lower portion 77 of the groove-shaped cover guide 75 has a substantially horizontal traverse part 77*a* in a position on the near side (rear side), a forward descending inclined portion 77*b* on the back side (front side) of the traverse part 77*a*, and a substantially horizontal seating part 77*c* on the back side (front side) of the inclined portion 77*b*.

The guide protrusion 76 has a forward descending inclined shape which coincides with the inclined portion 77*b* in a state where the staple cover 33 is attached in the stapler 1. A substantially horizontal seating surface 76*a* which abuts (seats) on the seating part 77*c* in a line-contact state when the staple cover 33 is attached in the stapler 1 is provided in the tip of the guide protrusion 76.

An upper portion 78 of the groove-shaped cover guide 75 has a forward descending guide taper part 78*a* on the near side (rear side), a traverse part 78*b* (upper traverse part) substantially parallel to the traverse part 77*a* (lower traverse part) on the back side of the guide taper part 78*a*, an inclined portion 78*c* substantially parallel to the inclined portion 77*b* on the back side of the traverse part 78*b*, and a terminal end portion 78*d* substantially parallel to the seating part 77*c* on the back side of the inclined portion 78*c*.

As illustrated in FIG. 31A, a tapered groove, which is gradually narrower from a wide state toward the front side such that the staple cover 33 can be obliquely inserted in a forward descending state, is formed between the traverse part 77*a* and the guide taper part 78*a* on an entry side.

In order that the staple cover 33 cannot enter without a posture change from the obliquely forward descending state illustrated in FIG. 31A to a horizontal state illustrated in FIG. 31B, a space between the intermediate traverse part 77*a* and the traverse part 78*b* is set as a traverse groove of the interval 79*a* which is narrower than the height of the guide protrusion 76 of the staple cover 33 in the forward descending state in the vertical direction Z. Incidentally, (the tapered groove of) the entry side of the cover guide 75 has a shortening height dimension to form the interval 79*a*.

As illustrated in FIG. 31B, a descending groove of the interval 79*b*, which is substantially the same as the thickness of the guide protrusion 76 itself, is formed between the inclined portion 77*b* and the inclined portion 78*c* which are close in depth such that the staple cover 33 in a substantially horizontal state is fallen downward along the inclined portion 77*b* as it is.

Finally, as illustrated in FIG. 31C, in order that the guide protrusion 76 is substantially regulated in a position in the vertical direction Z in a state where the staple cover 33 is attached, a space between the seating part 77*c* on the back side and the terminal end portion 78*d* is set as a holding groove of the interval 79*c* which is substantially the same as the height dimension of the inclined guide protrusion 76 of the staple cover 33 in a horizontal state in the vertical direction Z.

In this manner, it is possible to prevent a defect generated when the staple cover 33 is attached in the stapler 1, for example, that a guide protrusion 71*a* protruding from the staple protecting protrusion 71 of the tip of the staple cover 33, the locking surface 72*a* of the first non-return claw 72, or the locking surface 73*a* of the second non-return claw 73 scrubs forward the upper surface of the connection staple 3, and forcibly advances the connection staple 3 by the guide protrusion 71*a* by seating the stapler cover 33 on the back side to be fallen.

Positioning Structure of Connection Staple 3

When the connection staple 3 is cut into the nonmetal staple 2 one by one by the cutting mechanism (or the cutting forming mechanism 35), it is necessary to determine a cutting position with high accuracy. For this reason, it is extremely important to position the connection staple 3 accurately.

In this regard, for example, it is considered that by using a relatively strong elastic biasing unit such as a metal spring, the connection staple 3 on the transportation path 32 becomes in the state of being pressed normally from the upper side, the connection staple 3 is biased (to the front side) in a transporting direction so that the tip of the connection staple 3 is normally pressed to an abutting part (for example, the cutting blade 36) provided in a back position of (the cutting mechanism of) the transportation path 32, and thus the connection staple 3 is positioned (front alignment).

However, when such a front alignment is performed, in order to prevent the retreat of the connection staple 3 when the transportation mechanism 34 moving in the front and rear direction retreats, an excessive pressing force applied from above by the elastic biasing unit is required. Further, there are problems that a scar easily occurs in the connection staple 3 (a portion pressed by an abutting part (such as the cutting blade 36)) due to continuous pressing forces applied (to the front side) in the transporting direction, and the resistance at the time of transporting the connection staple 3 to the cutting mechanism is increased, for example.

In this regard, in the embodiment, the connection staple 3 is positioned as follows.

(Configuration 1) As described above, the stapler 1 of the embodiment includes a cutting mechanism which cuts the connection staple 3 formed by connecting a plurality of flat nonmetal staples 2 one by one, and the transportation mechanism 34 which transports the connection staple 3 to the cutting mechanism through the transportation path 32.

Further, as illustrated in FIGS. 27A and 27B, a positioning part 81 which performs positioning in a position closer to the rear side in the transporting direction than the tip of the connection staple 3 in the transporting direction is provided in the middle of the transportation path 32.

The positioning part 81 performs positioning of the connection staple 3 by pressing the connection staple 3 in a direction of being directed to the rear side in the transporting direction.

Herein, the cutting mechanism is the above-described cutting forming mechanism 35. The transporting direction is the front side in the front and rear direction X. The direction of being directed to the rear side in the transporting direction is the rear side in the front and rear direction X. A position closer to the rear side in the transporting direction than the tip of the connection staple 3 is a position of the second or subsequent nonmetal staple 2 of the connection staple 3 from the front side. In this case, the position is a position on the third nonmetal staple 2 of the connection staple 3 from the front side. As the positioning part 81, (the locking surface 72*a* directed in the vertical direction Z of) the first non-return claw 72 of the above-described staple cover 33 can be used.

Incidentally, as for (the locking surface 73*a* directed in the vertical direction Z of) the second non-return claw 73 of the staple cover 33 in FIG. 28, when pieces of the remaining connection staples 3 are two, it is possible to perform positioning on the second nonmetal staple 2 of the connection staple 3 as the positioning part 81. Incidentally, as illustrated in FIG. 29, since it is not necessary to perform cutting when the remaining connection staple 3 is one, it is not necessary to perform positioning.

(Operational effect 1) In the configuration, the positioning part 81 which performs positioning in a position closer to the rear side in the transporting direction than the tip of the connection staple 3 is provided in the middle of the transportation path 32. The connection staple 3 is positioned by a temporary pressure (just before cutting the connection staple 3) to the positioning part 81, and in a direction (returning direction) of being directed to the rear side in the transporting direction (rear alignment). Accordingly, a continuous pressure generated by a relatively strong elastic biasing unit such as a metal spring from above is no more required. Thus, an excessive and continuous pressing force does not act on the connection staple 3, and a scar hardly occurs in the connection staple 3. The resistance at the time of transporting the connection staple 3 to the cutting mechanism can be removed so that the nonmetal staple 2 formed of a softer material can be transported.

(Configuration 2) The positioning part 81 can perform positioning by abutting on the edge, which is directed to the rear side in the transporting direction, of the hole part 4 provided in the nonmetal staple 2 or the connection staple 3.

Herein, the hole part 4 is used as a positioning hole. The edge, which is directed to the rear side in the transporting direction, of the hole part 4 is positioned by abutting on the locking surface 72*a* of the positioning part 81 (first non-return claw 72) on the front side. The positioning hole can be also used as a feed hole. However, the positioning hole and the feed hole may be separately provided as a dedicated one.

In the case of the embodiment, by using the first hole part 4 and the second hole part 4 of the connection staple 3 from the front side as feed holes, and using the third hole part 4 from the front side as a positioning hole, the hole parts 4 provided in the same position in the right and left direction Y are used for different purposes to prevent that the first non-return claw 72 and the feed pawl 62 are interfered with each other.

(Operational effect 2) With the configuration, it is possible to reliably perform positioning on the connection staple 3 by a simple configuration. In addition, since the hole part 4 such as the feed hole is provided in the connection staple 3 in advance, it is possible to use the hole part 4 for positioning the connection staple 3 as it is. Incidentally, separately from the feed hole, the hole part 4 may be provided as a dedicated positioning member.

(Configuration 3) Alternatively, the positioning part 81 may perform positioning by abutting on the edges, which are directed to the rear side in the transporting direction, of both ends of the nonmetal staple 2 in the state of extending flatly.

Herein, the edges, which are directed to the rear side in the transporting direction, of the both ends of the nonmetal staple 2 can be set as tapered slits 3*b* provided in the rear edges of the both ends of the nonmetal staple 2 (in this case, the hole part 4 of FIGS. 27A and 27B is replaced with the slit 3*b*). The slit 3*b* of the rear edge of the nonmetal staple 2 is positioned to abut on the locking surface 72*a* on the front side of the positioning part 81. Incidentally, the positioning part 81 in this case is not illustrated particularly. However, for example, the first non-return claw 72 or one similar thereto may be provided in a position of the slit 3*b*.

(Operational effect 3) With the configuration, it is possible to reliably perform positioning on the connection staple 3 by a simple configuration. In addition, since the tapered slits 3*b* for easily inserting the staple legs 2*b* and 2*c* of the U-shaped bent nonmetal staple 2 to the through hole p1 formed in the sheet P are provided with respect to the front edge and the rear edge in both ends of the connection staple 3 in advance, the slit 3*b* of the rear edge among them can be used to position the connection staple 3 as it is.

(Configuration 4) The transportation mechanism 34 includes a returning part 82 which presses the connection staple 3 to the positioning part 81 by temporarily biasing the connection staple 3 in a direction of being directed to the rear side of the connection staple 3 in the transporting direction when the connection staple 3 is cut by the cutting mechanism (cutting forming mechanism 35).

Herein, the returning part 82 can be set as the feed pawl 62 of the pusher 61 in the transportation mechanism 34. In the feed pawl 62, a claw which has a locking surface 62*a* extending in the vertical direction Z on the front side and a rearward descending slant surface 62*b* on the rear side is provided with respect to the tip of the arm extending forward.

(Operational effect 4) As described above, when the connection staple 3 is sent, the feed pawl 62 is retreated from the state of being temporarily advanced. At this time, when the slant surface 62*b* displaces the hole part 4 (or the slit 3*b*) (hereinafter, described as the hole part 4) to the rear side, the claw is guided downward along the slant surface 62*b*, the feed pawl 62 is elastically deformed downward, and the claw of the tip comes out from the first hole part 4 from the front side. Further, the feed pawl 62 is retreated along the back surface of the connection staple 3 to be in the state of passing into the second hole part 4. At this time, as illustrated in FIG. 42D, the retreated state is locked (by locking the guide arm 65 of the pusher 61 in the locking small convex part 67 of (the guide part 66 of) the stapler body 5).

At the time of starting such a retreat of the pusher 61, the slant surface 62*b* of the feed pawl 62 presses rearward the rear edge of the hole part 4 on the front side, and thus, the connection staple 3 is biased to such an extent that slightly retreats to the rear side by a few time until the feed pawl 62 comes out from the hole part 4 on the front side. Further, by the small movement of the connection staple 3 at this time, the positioning can be performed by pressing the connection staple 3 to the positioning part 81. With the positioning, it is possible to make a load to the connection staple 3 small, and to accurately cut the connection staple 3 by the cutting mechanism.

Accordingly, the positioning temporarily performed only at the time of cutting by the cutting mechanism may be sufficient. Thus, a mechanistic load necessary for positioning can be reduced, and the transportation mechanism 34 can perform the positioning by using a preliminary operation (retreating operation) for transporting the connection staple 3. The feed pawl 62 of the transportation mechanism 34 can be used as the returning part 82 as it is, and thus, the configuration becomes simple.

(Configuration 5) The positioning part 81 has the locking surfaces, 72*a*, 73*a* which abut on the edge directed to the rear side of the nonmetal staple 2 or the connection staple 3 in the transporting direction when the transportation mechanism 34 biases the nonmetal staple 2 or the connection staple 3 in a direction of being directed to the rear side in the transporting direction.

(Operational effect 5) As described above, the positioning part 81 has the above-described locking surfaces 72*a*, 73*a*. Thus, the positioning can be performed by allowing the edge directed to the rear side of the nonmetal staple 2 or the connection staple 3 in the transporting direction to reliably abut on the locking surfaces 72*a*, 73*a* when the transportation mechanism 34 biases the nonmetal staple 2 or the connection staple 3 in a direction of being directed to the rear side in the transporting direction.

Self-Holding Structure of Connection Staple 3

In order to accurately cut the connection staple 3 formed by connecting the nonmetal staples 2 by the cutting mechanism, it is necessary to accurately mount the connection staple 3 in the stapler body 5. At that time, when the connection staple 3 wound in a roll shape is used, the connection staple 3 is hardly mounted in the stapler body 5 accurately by the effect of the curliness of the connection staple 3. In addition, there is a concern that although the connection staple 3 is accurately mounted, the connection staple 3 is deviated from an accurate position on the stapler body 5 due to the curliness after mounting. When the connection staple 3 is deviated from the accurate position as described above, the connection staple 3 cannot be accurately cut by the cutting mechanism.

In this regard, it is considered that, for example, by containing the roll-shaped connection staple 3 in a cartridge, and attaching the cartridge in the stapler 1, the connection staple 3 is indirectly mounted in the stapler body 5. In this manner, when the cartridge (which has a smaller size than the stapler 1 so as to be easy to handle) is used as a medium, the connection staple 3 is easily mounted in the cartridge. In addition, the connection staple 3 can be accurately mounted in the stapler body 5 through the cartridge, and the connection staple 3 can be hardly deviated.

However, in the case of using the cartridge, an effort to handle the connection staple 3 is increased by the attachment and detachment of the cartridge, and since the cartridge is required, a mechanism which attaches and detaches the cartridge in the stapler 1 is required. For this reason, the structure of the stapler 1 becomes complicated, and the number of the components increases so that the stapler 1 increases in size, and the cost is increased.

In this regard, in the embodiment, the connection staple 3 can be directly and accurately mounted in the stapler body 5 by following configurations.

(Configuration 1) As described above, the stapler 1 of the embodiment includes the cutting mechanism which cuts the connection staple 3 formed by connecting a plurality of flat nonmetal staples 2 one by one, and the transportation mechanism 34 which transports the connection staple 3 to the cutting mechanism through the transportation path 32.

Further, as illustrated in FIG. 32 (to FIG. 35), a staple holding part 84 which can hold the tip of the connection staple 3 or the vicinity thereof is provided on the front side of the transportation path 32 in the transporting direction. The staple holding part 84 includes an abutting surface 85 which abuts on the tip edge of the connection staple 3, an engaging member 87 which is engaged with an engaging part 86 provided in the connection staple 3 from one surface side of the connection staple 3 as illustrated in FIG. 33, and a release regulation part 88 which is disposed on the other surface side of the connection staple 3 to confront the engaging member 87 in the state of interposing the connection staple 3 therebetween and positioning differently from the engaging member 87 on the front and rear side in the transporting direction.

Incidentally, in this embodiment, for example, one surface side is set to a side of the transportation path component 51 or the engaging member 87 with respect to the connection staple 3, that is, the lower surface side of the connection staple 3. In addition, the other surface side is set to a side opposing to the transportation path component 51, for example, a side of the staple cover 33 or the staple holding part 84, that is, the upper surface side of the connection staple 3. However, the above-described configuration may be reversed.

Herein, the staple holding part 84 is preferably provided in a position of each of both side portions of the connection staple 3 in terms that the connection staple 3 is reliably self-held with respect to the stapler body 5, and further, the connection staple 3 is easily removed from the stapler body 5. The self-holding means that the tip of the connection staple 3 or the vicinity thereof is held only by the staple holding part 84 with respect to the stapler body 5 without any other configuration.

The abutting surface 85 may abut lightly on the tip edge of the connection staple 3 when the tip of the connection staple 3 is inserted into the transportation path 32. As the abutting surface 85, for example, as illustrated in FIGS. 34 and 35, the cutting blade 36 of the penetration mechanism 37 can be used. In addition, the abutting surface 85 can be provided in the transportation path component 51, for example, as illustrated in FIG. 36. Alternatively, the abutting surface 85 can be provided in the stapler body 5, for example, as illustrated in FIG. 37.

As the engaging part 86, the hole part 4 of the connection staple 3, the slit 3*b* of both side portions, or the like can be used. As the engaging member 87, the feed pawl 62 of the transportation mechanism 34 and the like can be used. In this case, the engaging member 87 is provided on the lower surface side of the connection staple 3. The release regulation part 88 is provided on the upper surface side of the connection staple 3. However, a positional relation between the engaging member 87 and the release regulation part 88 may be vertically reversed. The release regulation part 88 is preferably provided in the state of being deviated to the front and rear side from the engaging member 87. The release regulation part 88 will be described later.

(Operational effect 1) With the configuration, simply in such a manner that the tip of the roll-shaped connection staple 3 contained in the containing part 31 is drawn, the tip of the connection staple 3 is inserted to the back (front side) of the transportation path 32 to slide along the transportation path 32, and the tip edge of the connection staple 3 lightly abuts on the abutting surface 85, the tip of the connection staple 3 or the vicinity thereof can be directly self-held reliably in the stapler body 5 by the staple holding part 84 included on the front side of the transportation path 32 without any auxiliary components and the like.

At that time, simply in such a manner that the tip of the connection staple 3 is inserted into the back of the transportation path 32 by using one finger, the connection staple 3 can be simply and reliably mounted in the state of being not deviated in the transporting direction (front and rear direction X) without depending on visual observation. In addition, it is possible to prevent that a buckling and the like of the connection staple 3 occurs due to an excessive insertion of the connection staple 3 by the abutting surface 85 of the staple holding part 84.

As a result, it is possible to prevent a mounting error such as a deviation in the transporting direction due to the curliness of the connection staple 3 wound in a roll shape, and to reduce a correcting effort. It is not necessary that the cartridge is provided as a separate component, a space for containing the cartridge in the stapler 1 is provided, and a mechanism which attaches and detaches the cartridge with respect to the stapler 1 is provided in order to accurately mount the connection staple 3 in the stapler 1 (in order to contain and hold the roll-shaped connection staple 3 indirectly). Thus, an effort to handle the connection staple 3 is reduced, and the structure of the stapler 1 is largely simplified, so that the stapler 1 can miniaturized, the number of the components can be reduced, and the cost can be reduced.

(Configuration 2) The release regulation part 88 has a first regulation part 91 provided in a position of the nonmetal staple 2 of the top of the connection staple 3.

Herein, the nonmetal staple 2 of the top of the connection staple 3 is inserted into the cutting forming mechanism 35. Thus, the first regulation part 91 can be provided in an inner surface of a staple pressing plate 92 of the cutting forming mechanism 35 illustrated in FIG. 32.

For example, as illustrated in FIG. 36, the first regulation part 91 can be provided in the transportation path component 51.

(Operational effect 2) With the configuration, the first regulation part 91 reliably regulates a position of the nonmetal staple 2 of the top of the connection staple 3, so that the nonmetal staple 2 can be held not to be released. The first regulation part 91 effectively prevents that the connection staple 3 is buckled after the tip edge of (the nonmetal staple 2 of the top of) the connection staple 3 abuts on the abutting surface 85. In addition, the first regulation part 91 is provided so that the tip of the connection staple 3 abuts on the abutting surface 85 in a state where the buckling occurs hardly, and thus a response at the time of abutting is large (compared to the case of abutting on the abutting surface 85 in the buckled state). Therefore, through the response, it can be clearly felt that the tip of the connection staple 3 is reliably held in the release regulation part 88.

(Configuration 3) The release regulation part 88 may have a second regulation part 93 provided in a position of second or subsequent nonmetal staple 2 of the connection staple 3.

Further, the engaging member 87 is provided in a position between the first regulation part 91 and the second regulation part 93 in the transporting direction of the connection staple 3.

Herein, the second regulation part 93 can be set to an upper edge and the like (which are positioned on the both sides of the first recess 55 and the second recess 56) of the staple through opening 54 provided in the vertical wall 52 of the transportation path component 51.

In this case, as illustrated in FIG. 33, the engaging part 86 is set to the first hole part 4 from the front side, and the engaging member 87 is set as a claw of the feed pawl 62 fitted into the first hole part 4. The first regulation part 91 is positioned on the slightly front side from the first hole part 4, and the second regulation part 93 is positioned on the slightly rear side of the first hole part 4.

In this case, as illustrated in FIG. 35, the first regulation part 91 and the second regulation part 93 are provided to be positioned on the outside from the engaging member 87 in the right and left direction Y. Structurally, either one of the first regulation part 91 or the second regulation part 93 may be provided.

Incidentally, for example, as illustrated in FIG. 36, the second regulation part 93 can be provided in the transportation path component 51.

(Operational effect 3) With the configuration, the second regulation part 93 reliably regulates the position of the second or subsequent nonmetal staple 2 of the connection staple 3 so that nonmetal staple 2 can be held not to be released. The tip of the connection staple 3 or the vicinity thereof can be held vertically in a zigzag by the first regulation part 91 and the second regulation part 93 on the upper side, and the engaging member 87 on the lower side. As a result, a larger self-holding force is obtained, and thus the mounted connection staple 3 can be hardly released from the transportation path 32. The second regulation part 93 effectively prevents that the position of the connection staple 3 with the curliness is deviated due to the curliness.

(Configuration 4) As illustrated in FIG. 33, the release regulation part 88 is disposed with the gaps 95 and 96 with respect to the other surface of the connection staple 3.

Further, the tip of the engaging member 87 passes through the engaging part 86 to protrude to the other surface side of the connection staple 3 more largely than the gaps 95 and 96 (protruding amount 97>gaps 95 and 96).

(Operational effect 4) The release regulation part 88 is disposed with the gaps 95 and 96 with respect to the other surface of the connection staple 3. Accordingly, as for the connection staple 3 without the curliness, it is possible to prevent that the release regulation part 88 directly contacts the connection staple 3, and to regulate the tip of the connection staple 3 or the vicinity thereof so that the connection staple 3 can be held not to be released. In addition, as for the connection staple 3 with the curliness, it is possible to hold the tip of the connection staple 3, for example, by allowing the release regulation part 88 to directly contact the connection staple 3 lightly.

As a result, a scar cannot be generated in the connection staple 3, and a transport resistance with respect to the connection staple 3 can be reduced.

The tip of the engaging member 87 passes through the engaging part 86 to protrude to the other surface side of the connection staple 3 more largely than the above-described gaps 95 and 96. Accordingly, the tip of the connection staple 3 passing through the narrow gaps 95 and 96 between the release regulation part 88 and the other surface of the connection staple 3 hardly passes over the engaging member 87. Thus, the connection staple 3 is regulated more reliably and is held not to be released, and thus it can be effectively prevented that the connection staple 3 is deviated from the transportation path 32.

Incidentally, the feed pawl 62 as the engaging part 86 has the rearward descending slant surface 62*b* on the rear side of the claw of the tip, and has the locking surface 62*a* in the vertical direction Z on the front side. When the tip of the connection staple 3 is inserted from the rear side, the slant surface 62*b* is easily passed over, and when the connection staple 3 is pulled back, the locking surface 62*a* is hardly passed over. Therefore, the structure can be easy to be attached and be hard to be released.

However, in a case where the connection staple 3 is removed, as illustrated in FIG. 38, the connection staple 3 is pulled rearward by a necessary force (stronger than a force acting on the connection staple 3 when the connection staple 3 is naturally released from the transportation path 32 by the curliness). Thus, the staple holding part 84 is provided in a position of both side portions of the connection staple 3, and the first recess 55 and the second recess 56 are provided in the intermediate portions of the right and left second regulation parts 93 (staple through opening 54) of the staple holding part 84. Therefore, the connection staple 3 can be bent in an out-of-plane direction (upward) in a middle-height state, and thus the connection staple 3 can be intentionally removed from the staple holding part 84 by using the bending of the connection staple 3.

Hereinafter, the main portion of the stapler 1 will be described by using FIGS. 39 to 52.

Cutting Forming Mechanism 35

As illustrated in FIG. 39, the above-described cutting forming mechanism 35 includes a pair of right and left cutting blades 101 (cutting mechanism) which cut the nonmetal staple 2 from the connection staple 3 one by one, a pair of right and left forming members 102 (forming mechanism) which form the flat nonmetal staple 2 in a U shape, and the staple pressing plate 92 (staple pressing mechanism) which holds the staple legs 2*b* and 2*c* of the nonmetal staple 2 formed in a U shape in order to maintain a U-shaped forming state.

In addition, the receiving base 58 (see FIG. 38) of the above-described transportation path component 51 also functions as a supporting part (fixing part) which supports the nonmetal staple 2 at the time of forming, and is one of components of the cutting forming mechanism 35. Incidentally, as long as the nonmetal staple 2 can be supported not to be moved at the time of forming, the supporting part is not limited to the configuration like the receiving base 58.

The cutting blade 101 and the forming member 102 are provided integrally in a driver body 100 configuring the penetration mechanism 37. The driver body 100 and the staple pressing plate 92 can be moved relatively to the receiving base 58 in the vertical direction Z. In this embodiment, the receiving base 58 is fixed to be unmovable in the vertical direction Z, and the driver body 100 and the staple pressing plate 92 are configured to be moved in the vertical direction Z. However, this application is not limited thereto, the receiving base 58 may be configured to be moved to the driver body 100 and the staple pressing plate 92 in the vertical direction Z. In addition, the cutting blade 101 and the forming member 102 are contained in the staple pressing plate 92, and can be relatively moved in the staple pressing plate 92 in the vertical direction Z. Incidentally, in this embodiment, the forming member 102 is provided integrally in the driver body 100 (penetration mechanism 37). However, this application is not limited thereto. As long as a forming operation can be performed synchronously with a penetrating operation of the penetration mechanism 37, the forming member 102 may be provided separately from the driver body 100.

The driver body 100 has a shaft hole 100*a* extending in the right and left direction Y, and the above-described link shaft 15 is disposed to penetrate through the shaft hole 100*a*. The link shaft 15 is disposed to be inserted into the first guide groove 21 of the above-described link 18 (see FIG. 9) and the guide groove 17 which is provided in the side surface 16 (side wall) of the stapler body 5 and extends in the vertical direction Z. Further, when the link shaft 15 is guided along the guide groove 17, the driver body 100 is moved in the vertical direction Z.

The cutting blade 101 is an example of the cutting blade which cuts the connection part 3*a* of the connection staple 3, and an inclined blade 101*a* is provided on the lower end. The cutting blades 101 are attached in a pair of attachment parts 103 protruding to the back surface side (rearward) of the driver body 100 in a state where the inclined blades 101*a* are directed to the outer sides, respectively.

In order that the cutting blades 101 can cut the connection part 3*a* smoothly, the blade 101*a* is inclined outward, the cutting blades 101 are attached to the attachment part 103 in such an arrangement that the inner surface in the vicinity of the blade edge is inserted into the hole part 4 positioned to the inside from the connection part 3*a*, and each of the blades 101*a* is formed to be longer than the connection part 3*a*. In addition, in each of the cutting blades 101, the outside of the blade 101*a* is notched to provide a notched part 101*b*, and when the cutting blade 101 is moved relatively to the staple pressing plate 92 in the vertical direction Z, the blade 101*a* does not abut on the component of the staple pressing plate 92.

Each of the forming members 102 is provided in a position on the inside of each of the cutting blades 101, and includes an arm 102*a* extending downward from the wall surface of each of the attachment parts 103, and a protrusion

102*b* formed to protrude inward from the tip (lower end) of the arm 102*a*. In the arm 102*a*, the tip is a free end, and a base end portion (fixed end) fixed in the attachment part 103 is set as a base point, so as to be deformable elastically in the right and left direction Y.

In order to bend the staple legs 2*b* and 2*c* of the nonmetal staple 2 placed on the receiving base 58, the arm 102*a* is formed such that a formation height of the protrusion 102*b* from the upper end to the base end portion is a height which is the same as or larger than at least a length (height) of the staple legs 2*b* and 2*c*. In addition, the arm 102*a* is formed such that the length (depth) in the front and rear direction X is a length which is the same as or larger than the length of the nonmetal staple 2 in the transverse direction.

In order that the staple legs 2*b* and 2*c* can be held between the receiving base 58 and the inner wall surface of the arm 102*a*, the width of the receiving base 58 is formed to be substantially the same width dimension as the inner width of the crown 2*a*, and the interval of a pair of arms 102*a* is formed to be substantially the same dimension as the outer width of the crown 2*a*. In addition, the interval of a pair of protrusions 102*b* is formed to be slightly narrower than the outer width of the receiving base 58. With the configuration, when the protrusions 102*b* are lowered, the protrusions 102*b* abut on the receiving base 58 to be elastically deformed outward, and the protrusions 102*b* press the staple legs 2*b* and 2*c* to the receiving base 58 between the protrusions 102*b* and the receiving base 58 to be bent downward. Therefore, it is possible to reliably bend the nonmetal staple 2 in a U shape, and to perform the forming operation stably. In addition, after bending, the pair of staple legs 2*b* and 2*c* are held by the outer surface of the receiving base 58 and the inner surface of a pair of arms 102*a*, and a forming state can be maintained.

The staple pressing plate 92 is formed in a rectangular frame shape, and a pair of regulation protrusions 104 which guide the staple pressing plate 92 to move in the vertical direction Z and regulate the moving amount thereof are provided on the outer surface thereof. The pair of regulation protrusions 104 are inserted into a pair of regulation grooves 29 provided in adjacent to the guide groove 17 on the side surface 16 (side wall) of the stapler body 5 (see FIG. 42A and the like). When the regulation protrusion 104 is guided along the regulation groove 29, the staple pressing plate 92 moves in the vertical direction Z. The regulation groove 29 is a long hole extending in the vertical direction Z. Therefore, when the regulation protrusion 104 abuts on the upper end of the regulation groove 29, the staple pressing plate 92 stops rising. The stop position is the highest point of the staple pressing plate 92. In addition, when the regulation protrusion 104 abuts on the lower end of the regulation groove 29, the staple pressing plate 92 stops lowering. The stop position is a bottom point of the staple pressing plate 92. Further, since the regulation protrusion 104 is formed in an ellipse shape long in the vertical direction Z, the inclination in the front and rear direction X is suppressed so that the regulation protrusion 104 can move in the vertical direction Z smoothly without any shake and the like.

A pair of first regulation parts 91 which regulate the position of the tip of the nonmetal staple 2 in the vertical direction Z are provided on the inner surface of the staple pressing plate 92. A pair of staple leg pressing parts 105 which suppress opening of the pair of staple legs 2*b* and 2*c* of the form nonmetal staple 2 and maintain a forming state are provided on the lower side from the first regulation part 91. The staple pressing part 105 suppresses opening of the staple tip by guiding a staple tip inward by a taper surface 105*a* protruding inward. A pair of staple pressing parts 105 are formed to have such a length that can hold an insertion interval for inserting the pair of staple legs 2*b* and 2*c* formed in a U shape. In addition, a formation height of the staple pressing part 105 is formed to be such a height that when the staple pressing plate 92 is lowered to reach a bottom point, the upper end of the staple pressing part 105 does not interfere with the tips of the staple legs 2*b* and 2*c* of the formed nonmetal staple 2. In other words, the staple pressing part 105 is configured to retract to a position of not contacting the bent staple legs 2*b* and 2*c* when the forming member 102 is lowered to form the nonmetal staple 2 in a U shape.

On the other hand, the dimensions are set such that when the forming is completed and the staple pressing plate 92 is raised together with the forming member 102, the staple legs 2*b* and 2*c* can be held by being caught by the tips of the staple pressing parts 105 in a state where the arms 102*a* hold (a portion of) the staple legs 2*b* and 2*c*. Therefore, the delivery (staple picking) can be performed stably by suppressing opening of the staple legs 2*b* and 2*c* during the delivery of the staple legs 2*b* and 2*c* from the arms 102*a* to the staple pressing parts 105.

A pair of elastic pieces 106 (engaging part) which abut on a shoulder 103*a* of the attachment part 103 provided in the driver body 100 are provided substantially in the center of the inner surface of the staple pressing plate 92 in the vertical direction Z. The elastic pieces 106 are formed in a cantilever shape extending downward, and are elastically deformed in the right and left direction Y by setting a tip to a free end, and a fixed end to a base point. The protrusion 106*a* formed to protrude inward is provided in the tip of the elastic piece 106. With the configuration, when the driver body 100 is raised with respect to the staple pressing plate 92, the lower end of the elastic piece 106 engagingly abuts on the shoulder 103*a*, and the staple pressing plate 92 is raised together with the driver body 100. When the staple pressing plate 92 is raised to the highest point, the shoulder 103*a* presses and expands the elastic piece 106 outward, and passes over the elastic piece 106 so as to release the engagement therebetween, and then only the driver body 100 is raised.

Incidentally, when the driver body 100 is lowered with respect to the staple pressing plate 92 positioned at the bottom point, the attachment part 103 of the driver body 100 presses and expands the pair of elastic pieces 106 outward, and passes over the pair of elastic pieces 106, and then only the driver body 100 is lowered.

<Operational Example of Cutting Forming Mechanism 35>

Next, one example of the operation of the cutting forming mechanism 35 will be described with reference to the operation view of the cutting forming mechanism 35 in FIGS. 40A and 40B, and the operation view of the link 18 in FIGS. 42A to 42F.

FIGS. 40A and 40B are views obtained by observing the cutting forming mechanism 35 from the back surface side, and illustrate the state of an operating process of the cutting forming mechanism 35 through state A to state F. In order to give an easy description, FIGS. 40A and 40B illustrate only the cutting blade 101, the forming member 102, the staple pressing plate 92, and the link shaft 15. States A to F illustrated in FIGS. 42A to 42F indicate states (positions) of the link shaft 15 when the cutting forming mechanism is in state A to state F (F-1 and F-2). States A to C indicate states at the time of the depressing operation. States D to F indicate states at the time of returning. In addition, FIG. 39 is also referred about particular portions of components.

FIG. 40A illustrates a state A (standby), a state B (cut), a state C (form) which shows a bottom point of driving and a state D (staple leg picking), which are arranged from left to right in the drawing in this order. In the standby position (initial position) before the depressing operation of the operation handle 6, as illustrated by a state A (standby) of FIG. 40A, the nonmetal staple 2 of the top of the connection staple 3 is disposed on the receiving base 58 in a flat state before cutting. In addition, the pusher 61 (see FIG. 19) is biased in a direction (forward) of the receiving base 58 by the pusher returning spring 47. Thus, as illustrated in FIG. 42A, the tip of the guide arm 65 of the pusher 61 is positioned forward from the locking small convex part 67 provided in the guide part 66 of the stapler body 5. Accordingly, the tip of the pusher 61 as the pressing surface 63 is in a state of protruding into the staple pressing plate 92 (see FIGS. 26A and 26B). In addition, the nonmetal staple 2 cut and formed previously is mounted between a pair of cutting blades 36 (hereinafter, referred to as 36*a* and 36*b* when the cutting blade on the right side and the cutting blade on the left side are distinguished from each other) (see FIG. 22).

When an operator depresses the operation handle 6, the link shaft 15 is lowered by the depressing operation, and the driver body 100 and the link 18 are depressed. The link 18 is lowered while the shaft 25 is pressed rearward by the pressing protrusion 30. Further, as illustrated in FIG. 42B, when the upper edge of the guide hole 22 abuts on the guide protrusion 23, the link 18 stops lowering. At this time, when the tip of the guide arm 65 of the pusher 61 passes over the inclined surface 67*a* of the locking small convex part 67, and the pusher 61 is retreated, the pusher 61 can be separated from the staple pressing plate 92, and the staple pressing plate 92 can be lowered. At the time of lowering, the first regulation part 91 provided on the inner surface of the staple pressing plate 92 abuts on the connection staple 3. However, since the first regulation part 91 is formed to have such a protruding amount that can deform the both tips of the connection staple 3 slightly elastically and can pass therethrough, it is possible to prevent the damage of the both ends of the connection staple 3, for example.

By lowering the link shaft 15, both of the driver body 100 and the staple pressing plate 92 are lowered. When the staple pressing plate 92 reaches a bottom point by the lowering and stops lowering, only the driver body 100 connected with the link shaft 15 is lowered. As illustrated in state B (cut) of FIG. 40A, the connection part 3*a* of the connection staple 3 is cut (cutting operation) by the blade 101*a* of the cutting blade 101, and one nonmetal staple 2 is separated from the connection staple 3. Incidentally, for reference, a plan view of the cut connection staple 3 is additionally illustrated in state B. Since the connection part 3*a* is cut outward from the inside by the blade 101*a* inclined outward, the connection part 3*a* can be cut in a stable state. After the cutting, when the driver body 100 is further lowered, subsequently to the cutting operation, the tips (lower end) of the arms 102*a* of a pair of forming members 102 reach the nonmetal staple 2, and the arms 102*a* bend downward the staple legs 2*b* and 2*c* of the nonmetal staple 2 (a forming operation is started).

On the other hand, since the guide protrusion 23 regulates the lowering of the link 18, the link 18 moves rearward by the lowering of the link shaft 15. Thereafter, as illustrated in FIG. 42C, the rear extension part 18*b* abuts on the regulation protrusion 24, and the retreat of the link 18 is stopped. When the link shaft 15 is lowered further, the link 18 starts to rotate rearward (a counterclockwise rotation in the drawing) with the guide protrusion 23 used as a fulcrum, and by the guide of the third guide groove 28, a slide member 122 of the bending mechanism 38 starts to retreat (see FIG. 42D).

As illustrated in FIG. 42E, when the link shaft 15 is lowered to a bottom point, and the slide member 122 retreats at most, as illustrated in a state C (forming) of FIG. 40A, the driver body 100 reaches a bottom point in a state where the cut nonmetal staple 2 is completely formed. The staple legs 2*b* and 2*c* of the formed nonmetal staple 2 are held by the arms 102*a* of the forming members 102.

Next, by releasing the pressing of the operation handle 6, the operation handle 6 moves (returns) in a direction of returning to the initial position by a biasing force of the handle returning spring 45, and the link shaft 15 starts to be raised. In conjunction with such an operation, the link 18 rotates in a returning direction (a clockwise rotation in the drawing) with the guide protrusion 23 used as a fulcrum. Thus the slide member 122 moves (advances) in the returning direction, and the driver body 100 is raised. When the driver body 100 is raised, and the shoulder 103*a* of the attachment part 103 abuts on the elastic piece 106 of the staple pressing plate 92, the staple pressing plate 92 is raised together with the driver body 100. In such a raising process, in a state where the arms 102*a* hold the staple legs 2*b* and 2*c*, the staple legs 2*b* and 2*c* are inserted between the pair of staple pressing parts 105 of the staple pressing plate 92, and the staple tip can be picked (received and held). State D (staple leg picking) of FIG. 40A illustrates a state immediately after picking the staple tip. Since the staple tips of the staple legs 2*b* and 2*c* are slightly closed inward by the protrusions 102*b* of the forming members 102, it is possible to pick the staple tips easily by the staple pressing parts 105. However, since the taper surface 105*a* of the staple pressing part 105 guides the staple tip inward, as illustrated by a phantom line in the drawing of state D, the staple tip can be reliably picked although the staple leg 2*b*' is opened slightly outward.

Thus, it is possible to smoothly perform the delivery of the staple legs 2*b* and 2*c* from the forming members 102 to the staple pressing parts 105. In addition, merely by raising the staple pressing parts 105, the staple legs 2*b* and 2*c* can be held by the staple pressing parts 105. The elastically deformation of the staple legs 2*b* and 2*c* and the like is suppressed so that a load applied to the staple legs 2*b* and 2*c* can be reduced. Therefore, forming can be performed more stably.

FIG. 40B illustrates a state E (highest point 1 of staple pressing plate), a state F-1 (highest point 2 of staple pressing plate), a state F-2 (falling of staple pressing plate) and a state A' (staple extrusion), which are arranged from left to right in the drawing in this order. As illustrated in a state E (highest point 1 of staple pressing plate) of FIG. 40B, when the staple pressing plate 92 reaches the highest point, the staple pressing plate 92 stops rising. As illustrated in state E, the staple legs 2*b* and 2*c* of the nonmetal staple 2 come out from the arms 102*a*, but are held by the pair of staple pressing parts 105. When the link shaft 15 is raised subsequently, the shoulder 103*a* of the attachment part 103 presses and expands the pair of elastic pieces 106 outward. Thus, the pair of elastic pieces 106 are passed over, and the engagement therebetween is released. Accordingly, the driver body 100 is released from the staple pressing plate 92 and is released a lock state with the lower portion of the staple pressing plate 92. Thus, only the driver body 100 is raised (see state F-1 (highest point 2 of staple pressing plate) of FIG. 40B).

In a state where the engagement between the driver body 100 and the staple pressing plate 92 is released, the staple pressing plate 92 can be fallen freely in the regulation groove 29. Even in this case, as illustrated in a state F-2 (falling of staple pressing plate) of FIG. 40B, the staple legs 2*b* and 2*c* are caught by the tips of the staple pressing parts 105, and the release from the staple pressing parts 105 is prevented.

In a state where the slide member 122 is completely returned, the above-described link 18 stops rotating. However, as illustrated in FIG. 42F, since the guide arm 65 of the pusher 61 is engaged with the locking surface 67*b* of the locking small convex part 67 to be in a locked state, the advance of the pusher 61 is still regulated. By the subsequent rise of the link shaft 15, the link 18 and the driver body 100 are raised, and the driver body 100 raises the formed nonmetal staple 2 until the formed nonmetal staple 2 is received between the pair of cutting blades 36*a* and 36*b*. At that timing, the guide arm 65 is pressed upward by the lower edge of the second guide groove 27. Accordingly, the guide arm 65 is released from the locking small convex part 67, the pusher 61 is advanced by a biasing force of the pusher returning spring 47, and the nonmetal staple 2 is sent between the pair of cutting blades 36*a* and 36*b* by the pressing surface 63.

In addition, the flat connection staple 3 to be used next time is sent on the receiving base 58, and the cutting forming mechanism 35 returns to the standby state (state A' of FIG. 40B (staple extrusion)). The link 18, the link shaft 15, and the like also return to the initial position (see FIG. 42A).

Penetration Mechanism 37

As illustrated in FIGS. 39, 43, and 44, the above-described penetration mechanism 37 forms the through hole p1 (see FIG. 3) in the sheet P, and includes a pair of right and left cutting blades 36*a* and 36*b* which allow the staple legs 2*b* and 2*c* of the nonmetal staple 2 to penetrate the sheet P, and a crown pressing part 110 which suppresses the crown 2*a* of the nonmetal staple 2. The cutting blades 36*a* and 36*b* and the crown pressing part 110 are provided in the driver body 100, and move together with the driver body 100 in the vertical direction Z by the link shaft 15.

The pair of cutting blades 36*a* and 36*b* are attached on the lower side of the driver body 100 in parallel to the right and left direction Y with a predetermined interval that can contain and hold the nonmetal staple 2.

The pair of cutting blades 36*a* and 36*b* extend downward from the driver body 100, and V-shaped blades 111*a* and 111*b* which cut the sheet P are provided in the lower end thereof. The cutting blades 36*a* and 36*b* have a shape which is bent in a substantially crank shape (or inclined stepped shape) in front or rear view. The upper end (base end portion) attached in the driver body 100, and the blades 111*a* and 111*b* of the lower end are not in a straight line in the vertical direction Z, and the blades 111*a* and 111*b* on the lower end side are formed to be offset inward with respect to the upper end (base end portion).

More specifically, first penetrating parts 112*a* and 112*b* penetrating the sheet P initially are configured such that the interval of the pair of cutting blades 36*a* and 36*b* has the same as or slightly narrower than the inner width of the crown 2*a*, that is, the inner width of the pair of legs 2*b* and 2*c* in a range of a predetermined length from the tip side provided with the blades 111*a* and 111*b*. In an area from the upper side of the first penetrating parts 112*a* and 112*b* to the base end side, second penetrating parts 113*a* and 113*b* are configured to have the same as or slightly wider than the outer width of the crown 2*a*, that is, the outer width of the pair of legs 2*b* and 2*c*.

The stepped portions inclined between the first penetrating parts 112*a* and 112*b* and the second penetrating parts 113*a* and 113*b* are formed by performing bending in a substantially crank shape in a predetermined intermediate position of the boundary between the first penetrating parts 112*a* and 112*b* and the second penetrating parts 113*a* and 113*b*. In the stepped portion, the interval of the pair of cutting blades 36*a* and 36*b* is formed to be widened gradually from the first penetrating parts 112*a* and 112*b* toward the second penetrating parts 113*a* and 113*b*, so as to form hole expansion parts 114*a* and 114*b* which press and expand the through hole p1 formed by the first penetrating parts 112*a* and 112*b* outward.

The nonmetal staple 2 formed in a U shape can be held between the pair of second penetrating parts 113*a* and 113*b* disposed opposingly. In addition, the stepped portions in the boundary between the second penetrating parts 113*a* and 113*b* and the hole expansion parts 114*a* and 114*b* become the staple leg supporting parts 115*a* and 115*b* which support the staple legs 2*b* and 2*c* of the nonmetal staple 2 held by the second penetrating parts 113*a* and 113*b*.

In the cutting blades 36*a* and 36*b*, hole parts 116*a* and 116*b*, which first and second bending members 120*a* and 120*b* (see FIGS. 45A through 45C) as a pair of bending members of the bending mechanism 38 which bends inward the staple legs 2*b* and 2*c* penetrating the sheet P can enter and exit, are formed by penetrating the second penetrating parts 113*a* and 113*b* and the staple leg supporting parts 115*a* and 115*b*. Incidentally, as long as the first and second bending members 120*a* and 120*b* (see FIGS. 45A through 45C) can enter and exit, this application is not limited to the hole parts 116*a* and 116*b*, and may be a notched part in which a portion of the second penetrating parts 113*a* and 113*b* and the staple leg supporting parts 115*a* and 115*b* is notched.

A crown pressing part 110 is provided between the pair of cutting blades 36*a* and 36*b*. In addition, the crown pressing part 110 is configured to be movable to the driver body 100 in the vertical direction Z, and is attached in the driver body 100 in the state of being biased downward by the crown pressing spring 46.

In the stapler 1 of this embodiment, as described above, when the penetration mechanism 37 is lowered to a predetermined position, the bending mechanism 38 is operated to start to bend the staple legs 2*b* and 2*c*. In this regard, since the staple legs 2*b* and 2*c* are bent at a predetermined timing without being affected by a difference of the numbers (thickness) of the sheets P, the difference of the numbers (thickness) of the sheets P is absorbed by the movement of the crown pressing part 110 in the vertical direction Z, and the penetration mechanism 37 can be lowered to the predetermined position.

The penetration mechanism 37 includes a metal cutting blade guide 117 (see FIGS. 45A through 45C) which guides the cutting blades 36*a* and 36*b* penetrating the sheet P to the lower portion of the stapler body 5. As described above, in the cutting blades 36*a* and 36*b*, since the base end portion on the fixed side of the driver body 100 and the blades 111*a* and 111*b* of the tip are not in the same straight line in the vertical direction Z, when the blades 111*a* and 111*b* of the cutting blades 36*a* and 36*b* penetrate the sheet P, a force acts which allows the cutting blades 36*a* and 36*b* to flow inward (the cutting blades 36*a* and 36*b* to be inclined inward). Further, since the interval of the pair of hole expansion parts 114*a* and 114*b* is widened gradually, even when the hole expansion parts 114*a* and 114*b* press and expand the through hole p1 and pass therethrough, a force acts in a direction in which the cutting blades 36*a* and 36*b* flow inward (are inclined inward).

The cutting blade guide 117 is provided which prevents that the cutting blades 36*a* and 36*b* flow inward, and flow in the right and left direction. At the time of the penetrating operation, when the cutting blades 36*a* and 36*b* are lowered along the side surface of the cutting blade guide 117 having an inverted U shape, it is possible to prevent that the cutting blades 36*a* and 36*b* flow (are deformed) inward, and to smoothly perform the penetrating operation on the sheet P by the cutting blades 36*a* and 36*b*.

As illustrated in FIGS. 41A through 41D, the cutting blade guide 117 includes a first guide part 117*a*, and a second guide part 117*b* which has a lower formation height than the first guide part 117*a*. In addition, the upper edge corner portion on the front side (second guide part 107*b* side) of the first guide part 117*a* is chamfered in a forward descending tapered shape and a curvilinear shape to provide a chamfered portion 117*c*. Incidentally, in this embodiment, a front side of a plate member, which is formed in a U shape with the interval substantially the same as the interval of the first penetrating parts 112*a* and 112*b* interposed therebetween, is notched to form the stepped portion. The side which is not notched is set to the first guide part 117*a*, the lower side which is notched is set to the second guide part 117*b*, and the first and second guide parts 117*a* and 117*b* are formed integrally as one component. With the configuration, in the stapler 1, the number of the components can be reduced, and the configuration can be simplified. Therefore, the stapler 1 can be miniaturized, and the first and second guide parts 117*a* and 117*b* can be operated integrally.

Incidentally, this application is not limited to a shape in which the first guide part 117*a* and the second guide part 117*b* are configured as one the component as in the first embodiment of the configuration of the cutting blade guide 117. The first and second guide parts 117*a* and 117*b* may be formed separately. In addition, the first and second guide parts 117*a* and 117*b* formed separately may be configured to be operated synchronously. As long as a continuous surface is formed which can normally guide the inner surface in the vicinity of the blade edge according to a penetrating amount of the cutting blades 36*a* and 36*b*, the operation may be performed separately.

Since the first guide part 117*a* prevents that the sheet P is bent at the time of penetrating operation, the height of the top of the first guide part 117*a* is substantially the same as (flush with) the sheet base 7 on which the sheet P is placed or is slightly smaller than the sheet base 7. Accordingly, a load when the pair of cutting blades 36*a* and 36*b* penetrate the sheet P can be reduced, and the penetrating operation is performed smoothly to prevent that the through hole p1 is widened more than necessary. In addition, with such a formation height, at a timing when the cutting blades 36*a* and 36*b* penetrate the sheet P, and the inner surface in the vicinity of the blade edge protrudes from the sheet P, immediately, the inner surface in the vicinity of the blade edge can be guided by the first guide part 117*a*, and an effect of preventing the cutting blades 36*a* and 36*b* from flowing in the inner direction and in the right and left direction can be further improved.

On the other hand, when the pair of staple legs 2*b* and 2*c* of the nonmetal staple 2 penetrate the sheet P together with the cutting blades 36*a* and 36*b*, the second guide part 117*b* has such a height that can guide the tips of the cutting blades 36*a* and 36*b*, and has such a height that the bending mechanism 38 performs the bending operation by using a space between the second guide part 117*b* and the stapler body 5. More preferably, the second guide part 117*b* has such a height that is lower than the position of the tips of the staple legs 2*b* and 2*c* when the cutting blades 36*a* and 36*b* are lowered to the lowest end, or such a height that the hole parts 116*a* and 116 which the first and second bending members 120*a* and 120*b* of the bending mechanism 38 enter and exit are not blocked. However, in a shape in which the staple legs 2*b* and 2*c* start to be bent before the cutting blades 36*a* and 36*b* reaches the lowest end, the second guide part 117*b* may be formed to be slightly higher than the position of the tips of the staple legs 2*b* and 2*c* before bending.

The cutting blade guide 117 is provided in the slide member 122 (to be described later) of the bending mechanism 38. In conjunction with the reciprocating operation of the slide member 122, the first guide part 117*a* and the second guide part 117*b* are switched according to the length of the cutting blades 36*a* and 36*b* penetrating the sheet P and are disposed between the cutting blades 36*a* and 36*b*. When the through hole p1 is formed by the cutting blades 36*a* and 36*b* (when the penetrating length is relatively short), the first guide part 117*a* is disposed between the pair of cutting blades 36*a* and 36*b* to guide the tip (at least a portion of the blades 111*a* and 111*b*, more preferably, a portion also including the first penetrating parts 112*a* and 112*b*) of the cutting blades 36*a* and 36*b*.

On the other hand, the pair of cutting blades 36*a* and 36*b* are further lowered to deeply penetrate the sheet P (the penetrating length is relatively long), and the pair of staple legs 2*b* and 2*c* of the nonmetal staple 2 penetrate the sheet P. When the staple legs 2*b* and 2*c* penetrating the sheet P are bent by the bending mechanism 38, the first guide part 117*a* is retracted from between the pair of cutting blades 36*a* and 36*b*, and the second guide part 117*b* is positioned to be lower than the first guide part 117*a*. The second guide part 117*b* guides the tips of the cutting blades 36*a* and 36*b* to suppress a fluctuation of the cutting blade 6*b* in the right and left direction Y or an inward deformation, and to prevent that the bending operation of the staple legs 2*b* and 2*c* is disturbed by the first and second bending members 120*a* and 120*b*. The cutting blades 36*a* and 36*b* are formed with the continuous surface which can normally guide the inner surface in the vicinity of the blade edge according to the penetrating amount of the cutting blades 36*a* and 36*b* at the time of penetrating the sheet P and at the time of bending the nonmetal staple 2. Thus, the cutting blades 36*a* and 36*b* can reliably move relatively between the first guide part 117*a* and the second guide part 117*b*.

In this embodiment, in the upper edge of the second guide part 117*b*, the rear side is set to be horizontal, but the front side is inclined in a forward descending direction while the height becomes gradually lower. In other words, the front side is inclined along a passage in which the tip (the vicinity of the blade edge) relatively passes through the side surface of the second guide part 117*b* when the pair of cutting blades 36*a* and 36*b* are lowered as the slide member 122 retreats. With the inclination, even in a case where the pair of cutting blades 36*a* and 36*b* are lowered to the lowest end, it can be suppressed that the hole parts 116*a* and 116*b* are blocked by both wall surfaces of the second guide part 117*b* while the tips of the pair of cutting blades 36*a* and 36*b* are reliably guided. For this reason, it is possible to smoothly allow the first and second bending members 120*a* and 120*b* to enter and exit the hole parts 116*a* and 116*b*.

<Operational Example of Penetration Mechanism 37>

Next, an example of the operation of the penetration mechanism 37 will be described with reference to the explanation view of the driver body of FIGS. 43A through 43E and 44A through 44C, the operation view of the penetration mechanism 37 of FIGS. 40A and 40B, and the operation view of the cutting blade guide 117 of FIGS. 41A through 41D.

In the state of the standby position before the penetrating operation (see state A of FIG. 40A), as illustrated in FIGS. 43B and 43E, the U-shaped nonmetal staple 2 sent by the cutting forming mechanism 35 is held between the pair of cutting blades 36*a* and 36*b*. At this time, the crown 2*a* is pressed by the crown pressing part 110, and the staple legs 2*b* and 2*c* are supported by the staple leg supporting parts 115*a* and 115*b*.

When the link shaft 15 is lowered by the depressing operation of the operation handle 6, the driver body 100 provided with the penetration mechanism 37 is lowered (see FIG. 41A). Further, when the cutting blades 36*a* and 36*b* reach the sheet P placed on the sheet base 7, the through hole p1 is formed in the sheet P by the blades 111*a* and 111*b* (see a dotted line portion of state B of FIG. 40A), and, first, the first penetrating parts 112*a* and 112*b* penetrate through the through hole p1. At that time, by disposing the first guide part 117*a* of the cutting blade guide 117 between the cutting blades 36*a* and 36*b*, an inward inclination of the first penetrating parts 112*a* and 112*b* is prevented to enable smooth penetration.

When the penetration mechanism 37 is further lowered, the hole expansion parts 114*a* and 114*b* penetrate the sheet P while expanding the through hole p1 outward. Further, when the penetration mechanism 37 is further lowered, the second penetrating parts 113*a* and 113*b* penetrate through the through hole p1, and the pair of staple legs 2*b* and 2*c* of the nonmetal staple 2 held on the inside of the second penetrating parts 113*a* and 113*b* penetrate through the through hole p1 (see FIG. 41B).

When the crown 2*a* reaches the sheet P (see state C of FIG. 40A), the crown pressing part 110 presses the crown 2*a* to the sheet P, so that the crown 2*a* and the sheet P can be in close contact with each other. In addition, even in a case where the number of the sheets P is large, as illustrated in respective diagrams of FIGS. 44A through 44C, in a state where the crown pressing part 110 presses the crown 2*a* to the sheet P and stops, only the driver body 100 is lowered while the crown pressing spring 46 is compressed. For this reason, the cutting blades 36*a* and 36*b* can be lowered to the predetermined position without being affected by the number of the sheets P. For this reason, the subsequent bending operation of the staple legs 2*b* and 2*c* by the bending mechanism 38 can be performed smoothly at the predetermined timing.

As illustrated in FIG. 41C, at the timing of the bending operation, in conjunction with the retreat of the slide member 122, the cutting blade guide 117 is retreated, and the second guide part 117*b* is disposed between the cutting blades 36*a* and 36*b*. For this reason, the bending operation of the staple legs 2*b* and 2*c* by the bending mechanism 38 can be performed smoothly. Incidentally, a force of acting on the cutting blades 36*a* and 36*b* coincides with the force acting on the second penetrating parts 113*a* and 113*b*, and a force of being inclined inward hardly acts on the cutting blades 36*a* and 36*b*. For this reason, at the timing when the second penetrating parts 113*a* and 113*b* penetrate through the through hole p1, the deformation can be suppressed although the cutting blades 36*a* and 36*b* are not guided. However, in this embodiment, also at the timing when the second penetrating parts 113*a* and 113*b* penetrate the sheet P, the tips of the cutting blades 36*a* and 36*b* are guided by the second guide part 117*b*. Therefore, the inward deformation of the cutting blades 36*a* and 36*b* is prevented, and it is suppressed that the cutting blades 36*a* and 36*b* are fluctuated in the right and left direction Y when the pair of bending members 120*a* and 120*b* enter and exit the hole parts 116*a* and 116*b* of the cutting blades 36*a* and 36*b* at the time of the bending operation. Thus, the penetrating operation and the subsequent bending operation can be performed more smoothly.

As illustrated in FIG. 41D, after the sheet P is bound, the movement of the slide member 122 and the cutting blade guide 117 is stopped. Thereafter, when the pressure of the operation handle 6 is released, the driver body 100 is raised together with the link shaft 15. Then, the cutting blades 36*a* and 36*b* come out from the through hole p1, and the penetration mechanism 37 returns to the state of the standby position. Along with this, the slide member 122 is operated to return (advance) to a root position, and the first guide part 117*a* moves to a space between the cutting blades 36*a* and 36*b*. In this embodiment, the chamfered portion 117*c* is provided on the front side of the first guide part 117*a*. The first guide part 117*a* returns while the staple legs 2*b* and 2*c* overlapped on the lower side of the sheet P is scooped upward by the chamfered portion 117*c*.

For this reason, the returning operation of the first guide part 117*a* on the lower side of the staple legs 2*b* and 2*c* can be performed more smoothly, and the turn-up of the staple legs 2*b* and 2*c* can be suppressed.

Bending Mechanism 38

As illustrated in FIGS. 45 to 48, the above-described bending mechanism 38 includes a first bending member 120*a* which bends one staple leg (in this embodiment, the staple leg on the right side) 2*b* of the nonmetal staple 2 penetrating the sheet P, a second bending member 120*b* which bends the other leg (in this embodiment, the staple leg on the left side) 2*c*, a sticking member 121 which sticks the one staple leg 2*b* and the other staple leg 2*c*, the slide member 122 which is a driving member driving the first and second bending members 120*a* and 120*b* and the sticking member 121 in a determined order (sequence), and a pair of guide surfaces 123*a* and 123*b* (see FIGS. 47 and 50A) which are provided in the stapler body 5, and formed from the inclined surface guiding the first and second bending members 120*a* and 120*b* in a bending direction.

The first and second bending members 120*a* and 120*b* include bending protrusions 124*a* and 124*b* which bend inward the staple legs 2*b* and 2*c* formed to protrude toward the upper side, first and second inclined surfaces 125*a* and 125*b* which are engaged with the pair of guide surfaces 123*a* and 123*b* of the stapler body 5, and first and second operating stepped portions 126*a* and 126*b* in which the slide member 122 is engaged. In the first bending member 120*a* and the second bending member 120*b*, a movement in the vertical direction Z and the right and left direction Y is controlled by the advance and retreat operation of the slide member 122 in the front and rear direction X.

According to the movement in the vertical direction Z and the right and left direction Y, the first and second inclined surfaces 125*a* and 125*b* are guided along the pair of guide surfaces 123*a* and 123*b*. The first and second bending members 120*a* and 120*b* move while expanding and shortening (approaching and separating) the interval therebetween in an oblique direction. Accordingly, the first and second bending protrusions 124*a* and 124*b* enter and exit the hole parts 116*a* and 116*b* of the pair of cutting blades 36*a* and 36*b* penetrating the sheet P.

The first bending member 120*a* and the second bending member 120*b* are integrally connected by a connection spring 127 having a U shape in plan view, and configure a bending unit 128 having a Q shape in plan view. In this embodiment, the first and second bending members 120*a* and 120*b* and the connection spring 127 are integrally formed of resin to form the bending unit 128, and the bending unit 128 is attached in the inner surface of the stapler body 5 in a state where the connection spring 127 is compressed. For this reason, a shape stability or a flexibility is excellent, and a containability of the bending unit 128 in the stapler body 5 is improved, and the first and second bending members 120*a* and 12*b* can move freely in the vertical and right and left directions.

The connection spring 127 biases the first and second bending members 120*a* and 120*b* to move outward, that is, biases the first and second bending members 120*a* and 120*b* in a depressing direction (returning direction). Accordingly, when the first and second bending members 120*a* and 120*b* are depressed by the returning operation of the slide member 122 to return to the initial position, a restoring force of the connection spring 127 can assist the returning operation. Thus, the returning operation can be smoothly performed without being caught, for example, and the operability at the time of the returning operation can be improved. Incidentally, contrary to the above description, the connection spring 127 may bias the first and second bending members 120*a* and 120*b* to move inward, that is, bias the first and second bending members 120*a* and 120*b* in a pressing-up direction. The operability at the time of the bending operation can be improved.

When the bending unit 128 is attached in the stapler body 5, as illustrated in FIG. 47, an attachment protrusion 129 protruding to the connection spring 127 is engaged into the hole part 130 provided on the front side of the stapler body 5, and the attachment protrusions 131*a* and 131*b* (see FIGS. 45A through 45C) respectively protruding to the first and second bending members 120*a* and 120*b* are engaged with the long holes 132*a* and 132*b* provided in a recess shape in correspondence to the inclination of the guide surfaces 123*a* and 123*b* with respect to the stapler body 5. Accordingly, the accidental removal and the like of the bending unit 128 from the stapler body 5 is prevented, and the first and second bending members 120*a* and 120*b* can move in the vertical and right and left direction (oblique direction).

Incidentally, the connection spring 127 is not limited to a U shape in plan view. As long as the connection spring can bias the first bending member 120*a* and the second bending member 120*b* in a depressing direction (or the pressing-up direction), the connection spring 127 may has a V shape, a W shape, an I shape, or the like in plan view.

As illustrated in FIG. 50A and the like, the pair of guide surfaces 123*a* and 123*b* guiding the first and second bending members 120*a* and 120*b* are configured to have the lower end positioned to the most outside in the right and left direction Y, and to be a surface inclined gradually inward toward the upper end. In other words, the pair of guide surfaces 123*a* and 123*b* are formed in a trapezoidal shape in front view. Incidentally, the guide surfaces 123*a* and 123*b* are not necessarily limited to a continuous surface, and may be configured by a plurality of separate surfaces.

In this embodiment, an inclination angle (an inclination angle with respect to the horizontal direction) of each of the guide surfaces 123*a* and 123*b* is about 45°. The application is not limited thereto, and may be adjusted appropriately, for example, according to the movable range and the operation timing of the first and second bending members 120*a* and 120*b* or the slide member 122.

When the inclination angle is set to about 45° as in this embodiment, a movement distance of the slide member 122 in narrow space in the stapler body 5 can be shortened as much as possible, and the first and second bending members 120*a* and 120*b* can be pressed upward efficiently. In addition, when the cutting blades 36*a* and 36*b* are lowered while expanding the through hole p1 of the sheet P outward, the edge of the through hole p1 may protrude to hang down to be bent to the lower side. Even in this case, when the guide surface is set to about 45°, the interference between the hung-down edge and the first and second bending protrusions 124*a* and 124*b* is avoided, and the first and second bending members 120*a* and 120*b* can be vertically moved smoothly in an oblique direction. Therefore, it is possible to improve the workability of the first and second bending members 120*a* and 120*b*, and to improve the operability of the stapler 1 or to make the stapler 1 compact.

The sticking member 121 (see FIGS. 45A through 45C) is pivotally supported such that one end side (front end side) is vertically rotatable in the stapler body 5 through the spindle 133 (see FIGS. 48 and 51, and the like) extending in the right and left direction Y. A pressing part 134 which presses and sticks one staple leg 2*b* and the other staple leg 2*c* of the nonmetal staple 2 from below is provided in the other end (rear end) of the sticking member 121. When the sticking member 121 is vertically rotated with the spindle 133 used as a fulcrum, the pressing part 134 moves in the vertical direction Z.

When the slide member 122 (see FIGS. 45A through 45C) is operated to slidingly move with respect to the stapler body 5 in the front and rear direction X, the first and second bending members 120*a* and 120*b* and the sticking member 121 are appropriately pressed upward or depressed to be moved vertically. As illustrated in FIG. 11, the slide member 122 is attached in the stapler body 5 in a slidable state in the front and rear direction X. The slide member 122 is biased normally forward (returning direction) by the slider returning spring 48. The above-described shaft 26 (slider driving shaft, see FIG. 9) is provided on the rear side of the slide member 122. When the shaft 26 is inserted into the third guide groove 28 of the above-described link 18 (see FIGS. 42A and 48 and the like), the slide member 122 and the link 18 are connected. Thus, the slide member 122 and the operation handle 6 are connected through the link 18, and the slide member 122 can be operated in conjunction with the operation of the operation handle 6.

The link 18 converts a reciprocating operation of the operation handle 6 in the vertical direction Z into a reciprocating operation of the slide member 122 in the front and rear direction X. The slide member 122 is operated to reciprocate in the front and rear direction X basically in conjunction with the rotating operation of the link 18 (see FIG. 42E and the like). Further, when the third guide groove 28 is formed to be long in the vertical direction Z, the engagement between the shaft 26 and the third guide groove 28 is held, and only the link 18 and the operation handle 6 are allowed to move in the vertical direction Z.

In other words, the operation handle 6 and the slide member 122 are operated basically conjunctionally through the link 18. However, the operation handle 6 and the slide member 122 are also configured such that a predetermined operation of only one side is allowed to be performed, and further, a connected state of not being separated to each other is held.

As illustrated in FIG. 45C, the above-described cutting blade guide 117 is attached in the slide member 122, and can be operated to reciprocate integrally with the slide member 122 in the front and rear direction X. When the slide member 122 retreats, and the first and second bending members 120*a* and 120*b* enter and exit the hole parts 116*a* and 116*b* of the pair of cutting blades 36*a* and 36*b*, the cutting blade guide 117 also moves rearward together with the slide member 122, the first guide part 117*a* retracts from between the cutting blades 36*a* and 36*b*, and the second guide part 117*b* is disposed. For this reason, it is possible to prevent the interference between the cutting blade guide 117 and the first and second bending members 120*a* and 120*b* at the time of the bending operation.

The first and second side walls 135*a* and 135*b* which control the movement of the first and second bending members 120*a* and 120*b* in the vertical direction Z and the right and left direction Y are provided on the both sides of the slide member 122 in the right and left direction Y. The first and second operating stepped portions 126*a* and 126*b* of the first and second bending members 120*a* and 120*b* are engaged with the first and second side walls 135*a* and 135*b*, respectively.

As illustrated in FIG. 46, in order from the rear side (the upper side in the drawing) to the front side (the lower side in the drawing), the first and second side walls 135*a* and 135*b* include first and second standby parts 136*a* and 136*b* which hold the first and second bending members 120*a* and 120*b* in the standby position (initial position) without pressing upward, a first and second operating parts 137*a* and 137*b* which guide inward the first and second bending members 120*a* and 120*b* with pressing upward, and first and second hold parts 138*a* and 138*b* which hold the first and second bending members 120*a* and 120*b* in a predetermined pressing-upward state not to be pressed upward beyond a predetermined extent.

The first and second standby parts 136*a* and 136*b* are formed in such a height that the first and second bending members 120*a* and 120*b* are not pressed upward. As illustrated in FIGS. 45, 50A, 50B, and the like, the first and second operating parts 137*a* and 137*b* are formed by the inclined surface which is gradually higher forward. Further, as illustrated in FIG. 46, the first and second operating parts 137*a* and 137*b* are formed to be positioned gradually inward toward the front side, and are configured such that the interval therebetween is gradually narrower forward. The first and second hold parts 138*a* and 138*b* are formed horizontally along the extending direction of the slide member 122 continuously with the first and second operating parts 137*a* and 137*b*.

In this embodiment, first, the first bending member 120*a* is operated to bend one staple leg 2*b* on the right side. Next, the second bending member 120*b* is operated with a predetermined phase difference interposed therebetween to bend the other staple leg 2*c* on the left side. For this purpose, in the front and rear direction X, a starting position of the first operating part 137*a* is provided on the rear side from the position of the second operating part 137*b*. With this configuration, when the slide member 122 retreats, first, the first operating part 137*a* presses upward the first bending member 120*a* through a first operating stepped portion 126*a*, and guides the first bending member 120*a* inward (a direction to make a first bending protrusion 124*a* protrude from one hole part 116*a*). Thereafter, the second operating part 137*b* presses upward the second bending member 120*b* through the second operating stepped portion 126*b*, and guides the second bending member 120*b* inward (a direction to make the second bending protrusion 124*b* protrude from the other hole part 116*b*).

On the other hand, as illustrated in FIGS. 45 and 48, an operation shaft 139 extending in the right and left direction Y is provided in the front end of the slide member 122, and the operation shaft 139 is engaged to a cam groove 140 provided in the wall surface of the sticking member 121. The cam groove 140 and the operation shaft 139 are examples of the driving mechanism of the sticking member 121, and converts the movement of the slide member 122 in the front and rear direction X into the rotating operation of the sticking member 121 in the vertical direction Z.

The cam groove 140 is configured by a standby groove 141 which holds the sticking member 121 at the standby position (initial position) with respect to the movement of the slide member 122 in the front and rear direction X without rotating, a rotation groove 142 which rotates the sticking member 121, and a holding groove 143 which holds the sticking member 121 in a predetermined rotating state.

The standby groove 141 is inclined with respect to the extending direction of the sticking member 121 as illustrated in the respective drawings of FIGS. 51A through 51C, and is configured to be horizontal in a state where the sticking member 121 is at the standby position and the pressing part 134 is positioned at a bottom point. The rotation groove 142 is configured by a groove inclined in a direction symmetrical to the standby groove 141, and the holding groove 143 is configured by a groove extending along the extending direction of the sticking member 121.

As described above, with the configuration of the cam groove 140 and the operation shaft 139, the slide member 122 moves rearward, and the operation shaft 139 passes through the standby groove 141 at the timing when the first and second bending members 120*a* and 120*b* bend the staple legs 2*b* and 2*c*. Therefore, the sticking member 121 enters the standby state without rotating. When the operation shaft 139 passes through the rotation groove 142 at the timing when the staple legs 2*b* and 2*c* are completely bent by the first and second bending members 120*a* and 120*b*, the sticking member 121 rotates to raise the pressing part 134, and to press and stick the staple legs 2*b* and 2*c*. Thereafter, when the operation shaft 139 passes through the holding groove 143, the sticking member 121 stops rotating, and the pressing part 134 is held in the raised state.

<Operational Example of Bending Mechanism 38>

Next, an exemplary operation of the bending mechanism 38 will be described with reference to the operation views of the respective members of the bending mechanism of FIGS. 49A to 51C.

The first and second bending members 120*a* and 120*b* are positioned at the bottom point when the operation handle 6 of FIG. 51A is at the standby position (initial position) before the depressing operation (FIG. 50A). When the operation shaft 139 of the slide member 122 is positioned in the standby groove 141 of the sticking member 121, the pressing part 134 is positioned at the bottom point (see FIG. 49A).

The penetration mechanism 37 operates when the operation handle 6 is operated to be depressed, the link 18 starts to rotate at the timing when the first penetration parts 112*a* and 112*b* of the cutting blade 36*a* and 36*b* penetrate the sheet P (see FIGS. 42D and 42E). When the shaft 26 is guided by the third guide groove 28, the slide member 122 starts to move (retract) rearward, and the bending mechanism 38 is operated. First, the upper end of the first operation part 137*a* presses the first operation step part 126*a* upward to be guided to one guide surface 123*a*, and the first bending member 120*a* is raised in an oblique direction. Accordingly, the first bending protrusion 124*a* protrudes inside the pair of cutting blades 36*a* and 36*b* from one hole part 116*a*, and one staple leg 2*b* is bent. Next, when the upper end of the second operation part 137*b* presses upward the second operation step part 126*b* with a predetermined phase difference interposed therebetween, the second bending member 120*b* is raised in an oblique direction while being guided by the other guide surface 123*b*. Accordingly, the second bending protrusion 124*b* protrudes from the other hole part 116*b* into the pair of cutting blades 36*a* and 36*b*, and the other staple leg 2*c* is bent (see FIG. 50B).

Incidentally, the other staple leg 2*c* may be configured to start to be bent by the second bending member 120*b* in a state where the staple leg 2*b* is completely bent. In this embodiment, the other staple leg 2*c* may start to be bent by the second bending member 120*b* at the timing (at the phase difference interposed therebetween) when the first bending member 120*a* slightly bends the staple leg 2*b* inward. Even in this case, the staple leg 2*b* and the other staple leg 2*c* can be bent without any interference, and a moving distance (stroke) of the slide member 122 necessary for bending the pair of staple legs 2*b* and 2*c* can be further shortened.

The first and second bending members 120*a* and 120*b* are raised in the oblique direction by the operations of the slide member 122 and the guide surfaces 123*a* and 123*b*, and the staple legs 2*b* and 2*c* are bent from a direction substantially perpendicular to the staple legs 2*b* and 2*c*, so that it is possible to suppress the staple legs 2*b* and 2*c* from escaping in the front and rear direction X even without preventing the escape. Therefore, the staple legs 2*b* and 2*c* can be smoothly bent, and the bending of the crease of the staple legs 2*b* and 2*b* can also be suppressed, so that the visual quality and the binding function can also be improved.

Incidentally, when the staple legs 2*b* and 2*b* are bent, the slide member 122 is retracted. Then, the first guide part 117*a* of the cutting blade guide 117 is retracted rearward from between the pair of cutting blades 36*a* and 36*b*, and the second guide part 117*b* is disposed (see FIGS. 41C and 49B). For this reason, the bending operation can be performed using a space between the stapler body 5 and the second guide part 117*b*, and the first and second bending members 120*a* and 120*b* can pass through the hole parts 116*a* and 116*b* without any interference with the cutting blade guide 117. In addition, the operation shaft 139 is positioned in the standby groove 141 while the first and second bending members 120*a* and 120*b* perform the operation, so that the sticking member 121 is held in the standby state without operating.

In this embodiment, the ending side (front side) of the first operation part 137*b* with respect to the first bending member 120*a* is formed slightly low to lower the first bending member 120*a* as illustrated in FIG. 50D from the state illustrated in FIG. 50C, when the bending of the staple leg 2*b* is completed. With the configuration, it is possible to suppress the interference between the first bending member 120*a* and the other staple leg 2*c* on the other side. Particularly, this configuration is effective to a case where the nonmetal staple includes long staple legs 2*b* and 2*c*, and a case where the thickness of the sheet P is thin and the staple legs 2*b* and 2*c* protruding from the sheet P become long. For this reason, it is possible to provide the staple 1 which can smoothly bend the staple legs 2*b* and 2*c* without being affected from a change in the type of the using nonmetal staple 2 and the thickness of the sheet P, for example.

When the pair of staple legs 2*b* and 2*c* are completely bent, the first and second operation step parts 126*a* and 126*b* of the first and second bending members 120*a* and 120*b* are positioned in the first and second holding parts 138*a* and 138*b*, so that the first and second bending members 120*a* and 120*b* stop rising. At that timing, the operation shaft 139 passes through the rotation groove 142. Therefore, the sticking member 121 rotates about the spindle 133, the pressing part 134 is raised to press and stick the staple leg 2*b* and the other staple leg 2*c* (see FIGS. 49C, 50C, and 51C). Also at this time, since the second guide part 117*b* of the cutting blade guide 117 is positioned between the pair of cutting blades 36*a* and 36*b*, the operation of the sticking member 121 does not affect the cutting blade guide 117. When the staple legs 2*b* and 2*c* are completely stuck, the operation shaft 139 passes through the holding groove 143, so that the sticking member 121 stops rotating (FIG. 51C). Thereafter, the slide member 122 also stops retreating (FIG. 49C).

Further, when the depressing operation of the operation handle 6 is released, the operation handle 6 is pressed upward by a restoring force of the handle returning spring 45, and the link 18 rotates in the returning direction and is guided to the third guide groove 28, so that the slide member 122 moves in the returning direction (forward). In this manner, the slide member 122 can be forcibly returned by the link 18, and in this embodiment, the slider returning spring 48 is further provided. The movement of the slide member 122 in the returning direction is assisted by a biasing force of the slider returning spring 48, and the returning operation can be more smoothly performed.

The operation shaft 139 passes through the rotation groove 142 and returns to the standby groove 141 as the slide member 122 returns, and thus the pressing part 134 is lowered to return to the standby position. In addition, the slide member 122 moves while pressing the first and second bending members 120*a* and 120*b* outward by the outer wall surface of the first and second operation parts 137*a* and 137*b*, so that the first and second bending members 120*a* and 120*b* are forcibly moved in a direction of separating from each other in the depressing direction and the right and left direction Y. In addition, the first and second bending members 120*a* and 120*b* can be smoothly depressed and separated in cooperation with a biasing force of the connection spring 127 so as to be returned to the initial position. In this manner, the respective parts of the bending mechanism 38 can be returned to the initial positions by the link 18 in conjunction with the returning operation of the operation handle 6.

The bending mechanism 38 can be thoroughly operated by the above-described link 18 at a predetermined timing in conjunction with the penetration mechanism 37 which is directly driven by the operation handle 6, and the returning operation can also be performed in conjunction. In a case where there is no such a thorough conjunction relation, the slide member 122 and the penetration mechanism 37 are independently returned. For this reason, for example, the penetration mechanism 37 can be returned alone even when the slide member 122 is not returned due to paper jamming or failure in the operation of the slider returning spring 48. For this reason, in a case where the operator keeps binding work without knowing the defect of the bending mechanism 38, the durability of the components and the operability of the stapler 1 may be affected.

With this regard, since the operation and the returning operation of each mechanism are performed in conjunction with the link 18 in this embodiment, the other mechanism and the operation handle 6 also stop their operation and the returning operation in a case where there occurs an operation failure or a returning failure in any one of the operation handle 6, the cutting forming mechanism 35, the penetration mechanism 37, and the bending mechanism 38. For this reason, the operator can easily grasp that there is an operation failure in some mechanism, and quickly take an action when the operation handle 6 is not completely returned to the initial position. In addition, since it is prevented that the operator keeps operating without knowing an operation failure, the components are prevented from being stuck, so that the durability of the stapler 1 can be improved.

Next, a modification of the bending mechanism will be described with reference to FIGS. 52A through 52C. In the embodiment, the first and second bending members 120*a* and 120*b* are biased in the returning direction (depressing direction) by the elastic force of the connection spring 127 which connects the first and second bending members 120*a* and 120*b*. With this regard, in the modification of FIGS. 52A to 52C, the first and second bending members 120*a* and 120*b*, which are individually formed, are biased by the coil spring in the pressing-up direction or the depressing direction.

In the modification illustrated in FIG. 52A, the first bending member 120*a* is biased in the pressing-up direction by the screw coil spring 146 disposed between a protrusion 145 provided in the first bending member 120*a* and a protrusion 145 provided in the side surface of the staple body 5. In addition, the second bending member 120*b* is biased in the pressing-up direction by a compression coil spring 147 disposed between the lower end of the second bending member 120*b* and the bottom surface of the stapler body 5. Incidentally, the first bending member 120*a* may be biased by the compression coil spring 147, and the second bending member 120*b* may be biased by the screw coil spring 146. Alternatively, both of the first and second bending members 120*a* and 120*b* may be biased by the screw coil spring 146 or the compression coil spring 147.

In the modification illustrated in FIG. 52B, the first bending member 120*a* is biased in the returning direction by the screw coil spring 149 disposed between the protrusion 145 provided in the first bending member 120*a* and the protrusion 145 provided in the ceiling surface of the stapler body 5. In addition, the second bending member 120*b* is biased in the returning direction by a tension coil spring 150 disposed between a spring attaching part 148 provided in the second bending member 120*b* and a spring attaching part 148 provided in the stapler body 5. Incidentally, the first bending member 120*a* may be biased by the tension coil spring 150, and the second bending member 120*b* may be biased by the screw coil spring 149. Alternatively, both of the first and second bending members 120*a* and 120*b* may be biased by the screw coil spring 149 or the tension coil spring 150.

In the modification illustrated in FIG. 52C, the compression coil spring 151 is disposed between the spring attaching part 148 provided in the first bending member 120*a* and the spring attaching part 148 provided in the second bending member 120*b* to bias the first and second bending members 120*a* and 120*b* in the returning direction. Incidentally, the tension coil spring 150 may be disposed in place of the compression coil spring 151 to bias the first and second bending members 120*a* and 120*b* in the pressing-up direction.

As described in the respective modifications of FIGS. 52B and 52C, it is possible to improve the operability at the time of depressing the first and second bending members 120*a* and 120*b* by biasing the first and second bending members 120*a* and 120*b* in the returning direction. In addition, as described in the modification of FIG. 52A, it is possible to improve the operability at the time of pressing upward the first and second bending members 120*a* and 120*b* by biasing the first and second bending members 120*a* and 120*b* in the pressing-up direction.

Incidentally, the mechanism for biasing the first and second bending members 120*a* and 120*b* is not limited to the embodiments and the modifications, and other types of springs such as a plate spring and a spiral spring may be used, or a biasing mechanism other than the spring may be used. In addition, since the first and second bending members 120*a* and 120*b* can be sufficiently controlled to move up and down using the operation part of the slide member 122, the biasing mechanism may be not necessarily provided.

In addition, the description has been made such that the first and second operation parts 137*a* and 137*b* of the slide member 122 are configured to be gradually narrow. However, the first and second bending members 120*a* and 120*b* may forcibly move only in the vertical direction Z by the slide member 122, and move in the right and left direction Y by the biasing mechanism such as a spring. In addition, the first and second bending members 120*a* and 120*b* may forcibly move in the right and left direction Y by the slide member 122, and move in the vertical direction Z by the biasing mechanism.

Even in either case, the first and second bending members 120*a* and 120*b* can be smoothly driven in cooperation with the guiding function of the pair of guide surfaces 123*a* and 123*b*.

Forming structure and operational effect of nonmetal staple 2 of forming mechanism and staple pressing mechanism (Configuration 1) As described above, the stapler 1 of the embodiment includes the forming mechanism (forming member 102) which forms a flat nonmetal staple to be bent in a U shape, and the staple pressing mechanism (staple pressing plate 92) which holds the staple legs 2*b* and 2*c* of the nonmetal staple 2 formed in a U shape.

The nonmetal staple 2 formed in a U shape is transferred between the forming mechanism and the staple pressing mechanism.

The forming mechanism and the staple pressing mechanism are provided to be relatively movable along a direction of bending the nonmetal staple 2 in a U shape with respect to the nonmetal staple 2, and the forming mechanism and the staple pressing mechanism are relatively movable to each other.

The forming mechanism is configured to relatively move with respect to the nonmetal staple 2 and the staple pressing mechanism so as to bend the nonmetal staple 2 in the moving direction.

When the forming mechanism bends the nonmetal staple 2 in a U shape, the staple pressing mechanism is configured to retract to a position of not contacting the bent staple legs 2*b* and 2*c*, and when the nonmetal staple 2 bent in a U shape is received, the staple pressing mechanism is configured to move relatively toward the nonmetal staple 2 to hold the staple legs 2*b* and 2*c* of the nonmetal staple 2 formed in a U shape.

(Operational effect 1) With the configuration, the nonmetal staple 2 is formed in a U shape when the forming mechanism relatively moves along the direction of forming the nonmetal staple 2 in a U shape. At this time, since the staple pressing mechanism retracts to a position of not contacting the staple legs 2*b* and 2*c*, it is possible to reduce a load on the staple legs 2*b* and 2*c* when being formed in a U shape. After forming, the staple pressing mechanism relatively moves in a direction of the nonmetal staple 2, so that it is possible to hold the staple legs 2*b* and 2*c*. In this manner, the nonmetal staple 2 can be formed and transferred merely by relatively moving the forming mechanism and the staple pressing mechanism with respect to the nonmetal staple 2. In addition, when the staple legs 2*b* and 2*c* are held by the staple pressing mechanism, it is possible to maintain the formed state of a U shape, and it is possible to suppress the staple legs 2*b* and 2*c* from being deformed. Therefore, it is possible to more stably form the nonmetal staple 2.

(Configuration 2) The forming mechanism may be configured to include the forming member 102 which bends the nonmetal staple 2 to be formed in a U shape. The forming member 102 may be configured to include the pair of arms 102*a* which extend substantially parallel to the direction of bending and forming the nonmetal staple 2 in a U shape, bend the staple legs 2*b* and 2*c* and hold the pair of staple legs 2*b* and 2*c* of the nonmetal staple formed in a U shape.

The pair of arms 102*a* are elastically deformable in a direction expanding or compressing the interval therebetween, and are preferably configured such that the interval between the portions on the tip side (protrusion 102*b*) where the tips of the pair of staple legs 2*b* and 2*c* are held is narrower than the interval between the pair of staple legs 2*b* and 2*c* of the nonmetal staple 2 formed in a U shape.

(Operational effect 2) With the configuration, when the staple legs 2*b* and 2*c* are held by the pair of arms 102*a*, the staple tips are slightly closed inwardly by the portions on the tip side (protrusion 102*b*) where the interval is narrower than that between the staple legs 2*b* and 2*c*. For this reason, even when the staple legs 2*b* and 2*c* are slightly deformed, the staple tip can be easily handled by the staple pressing mechanism, and the nonmetal staple 2 can be stably formed.

(Configuration 3) The staple pressing mechanism is disposed through the insertion interval of the pair of staple legs 2*b* and 2*c* of the nonmetal staple 2 formed in a U shape, and includes the pair of staple pressing parts 105 which relatively move with respect to the nonmetal staple 2 and inwardly take the pair of staple legs 2*b* and 2*c*.

The staple pressing parts 105 are preferably configured to hold the tips of the pair of staple legs 2*b* and 2*c* in a state where the pair of arms 102*a* hold the pair of staple legs 2*b* and 2*c* when receiving the nonmetal staple 2 from the forming mechanism.

(Operational effect 3) With the configuration, the pair of staple legs 2*b* and 2*c* can be inserted into the pair of staple pressing parts 105 and reliably held therein merely by relatively moving the staple pressing mechanism with respect to the nonmetal staple 2. In addition, the opening of the staple legs 2*b* and 2*c* can be suppressed to maintain the U shape by holding the staple legs 2*b* and 2*c* using the staple pressing part 105 before the nonmetal staple 2 is separated from the arm 102*a*. Therefore, it is possible to stably form the nonmetal staple 2. In addition, there is no need to perform an open/close operation of the staple pressing part 105 and thus no need to provide the additional member. The forming mechanism and the staple pressing mechanism can be simplified, and the number of components can be reduced. The stapler 1 can be provided at a low cost.

(Configuration 4) At least one of the staple pressing mechanism and the forming mechanism may include an engaging part (elastic piece 106) which integrally engages with the other one in a relatively movable manner when the nonmetal staple 2 is transferred between the forming mechanism and the staple pressing mechanism.

(Operational effect 4) With the configuration, for example, the nonmetal staple 2 may be formed by the forming mechanism by releasing the engagement of the engaging part to allow only the forming mechanism to move relatively to the nonmetal staple 2. After forming, the forming mechanism and the staple pressing mechanism are engaged by the engaging part and integrated to relatively move, so that the staple pressing mechanism may hold the staple legs 2*b* and 2*c* in a state where the nonmetal staple 2 formed in a U shape by the forming mechanism is held. Therefore, the U-shape state can be maintained by suppressing the opening of the staple legs 2*b* and 2*c*, and the nonmetal staple 2 can be transferred more smoothly and reliably and can be formed more stably.

(Configuration 5) The penetration mechanism 37 equipped with the pair of cutting blades 36*a* and 36*b* which allow the pair of staple legs 2*b* and 2*c* of the nonmetal staple 2 to penetrate the sheet P is included, and the forming mechanism may be integrally provided with the penetration mechanism 37.

(Operational effect 5) With the configuration, the forming mechanism can be operated in conjunction with the penetration mechanism 37, and the number of the components can be reduced. For this reason, the space for the forming mechanism can be saved, and the stapler 1 can be minimized.

(Configuration 6) The forming mechanism may be contained in the staple pressing mechanism in a relatively movable manner.

(Operational effect 6) With the configuration, the forming mechanism and the staple pressing mechanism can be reduced in volume, and the stapler 1 can be miniaturized. In addition, the forming mechanism can be relatively moved in the staple pressing mechanism, and the movement of the forming mechanism can be simply controlled by restricting the movement within a desired range.

Guide structure and operational effect of cutting blades 36*a* and 36*b* of cutting blade guide 117

(Configuration 1) As described above, the stapler 1 of the embodiment includes the penetration mechanism 37 equipped with the pair of cutting blades 36*a* and 36*b* which allow the pair of staple legs 2*b* and 2*c* of the nonmetal staple 2 to penetrate the sheet P, and the bending mechanism 38 which bends the pair of staple legs 2*b* and 2*c* penetrating the sheet P along the sheet P. In addition, there is included the cutting blade guide 117 which guides the inside of the pair of cutting blades 36*a* and 36*b* penetrating the sheet P.

The cutting blade guide 117 includes the first guide part 117*a* which is positioned between the pair of cutting blades 36*a* and 36*b* and guides a portion, which penetrates from the sheet P, of the cutting blades 36*a* and 36*b*, and the second guide part 117*b* which guides a part of a portion, which penetrates from the sheet P, of the cutting blade 36*a* and 36*b*.

Before the pair of cutting blades 36*a* and 36*b* penetrate the sheet P and the bending mechanism 38 bends the staple legs 2*b* and 2*c*, the first guide part 117*a* is positioned between the cutting blade 36*a* and 36*b* to guide the cutting blade 36*a* and 36*b*. When the pair of cutting blades 36*a* and 36*b* penetrate the sheet P and the bending mechanism 38 bends the staple legs 2*b* and 2*c*, the second guide part 117*b* is positioned between the cutting blade 36*a* and 36*b* to guide the cutting blade 36*a* and 36*b*.

(Operational effect 1) With the configuration, before the pair of cutting blades 36*a* and 36*b* penetrate the sheet P and the bending mechanism 38 bends the staple legs 2*b* and 2*c*, a portion, which penetrates from the sheet P, of the cutting blade 36*a* and 36*b* penetrating the sheet P is guided by the first guide part 117*a*, and flowing (deformation) in an inward direction of the cutting blade 36*a* and 36*b* can be suppressed. In addition, when the pair of cutting blades 36*a* and 36*b* penetrate the sheet P and the bending mechanism 38 bends the staple legs 2*b* and 2*c*, a part of a portion, which penetrates from the sheet P, of the cutting blade 36*a* and 36*b* is guided by the second guide part 117*b*, and the fluctuation of the cutting blade 36*a* and 36*b* in the right and left direction Y and the inward deformation can be suppressed. For this reason, there is no need to perform guidance in the bending members 120*a* and 120*b*, for example. In addition, the first guide part 117*a* and the second guide part 117*b* can be switched merely by moving the cutting blade guide 117. Therefore, the tips of the cutting blades 36*a* and 36*b* can be always guided by the first guide part 117*a* and the second guide part 117*b*. The deformation of the cutting blades 36*a* and 36*b* of the penetration mechanism 37 can be suppressed by a small number of components and a simple configuration. The binding operation can be performed smoothly.

(Configuration 2) A cutting blade guiding driver (slide member 122) is included which can move the cutting blade guide 117 in a direction of bending the staple legs 2*b* and 2*c*, and the cutting blade guide 117 may be configured such that the first guide part 117*a* and the second guide part 117*b* are disposed in parallel in a direction of bending the staple legs 2*b* and 2*c*. At this time, the cutting blade guide driver preferably move the cutting blade guide 117 such that the first guide part 117*a* is positioned between the cutting blade 36*a* and 36*b* before the pair of cutting blades 36*a* and 36*b* penetrate the sheet P and the bending mechanism 38 bends the staple legs 2*b* and 2*c*. When the pair of cutting blades 36*a* and 36*b* penetrate the sheet P and the bending mechanism 38 bends the staple legs 2*b* and 2*c*, the cutting blade guide driver preferably move the cutting blade guide 117 such that the second guide part 117*b* is positioned between the cutting blade 36*a* and 36*b*.

(Operational effect 2) With the configuration, the movement of the first guide part 117*a* and the second guide part 117*b* can be easily performed merely by moving the cutting blade guide driver (slide member 122) in a direction of bending the staple legs 2*b* and 2*c*, and the guidance can be made more stably. Incidentally, the first guide part 117*a* and the second guide part 117*b* may be separated or integrated as long as the first guide part 117*a* and the second guide part 117*b* are disposed in parallel and movable by the cutting blade guide driver.

(Configuration 3) In addition, as described above, the stapler 1 of the embodiment includes the penetration mechanism 37 equipped with the pair of cutting blades 36*a* and 36*b* which allow the pair of staple legs 2*b* and 2*c* of the nonmetal staple 2 to penetrate the sheet P, and the bending mechanism 38 which bends the pair of staple legs 2*b* and 2*c* penetrating the sheet P along the sheet P. In addition, there is included the cutting blade guide 117 which guides the inside of the pair of cutting blades 36*a* and 36*b* penetrating the sheet P.

The cutting blade guide 117 includes the first guide part 117*a* which is positioned between the pair of cutting blades 36*a* and 36*b* and guides a portion, which penetrates from the sheet P, of the cutting blade 36*a* and 36*b*, and the second guide part 117*b* which guides a part of a portion, which penetrates from the sheet P, of the cutting blade 36*a* and 36*b*. The first guide part 117*a* and the second guide part 117*b* include a continuous surface which normally supports the inside of the cutting blades 36*a* and 36*b* when the sheet P is penetrated and the bending mechanism 39 bends the pair of staple legs 2*b* and 2*c* penetrating the sheet P.

(Operational effect 3) With the configuration, similarly to (Operation effect 1) described in (Configuration 1), the fluctuation of the cutting blade 36*a* and 36*b* in the right and left direction Y and the inward deformation can be suppressed. In addition, the inside of the cutting blade 36*a* and 36*b* can be normally indicated by the continuous surface during a period until the bending mechanism 39 bends the pair of staple legs 2*b* and 2*c* penetrating the sheet P after the pair of cutting blades 36*a* and 36*b* penetrate the sheet P. It is possible to more effectively suppress the fluctuation of the cutting blade 36*a* and 36*b* in the right and left direction Y and the inward deformation.

(Configuration 4) The first guide part 117*a* and the second guide part 117*b* may be configured by one component.

(Operational effect 4) With the configuration, the cutting blade guide 117 can be configured more simply with a less number of components, and also can be minimized. In addition, the first guide part 117*a* and the second guide part 117*b* can easily move in synchronization and be switched.

(Configuration 5) The height of the first guide part 117*a* is substantially the same as that of the sheet base 7 where the sheet P is placed, and the height of the second guide part 117*b* is preferably lower than the first guide part 117*a*.

(Operational effect 5) With the configuration, a load when the pair of cutting blades 36*a* and 36*b* penetrate the sheet P can be reduced, and it is possible to prevent that the penetrating operation of the penetration mechanism 37 is performed smoothly so as to widen the through hole p1 excessively more than necessary. Therefore, the sheet P can be stably bound by the nonmetal staple 2. In addition, since the second guide part 117*b* is disposed lower than the first guide part 117*a*, the inside surface in the vicinity of the blade edge can be guided even when the pair of cutting blades 36*a* and 36*b* deeply penetrate the sheet P. The bending operation can be smoothly performed by the bending mechanism 38 even when the second guide part 117*b* is positioned between the cutting blade 36*a* and 36*b*.

(Configuration 6) The cutting blade guide 117 may be provided in the driving member (slide member 122) which drives the bending mechanism 38.

(Operational effect 6) With the configuration, between the pair of cutting blades 36*a* and 36*b*, the first and second guide parts 117*a* and 117*b* can be disposed to be easily switched by driving the driving member (reciprocation of the slide member 122). Therefore, there is no need to individually provide the driving member for each cutting blade guide 117, and it is possible to realize that the number of components is reduced, and the configuration is simplified and minimized. In addition, it is possible to easily and more accurately match timing of the bending operation of the bending mechanism 38 and the driving operation of the cutting blade guide 117, and the penetrating operation and the bending operation can be performed more smoothly.

(Configuration 7) The first guide part 117*a* may be provided with the chamfered portion 117*c* at the corner on a side near the second guide part 117*b*.

(Operational effect 7) With the configuration, the first guide part moves while picking up the staple legs 2*b* and 2*c* by the chamfered portion 117*c* when the bending operation is completed and the first guide part 117*a* performs the returning operation toward between the pair of cutting blades 36*a* and 36*b*.

For this reason, the returning operation of the first guide part 117*a* on the lower side of the staple legs 2*b* and 2*c* can be performed more smoothly, and the staple legs 2*b* and 2*c* can be suppressed from being flipped over, so that the sheet P can be bound more stably.

Bending structure and operational effect of bending mechanism 38

(Configuration 1) As described above, the stapler 1 of the embodiment includes the penetration mechanism 37 equipped with the pair of cutting blades 36*a* and 36*b* which allow the pair of staple legs 2*b* and 2*c* of the nonmetal staple 2 to penetrate the sheet P, and the bending mechanism 38 which bends the pair of staple legs 2*b* and 2*c* penetrating the sheet P along the sheet P.

In the pair of cutting blades 36*a* and 36*b*, the hole parts 116*a* and 116*b* (or the notched parts) are provided in the second penetration parts 113*a* and 113*b* (penetration parts) penetrating the sheet P.

The bending mechanism 38 includes, as illustrated in FIGS. 45A through 45C, the first and second bending members 120*a* and 120*b* which move along the direction of bending the pair of staple legs 2*b* and 2*c* inward and protrude from the hole parts 116*a* and 116*b* toward between the pair of cutting blades 36*a* and 36*b* so as to bend the pair of staple legs 2*b* and 2*c*, the first and second guide surfaces 123*a* and 123*b* which guide the first and second bending members 120*a* and 120*b* in the bending direction, and the slide member 122 (driving member) which drives the first and second bending members 120*a* and 120*b* in the bending direction. The first and second bending members 120*a* and 120*b* are disposed between the first and second guide surfaces 123*a* and 123*b* and the slide member 122.

(Operational effect 1) In order to favorably bind the sheet P by the nonmetal staple 2, the pair of staple legs 2*b* and 2*c* are necessarily bent to be overlapped with the crown 2*a* in parallel. In the conventional configuration where the bending is performed from down to up by rotating the bending member, a pressing member of pressing and deforming the staple tip inward and a wall surface for suppressing the staple legs from escaping (deformation) in the front and rear direction X are necessarily provided, and the number of the components is large and thus the structure is complicate.

In this regard, the first and second bending members 120*a* and 120*b* are configured to straightly protrude from the hold parts 116*a* and 116*b* of the pair of cutting blades 36*a* and 36*b*. Further, the first and second bending members 120*a* and 120*b* are disposed between the guide surfaces 123*a* and 123*b* which guide the first and second bending members in the bending direction of the pair of staple legs 2*b* and 2*c* (that is, a direction substantially parallel to the crown 2*a*), and the slide member 122 which drives the first and second bending members 120*a* and 120*b*.

With the configuration, when the slide member 122 operates, the first and second bending members 120*a* and 120*b* are guided and move to the guide surfaces 123*a* and 123*b*, and straightly protrude obliquely upward from the hole parts 116*a* and 116*b*, so that the pair of staple legs 2*b* and 2*c* are bent. For this reason, the pair of staple legs 2*b* and 2*c* can be bent in substantially parallel to the crown 2*a*.

The bending mechanism 38 excellent in the bending function can be realized by disposing the first and second bending members 120*a* and 120*b* between the guide surfaces 123*a* and 123*b* and the slide member 122. For this reason, the staple legs 2*b* and 2*c* of the nonmetal staple 2 can be reliably bent by a small number of components and a simple configuration, and the staple 1 can be provided at a low cost. In addition, the stapler 1 can also be reduced in size and weight.

(Configuration 2) The slide member 122 may be configured to reciprocate in a direction (front and rear direction X) intersecting with the inserting-and-releasing direction (vertical direction Z) of the pair of cutting blades 36*a* and 36*b*. The slide member may include the first and second operation parts 137*a* and 137*b* which press upward the first and second bending members 120*a* and 120*b* toward the pair of staple legs 2*b* and 2*c* according to a forward travel operation. In this case, the first and second bending members 120*a* and 120*b* may be configured to be depressed by the first and second operation parts 137*a* and 137*b* according to the backward travel operation of the slide member 122. Alternatively, the depressing operation may be performed using other members such as a spring.

(Operational effect 2) With the configuration, the first and second operation parts 137*a* and 137*b* can smoothly move in the bending direction by the slide member 122.

(Configuration 3) In addition, the slide member 122 may be configured to reciprocate in a direction (front and rear direction X) intersecting with the inserting-and-releasing direction (vertical direction Z) of the pair of cutting blades 36*a* and 36*b*. The slide member 122 may include the first and second operation parts 137*a* and 137*b* which widen the interval between the first and second bending members 120*a* and 120*b* according to the backward travel operation so as to move the bending protrusions 124*a* and 124*b*, which protrude toward between the pair of cutting blades 36*a* and 36*b*, of the first and second bending members 120*a* and 120*b* in a direction to come out from the hole parts 116*a* and 116*b* of the pair of cutting blades 36*a* and 36*b*.

In this case, the pair of the first and second bending members 120*a* and 120*b* may be configured such that the interval therebetween is narrowed by the first and second operation parts 137*a* and 137*b* according to the forward travel operation, and the bending protrusions 124*a* and 124*b* move from the hole parts 116*a* and 116*b* of the pair of cutting blades 36*a* and 36*b* in the protruding direction. Alternatively, the movement operation in the protruding direction may be performed by other members such as a spring.

(Operational effect 3) With the configuration, the first and second bending members 120*a* and 120*b* can smoothly return to the initial position by the slide member 122.

(Configuration 4) The slide member 122 may be configured to move one of the first and second bending members 120*a* and 120*b* so as to move the other one of the first and second bending members 120*b* and 120*a* with a predetermined phase difference interposed therebetween.

(Operational effect 4) With the configuration, the pair of staple legs 2*b* and 2*c* can be overlapped by sequentially bending without causing interference therein, and the bending operation can be performed more smoothly.

Connection Structure and Operational Effect of Link 18

(Configuration 1) As described above, the stapler 1 of the embodiment includes the operation handle 6 (operation member) which reciprocates according to the operation of the operator, the link 18 which operates in conjunction with the reciprocating operation of the operation handle 6, and the bending mechanism 38 which bends the pair of staple legs 2*b* and 2*c* of the nonmetal staple 2 penetrating the sheet P along the sheet P. The bending mechanism 38 includes the first and second bending members 120*a* and 120*b* which bend the pair of staple legs 2*b* and 2*c* inward as illustrated in FIGS. 42A to 42F, and the slide member 122 (driving member) which drives the first and second bending members 120*a* and 120*b*. Further, the slide member 122 is configured to be connected to the link 18, and comes in conjunction with the operation of the operation handle 6 through the link 18. More specifically, the operation handle 6 and the link 18 are connected by the link shaft 15, and the slide member 122 and the link 18 are connected by the shaft 26 (slider driving shaft), so that the operation handle 6 and the bending mechanism 38 can come in conjunction with each other through the link 18.

(Operational effect 1) Herein, even in a case where the operation handle 6 and the bending mechanism 38 are not mechanically connected, and the bending mechanism 38 operates independent of the operation of the operation handle 6 (for example, the bending mechanism 38 does not return to the initial position due to a clogging of the nonmetal staple 2), the operation handle 6 returns to the initial position normally. For this reason, the operator may keep operating without knowing an operation failure, and thus there may be an influence on the operability and the durability of the stapler 1.

In this regard, the operation handle 6 and the slide member 122 of the bending mechanism 38 are mechanically connected by the link 18. With the configuration, the operation of the operation handle 6 and the operation and the returning operation of the bending mechanism 38 can be performed in conjunction. For this reason, when the operation failure occurs in any one of these operations, the other predetermined operations may also be affected through the link 18. Therefore, the operator can reliably grasp the operation failure, and can quickly cope with that failure. For this reason, it is possible to improve the durability and the operability of the stapler 1. In addition, the stapler 1 excellent in the durability and the operability can be realized with a small number of components and a simple configuration at a low cost merely by connecting the operation handle 6 and the slide member 122 with the link 18.

(Configuration 2) In addition, the driving member connected to the link 18 may be the slide member 122 which reciprocates in conjunction with the operation of the link 18. The slide member 122 may include inclined surfaces (first and second operation parts 137*a* and 137*b*) which guide the first and second bending members 120*a* and 120*b* in a direction of bending the staple legs 2*b* and 2*c*.

(Operational effect 2) With the configuration, when the slide member 122 performs the forward travel operation or the backward travel operation, the first and second bending members 120*a* and 120*b* can be smoothly guided in a direction of bending the staple legs 2*b* and 2*c* through the inclined surfaces (first and second operation parts 137*a* and 137*b*).

(Configuration 3) In addition, there may be provided the penetration mechanism 37 equipped with the pair of cutting blades 36*a* and 36*b* which allow the pair of staple legs 2*b* and 2*c* of the nonmetal staple 2 to penetrate the sheet P, and performs the inserting-and-releasing operation of the pair of cutting blades 36*a* and 36*b* on the sheet P in conjunction with the reciprocating operation of the operation handle 6. More specifically, the penetration mechanism 37 and the bending mechanism 38 can operate in conjunction through the link 18 by connecting the penetration mechanism 37 and the link 18 using the link shaft 15.

(Operational effect 3) With the configuration, the penetrating operation of the penetration mechanism 37 driven by the operation handle 6, the bending operation of the bending mechanism 38, and the returning operation of these mechanisms can be performed in conjunction through the link 18, and the respective operations can be performed at appropriate timing. In addition, the operator can reliably grasp an operation failure occurring in any one of the operation of the penetration mechanism 37 and the bending mechanism 38, and quickly cope with that failure. For this reason, it is possible to improve the durability of the penetration mechanism 37 and the bending mechanism 38.

(Configuration 4) In addition, there may be provided the pusher 61 (transportation member) which transports the nonmetal staple 2 in a predetermined transporting direction (front and rear direction X), and the link 18 may be configured to allow the pusher 61 to reciprocate with respect to the transporting direction (front and rear direction X) in conjunction with the reciprocating operation of the operation handle 6. More specifically, since the link 18 pushes the shaft 25 (pusher driving shaft) inserting into the pusher 61 using the pressing protrusion 30, the pusher 61 reciprocates with respect to the transporting direction in correspondence with the operation of the operation handle 6.

(Operational effect 4) With the configuration, for example, the pusher 61 is retracted rearward during a period where the sheet P is bound by the penetration mechanism 37 and the bending mechanism 38 so as not to hinder the operations of the penetration mechanism 37 and the bending mechanism 38. Further, a new nonmetal staple 2 can be sent between the pair of cutting blades 36*a* and 36*b* by advancing the pusher 61 using the link 18 at the timing when the sheet P is completely bound. For this reason, the penetrating operation, the bending operation, the transporting operation of the nonmetal staple 2, and the returning operation thereof can be performed at an appropriate timing in conjunction with the link 18. In addition to the operation failure of the penetration mechanism 37 and the bending mechanism 38, the operator can also reliably grasp the operation failure of the pusher 61, and quickly cope with that failure. For this reason, it is possible to improve the durability of the penetration mechanism 37, the bending mechanism 38, and the pusher 61.

Hitherto, the embodiments have been described in detail with reference to the drawings, but the embodiments are given as merely exemplary. Therefore, the invention is not limited only to the embodiments. Changes may be made within a scope not departing from the spirit, and it is a matter of course that these changes are contained in the invention. In addition, for example, in a case where a plurality of configurations are contained in each embodiment, it is a matter of course that these configurations can be combined even not elsewhere specified. In addition, in a case where a plurality of embodiments and modifications are disclosed, it is a matter of course that a possible combination of these configurations is included in the invention. In addition, it is a matter of course that the configurations illustrated in the drawings are included in the invention even when there is no particular description thereof. Further, the expression "such as" is used to mean that those identical or similar are included. In addition, the expressions "substantially", "about", and "to some extent" are used to mean that those falling within a range or accuracy accepted in a common sense.

REFERENCE SIGNS LIST

1 stapler
2 nonmetal staple
2*b*, 2*c* staple leg
3 connection staple
4 hole part
6 operation handle (operation part)
7 sheet base (sheet placement part)
11 handle operation part
18 link
32 transportation path
34 transportation mechanism

35 cutting forming mechanism (cutting mechanism, forming mechanism, staple pressing mechanism)
36, 36*a*, 36*b* cutting blade
37 penetration mechanism
38 bending mechanism
61 pusher (transportation member)
81 positioning part
82 returning part
84 staple holding part
85 abutting surface
86 engaging part
87 engaging member
88 release regulation part
91 first regulation part
92 staple pressing plate (staple pressing mechanism)
93 second regulation part
95 gap
96 gap
101 cutting blade (cutting mechanism)
102 forming member (forming mechanism)
102*a* arm
105 staple pressing part
106 elastic piece (engaging part)
113*a*, 113*b* second penetrating part (penetration part)
116*a*, 116*b* hole part
117 cutting blade guide
117*a* first guide part
117*b* second guide part
117*c* chamfered portion
120*a* first bending member
120*b* second bending member
123*a*, 123*b* guide surface
122 slide member (driving member)
137*a* first operating part (operation part and inclined surface)
137*b* second operating part (operation part and inclined surface)
P sheet (binding object)
X front and rear direction (transporting direction)

The invention claimed is:

1. A stapler comprising:

a penetration mechanism that is mounted with a pair of cutting blades which allow a pair of staple legs of a nonmetal staple to penetrate a binding object; and a bending mechanism that bends the pair of staple legs which penetrate the binding object, along the binding object, wherein the pair of cutting blades have hole parts or notched parts in penetration parts which penetrate the binding object, the bending mechanism includes:

a pair of bending members which move along a bending direction in which the pair of staple legs bend inward and which protrude from the hole parts or the notched parts toward between the pair of cutting blades so as to bend the pair of staple legs;

guide surfaces which guide the pair of bending members in the bending direction; and a driving member which drives the pair of bending members, and the pair of bending members are provided between the guide surfaces and the driving member.

2. The stapler according to claim 1, wherein the driving member is configured to reciprocate in a direction which intersects with an inserting-and-releasing direction of the pair of cutting blades with respect to the binding object, and the driving member includes operation parts which press the pair of bending members to move in a direction to bring the bending members close to the pair of staple legs along the inserting-and-releasing direction according to a forward travel operation.

3. The stapler according to claim 1, wherein the driving member is configured to reciprocate in the direction which intersects with an inserting-and-releasing direction of the pair of cutting blades with respect to the binding object, and the driving member includes operation parts which widen an interval between the pair of bending members according to a backward travel operation and which moves portions of the pair of bending members in a direction to release from the hole parts of the pair of cutting blades, the portions of the pair of bending members protruding toward between the pair of cutting blades.

4. The stapler according to claim 1, wherein the driving member is configured to drive one of the bending members and to drive the other one of the bending members with a predetermined phase difference.

5. The stapler according to claim 1, wherein the guide surfaces include inclined surfaces which are provided in a stapler body and which guide the pair of bending members in the bending direction.

6. The stapler according to claim 5, wherein the pair of bending members include first and second inclined surfaces which are engaged with the guide surfaces of the stapler body.

7. The stapler according to claim 6, wherein the pair of bending members include first and second operating stepped portions with which the driving member is engaged.

8. The stapler according to claim 7, wherein the driving member includes first and second side walls which are engaged with the first and second operating stepped portions to control a movement of the pair of bending members in a vertical direction which is an inserting-and-releasing direction of the pair of cutting blades, and to control the movement of the pair of bending members in a right-and-left direction which is a direction approaching and separating direction of the pair of bending members.

* * * * *